US012096905B2

(12) United States Patent
Gray et al.

(10) Patent No.: US 12,096,905 B2
(45) Date of Patent: Sep. 24, 2024

(54) SPOT CLEANER APPARATUS

(71) Applicant: DUPRAY VENTURES INC., Montreal (CA)

(72) Inventors: Brent Gray, Montreal (CA); Michel Morand, Verdun (CA)

(73) Assignee: DUPRAY VENTURES INC., Montreal (CA)

( * ) Notice: Subject to any disclaimer, the term of this patent is extended or adjusted under 35 U.S.C. 154(b) by 0 days.

(21) Appl. No.: 17/697,225

(22) Filed: Mar. 17, 2022

(65) Prior Publication Data

US 2022/0296057 A1 Sep. 22, 2022

Related U.S. Application Data

(60) Provisional application No. 63/162,250, filed on Mar. 17, 2021.

(51) Int. Cl.
*A47L 7/00* (2006.01)
*A47L 9/06* (2006.01)
(Continued)

(52) U.S. Cl.
CPC ..... *A47L 7/0023* (2013.01); *A47L 7/0009* (2013.01); *A47L 7/0042* (2013.01); *A47L 9/06* (2013.01); *A47L 9/248* (2013.01); *A47L 9/2857* (2013.01); *A47L 9/327* (2013.01); *A47L 11/30* (2013.01); *A47L 11/4008* (2013.01);
(Continued)

(58) Field of Classification Search
CPC .... A47L 7/0023; A47L 7/0009; A47L 7/0042; A47L 9/06; A47L 9/248; A47L 9/2857; A47L 9/327; A47L 11/30; A47L 11/4008; A47L 11/4016; A47L 11/4036; A47L 11/4075; A47L 11/4083; A47L 11/4088; A47L 11/201; A47L 11/34; A47L 5/22; A47L 9/00; A47L 9/0606; A47L 9/18; A47L 9/24; A47L 9/32
See application file for complete search history.

(56) References Cited

U.S. PATENT DOCUMENTS

D173,441 S 11/1954 Lambert
D198,492 S 6/1964 Buda
(Continued)

OTHER PUBLICATIONS

EP Communication; Extended European Search Report; Application No. 22162573.4-1016; dated Jul. 8, 2022; pp. 1-8.
(Continued)

*Primary Examiner* — David Redding
(74) *Attorney, Agent, or Firm* — CANTOR COLBURN LLP

(57) ABSTRACT

A spot cleaner apparatus may have a clean fluid tank configured for holding a cleaning fluid. A dirty fluid tank may include an integrated liquid/air separator. A cleaning head may be fluidly coupled to the clean fluid tank, the cleaning head including one or more vacuum inlets and a fluid-nebulizing orifice configured to dispense the cleaning fluid in a mist-like fashion. A pump assembly may fluidly couple the clean fluid tank to the cleaning head. A fluid heater heats the cleaning fluid at or between the clean fluid tank and the fluid-nebulizing orifice. A vacuum assembly configured for drawing a vacuum airflow from one or more vacuum inlets in the cleaning head through the integrated liquid/air separator in the dirty fluid tank.

24 Claims, 42 Drawing Sheets

(51) Int. Cl.

| | |
|---|---|
| ***A47L 9/24*** | (2006.01) |
| ***A47L 9/28*** | (2006.01) |
| ***A47L 9/32*** | (2006.01) |
| ***A47L 11/30*** | (2006.01) |
| ***A47L 11/40*** | (2006.01) |

(52) U.S. Cl.

CPC ..... *A47L 11/4016* (2013.01); *A47L 11/4036* (2013.01); *A47L 11/4075* (2013.01); *A47L 11/4083* (2013.01); *A47L 11/4088* (2013.01)

(56) References Cited

U.S. PATENT DOCUMENTS

D212,710 S 11/1968 Mango
3,775,053 A 11/1973 Wisdom
3,896,521 A 7/1975 Parise
4,353,145 A 10/1982 Woodford
4,910,828 A 3/1990 Blase et al.
4,974,282 A * 12/1990 Stoltz ..... A47L 11/4083 15/322
5,146,647 A 9/1992 Blase et al.
D344,377 S 2/1994 Thomas
6,256,833 B1 7/2001 Steinberg
6,344,064 B1 2/2002 Conrad
6,381,804 B1 5/2002 Paterson et al.
6,406,507 B1 6/2002 Paterson et al.
6,446,302 B1 9/2002 Kasper et al.
6,446,303 B1 9/2002 Paterson et al.
6,446,304 B1 9/2002 Paterson et al.
6,467,122 B2 10/2002 Lenkiewicz et al.
6,484,348 B1 11/2002 Paterson et al.
6,490,755 B2 12/2002 Paterson et al.
6,497,002 B2 12/2002 Paterson et al.
6,499,183 B1 12/2002 Paterson et al.
6,532,619 B2 3/2003 Kasper et al.
6,553,599 B2 4/2003 Paterson et al.
6,560,806 B1 5/2003 Lawson et al.
6,609,268 B2 8/2003 Miner
6,616,721 B2 9/2003 Oh
6,658,692 B2 12/2003 Lenkiewicz et al.
6,658,693 B1 12/2003 Reed, Jr.
6,775,880 B2 8/2004 Kasper et al.
6,810,557 B2 11/2004 Hansen et al.
6,842,942 B2 1/2005 Morgan et al.
6,867,174 B2 3/2005 Ramirez, Jr. et al.
6,868,578 B1 3/2005 Kasper et al.
6,880,199 B1 4/2005 Huffman et al.
6,883,202 B2 4/2005 Steffen et al.
6,892,420 B1 5/2005 Haan et al.
6,896,711 B2 5/2005 Oh
6,898,820 B2 5/2005 Kasper et al.
6,934,993 B1 8/2005 Huffman et al.
6,968,593 B1 11/2005 Lenkiewicz et al.
7,013,528 B2 3/2006 Parker et al.
7,021,499 B2 4/2006 Hansen et al.
7,024,724 B2 4/2006 Ponjican et al.
7,048,783 B2 5/2006 Ponjican et al.
7,062,816 B2 6/2006 Kasper et al.
7,073,226 B1 7/2006 Lenkiewicz et al.
7,140,068 B1 11/2006 Vander Baan et al.
7,153,371 B2 12/2006 Hansen et al.
D534,699 S 1/2007 Moine et al.
7,159,273 B2 1/2007 Fawcett
7,188,388 B2 3/2007 Best et al.
7,198,070 B1 4/2007 Hansen et al.
7,208,892 B2 4/2007 Tondra et al.
7,216,783 B2 5/2007 Hansen
7,222,389 B2 5/2007 Morgan et al.
7,225,503 B1 6/2007 Lenkiewicz et al.
7,228,589 B2 6/2007 Miner et al.
7,234,197 B2 6/2007 Tran
7,241,330 B2 7/2007 Moshenrose
7,247,181 B2 7/2007 Hansen et al.
7,258,709 B2 8/2007 Ponjican et al.
7,264,659 B1 9/2007 Moshenrose
7,291,206 B1 11/2007 Kiern et al.
7,305,736 B2 12/2007 Moshenrose
7,306,655 B2 12/2007 Kiern et al.
7,320,149 B1 1/2008 Huffman et al.
7,325,271 B2 2/2008 Paterson et al.
7,346,428 B1 3/2008 Huffman et al.
D566,356 S 4/2008 Medema
D566,357 S 4/2008 Santiago
D566,358 S 4/2008 Santiago
7,357,828 B2 4/2008 Bohlen
7,360,277 B2 4/2008 Moshenrose et al.
7,377,007 B2 5/2008 Best
7,411,133 B2 8/2008 Morgan et al.
7,413,594 B2 8/2008 Paterson et al.
7,444,711 B2 11/2008 Garcia et al.
7,476,885 B2 1/2009 Garcia et al.
7,481,870 B2 1/2009 Kiern et al.
7,484,265 B2 2/2009 Kasper et al.
7,507,980 B2 3/2009 Garcia et al.
7,547,336 B2 6/2009 Fester et al.
7,547,352 B2 6/2009 Paterson et al.
D598,169 S 8/2009 Benacquisto et al.
D598,170 S 8/2009 Benacquisto et al.
D598,615 S 8/2009 Benacquisto et al.
D600,025 S 9/2009 Hill et al.
7,585,344 B2 9/2009 Paterson et al.
7,597,749 B2 10/2009 Paterson et al.
7,624,473 B2 12/2009 Kegg et al.
7,625,424 B2 12/2009 Kiern et al.
7,631,386 B1 12/2009 Santiago et al.
7,631,392 B1 12/2009 Meitz
7,631,396 B2 12/2009 Ivarsson et al.
7,651,544 B1 1/2010 Fester et al.
7,657,964 B2 2/2010 Parr et al.
7,657,965 B2 2/2010 Scott et al.
7,665,172 B1 2/2010 Tran et al.
7,669,901 B2 3/2010 Paterson et al.
7,670,400 B2 3/2010 Reynolds et al.
7,685,671 B2 3/2010 Jansen
D613,918 S 4/2010 Benacquisto
7,691,187 B2 4/2010 Kiern et al.
D615,717 S 5/2010 Butts et al.
7,707,682 B2 5/2010 Parr
7,708,789 B2 5/2010 Fester
7,713,330 B2 5/2010 Bohlen et al.
7,718,593 B2 5/2010 Micciche et al.
7,721,383 B2 5/2010 Garcia et al.
7,722,694 B2 5/2010 Paterson et al.
7,725,223 B2 5/2010 Gordon et al.
D617,966 S 6/2010 Lee et al.
7,725,984 B2 6/2010 Jansen
7,725,985 B2 6/2010 Krebs
7,743,461 B2 6/2010 Carr et al.
D620,652 S 7/2010 Butts et al.
7,748,079 B2 7/2010 McDowell et al.
7,752,705 B2 7/2010 McDowell et al.
7,757,342 B2 7/2010 Gordon et al.
7,758,702 B1 7/2010 Huffman
D621,109 S 8/2010 Benequisto
7,770,256 B1 8/2010 Fester
7,774,895 B2 8/2010 Hansen et al.
7,779,505 B2 8/2010 Krebs et al.
7,784,148 B2 8/2010 Lenkiwicz et al.
7,793,385 B2 9/2010 Huffman
7,799,107 B2 9/2010 Corney et al.
7,811,348 B2 10/2010 Paterson et al.
7,811,349 B2 10/2010 Nguyen
7,819,127 B1 10/2010 Huffman
7,823,250 B2 11/2010 Vander Baan
7,824,120 B1 11/2010 Kasper et al.
7,836,544 B2 11/2010 Jansen
7,845,045 B2 12/2010 Lenkiewicz et al.
7,849,556 B1 12/2010 Jansen
7,857,890 B2 12/2010 Paterson et al.
7,857,893 B2 12/2010 Kiern et al.
7,861,352 B2 1/2011 Reindle
7,861,369 B2 1/2011 Miner et al.
7,862,623 B1 1/2011 Hansen et al.
7,870,638 B2 1/2011 Jansen

(56) References Cited

U.S. PATENT DOCUMENTS

| | | | |
|---|---|---|---|
| 7,891,049 | B1 | 2/2011 | Miner |
| D633,667 | S | 3/2011 | Santiago |
| 7,900,310 | B2 | 3/2011 | Reindle |
| 7,902,140 | B1 | 3/2011 | Hansen |
| 7,904,990 | B1 | 3/2011 | Miner |
| 7,904,991 | B2 | 3/2011 | Ivarsson et al. |
| 7,906,473 | B2 | 3/2011 | Williams et al. |
| 7,908,705 | B2 | 3/2011 | Vanderbaan |
| 7,918,909 | B2 | 4/2011 | McDowell |
| 7,923,707 | B2 | 4/2011 | Garcia et al. |
| 7,934,318 | B2 | 5/2011 | Sowell et al. |
| 7,938,896 | B2 | 5/2011 | Paterson et al. |
| 7,958,652 | B2 | 6/2011 | Huffman et al. |
| 7,966,690 | B2 | 6/2011 | Lenkiewicz |
| 7,967,220 | B2 | 6/2011 | Hansen et al. |
| 7,976,597 | B2 | 7/2011 | Smith |
| 7,979,951 | B2 | 7/2011 | Lenkiewicz et al. |
| 7,979,955 | B2 | 7/2011 | Lenkiewicz et al. |
| 7,987,552 | B2 | 8/2011 | Gordon et al. |
| 7,998,277 | B2 | 8/2011 | Nguyen |
| 8,016,902 | B2 | 9/2011 | Makarov |
| 8,028,370 | B2 | 10/2011 | Gordon et al. |
| 8,032,983 | B2 | 10/2011 | Griffith et al. |
| 8,037,571 | B2 | 10/2011 | Butts et al. |
| 8,051,532 | B1 | 11/2011 | Griffith et al. |
| 8,056,834 | B2 | 11/2011 | Gardner et al. |
| 8,062,398 | B2 | 11/2011 | Luo et al. |
| 8,069,529 | B2 | 12/2011 | Groff et al. |
| 8,071,524 | B2 | 12/2011 | Horton |
| 8,082,624 | B2 | 12/2011 | Myers |
| 8,112,841 | B2 | 2/2012 | Garcia et al. |
| 8,117,713 | B2 | 2/2012 | Kasper et al. |
| 8,117,714 | B2 | 2/2012 | Nguyen et al. |
| 8,118,241 | B2 | 2/2012 | Gardner et al. |
| 8,122,562 | B2 | 2/2012 | Krebs |
| 8,141,754 | B2 | 3/2012 | Conner et al. |
| 8,146,200 | B2 | 4/2012 | Krebs et al. |
| 8,161,596 | B2 | 4/2012 | Cheung et al. |
| 8,161,599 | B2 | 4/2012 | Griffith et al. |
| D660,531 | S | 5/2012 | Benacquisto |
| D660,533 | S | 5/2012 | Hill et al. |
| 8,176,597 | B2 | 5/2012 | Stein et al. |
| 8,176,649 | B2 | 5/2012 | Huffman et al. |
| 8,186,004 | B2 | 5/2012 | Garcia et al. |
| 8,205,296 | B1 | 6/2012 | Bissell et al. |
| D664,728 | S | 7/2012 | Santiago et al. |
| 8,209,815 | B2 | 7/2012 | Makarov et al. |
| 8,214,968 | B2 | 7/2012 | Griffith et al. |
| 8,220,109 | B2 | 7/2012 | Medema et al. |
| 8,230,549 | B2 | 7/2012 | Lenkiewicz et al. |
| 8,230,550 | B2 | 7/2012 | Krebs et al. |
| D665,959 | S | 8/2012 | Hill et al. |
| D667,182 | S | 9/2012 | Santiago et al. |
| D667,183 | S | 9/2012 | Benacquisto |
| D667,185 | S | 9/2012 | Benacquisto |
| 8,261,407 | B2 | 9/2012 | Bozzelli et al. |
| D670,055 | S | 10/2012 | Hill |
| 8,291,540 | B2 | 10/2012 | Chavana, Jr. |
| 8,291,546 | B2 | 10/2012 | Louis et al. |
| D671,283 | S | 11/2012 | Paterson |
| 8,302,248 | B2 | 11/2012 | Chavana, Jr. et al. |
| 8,328,118 | B2 | 12/2012 | Hansen et al. |
| 8,338,354 | B2 | 12/2012 | Williams et al. |
| 8,347,453 | B2 | 1/2013 | Frackowiak |
| 8,349,088 | B1 | 1/2013 | Miner |
| 8,353,074 | B2 | 1/2013 | Krebs |
| 8,365,347 | B2 | 2/2013 | Morgan et al. |
| 8,370,991 | B2 | 2/2013 | Paliobeis et al. |
| 8,375,506 | B2 | 2/2013 | Chaney |
| 8,381,352 | B2 | 2/2013 | Huffman et al. |
| 8,402,599 | B2 | 3/2013 | Charlton et al. |
| 8,407,851 | B2 | 4/2013 | Moyher, Jr. et al. |
| 8,418,310 | B2 | 4/2013 | Krebs |
| 8,418,313 | B1 | 4/2013 | Miner et al. |
| 8,424,153 | B2 | 4/2013 | Fester et al. |
| 8,425,203 | B2 | 4/2013 | Gardner et al. |
| 8,435,189 | B2 | 5/2013 | Bissell |
| 8,438,696 | B2 | 5/2013 | Charlton |
| 8,438,700 | B2 | 5/2013 | Makarov et al. |
| 8,444,068 | B2 | 5/2013 | Hahn et al. |
| 8,458,850 | B2 | 6/2013 | Kasper et al. |
| 8,458,851 | B2 | 6/2013 | Louis et al. |
| 8,458,853 | B2 | 6/2013 | Charlton et al. |
| 8,475,070 | B1 | 7/2013 | Miner et al. |
| 8,495,788 | B2 | 7/2013 | Tran |
| 8,499,411 | B2 | 8/2013 | Tran et al. |
| 8,505,155 | B2 | 8/2013 | Lenkiewicz |
| 8,516,655 | B2 | 8/2013 | Maurer et al. |
| D689,252 | S | 9/2013 | Benacquisto et al. |
| 8,528,166 | B2 | 9/2013 | Morgan |
| 8,533,905 | B1 | 9/2013 | Tran |
| 8,549,697 | B1 | 10/2013 | Moyher, Jr. et al. |
| 8,567,009 | B2 | 10/2013 | Krebs |
| 8,567,418 | B2 | 10/2013 | Reed, Jr. et al. |
| 8,572,804 | B2 | 11/2013 | Tran et al. |
| 8,584,309 | B2 | 11/2013 | Santiago |
| 8,595,893 | B2 | 12/2013 | Morgan et al. |
| 8,606,404 | B1 | 12/2013 | Huffman et al. |
| 8,607,404 | B2 | 12/2013 | Krebs |
| 8,607,405 | B2 | 12/2013 | Reed et al. |
| 8,621,708 | B2 | 1/2014 | Lenkiewicz et al. |
| 8,631,538 | B2 | 1/2014 | Huffman |
| 8,631,541 | B2 | 1/2014 | Tran |
| 8,635,740 | B2 | 1/2014 | Gordon et al. |
| 8,640,301 | B1 | 2/2014 | Lee et al. |
| 8,641,309 | B2 | 2/2014 | Perry et al. |
| D700,757 | S | 3/2014 | Hill et al. |
| D700,759 | S | 3/2014 | Wu et al. |
| 8,662,782 | B2 | 3/2014 | Huffman |
| 8,667,642 | B2 | 3/2014 | Krebs |
| 8,671,509 | B2 | 3/2014 | Reed et al. |
| 8,677,544 | B1 | 3/2014 | Raven et al. |
| 8,677,552 | B2 | 3/2014 | Krebs |
| 8,679,211 | B1 | 3/2014 | Makarov |
| 8,689,399 | B2 | 4/2014 | Liu et al. |
| 8,689,401 | B2 | 4/2014 | Makarov et al. |
| 8,701,245 | B2 | 4/2014 | Charlton et al. |
| 8,707,510 | B2 | 4/2014 | Reed, Jr. |
| 8,719,998 | B1 | 5/2014 | Huffman |
| 8,726,441 | B1 | 5/2014 | Colasanti et al. |
| 8,726,455 | B2 | 5/2014 | Kasper |
| 8,726,457 | B2 | 5/2014 | Liu et al. |
| 8,726,461 | B2 | 5/2014 | Makarov et al. |
| 8,739,358 | B2 | 6/2014 | Stephens et al. |
| 8,752,235 | B2 | 6/2014 | Gordon |
| 8,752,237 | B2 | 6/2014 | DeJonge |
| 8,752,240 | B2 | 6/2014 | Pruiett |
| 8,752,242 | B2 | 6/2014 | Miner et al. |
| 8,756,752 | B2 | 6/2014 | Krondorfer et al. |
| 8,756,753 | B2 | 6/2014 | Reed et al. |
| 8,756,757 | B2 | 6/2014 | Tran |
| D708,407 | S | 7/2014 | Chu et al. |
| 8,769,763 | B2 | 7/2014 | Kloeppel et al. |
| 8,776,312 | B2 | 7/2014 | Overholt et al. |
| 8,784,504 | B2 | 7/2014 | Williams et al. |
| 8,789,235 | B2 | 7/2014 | Krebs et al. |
| 8,789,238 | B2 | 7/2014 | Myers |
| 8,800,106 | B2 | 8/2014 | Bilek et al. |
| 8,806,712 | B2 | 8/2014 | Griffith |
| 8,839,484 | B2 | 9/2014 | Krebs |
| 8,839,485 | B2 | 9/2014 | Morgan |
| 8,844,584 | B1 | 9/2014 | Haley et al. |
| 8,850,654 | B2 | 10/2014 | Nolan et al. |
| 8,869,349 | B2 | 10/2014 | Henderson |
| 8,887,347 | B2 | 11/2014 | Louis et al. |
| 8,914,940 | B2 | 12/2014 | Morgan et al. |
| 8,925,146 | B2 | 1/2015 | Kasper |
| 8,926,208 | B2 | 1/2015 | Johnson et al. |
| 8,927,480 | B2 | 1/2015 | Williams et al. |
| D724,283 | S | 3/2015 | Manning et al. |
| 8,973,215 | B2 | 3/2015 | Makarov |
| 8,978,199 | B2 | 3/2015 | Kasper et al. |
| 8,978,200 | B2 | 3/2015 | Lenkiewicz et al. |
| 8,985,336 | B1 | 3/2015 | Yost et al. |

(56) References Cited

U.S. PATENT DOCUMENTS

| | | | |
|---|---|---|---|
| 8,991,000 | B2 | 3/2015 | Huffman et al. |
| 8,991,003 | B2 | 3/2015 | Krebs |
| 8,999,911 | B2 | 4/2015 | Armstrong et al. |
| 9,009,914 | B2 | 4/2015 | Tran |
| 9,015,898 | B2 | 4/2015 | Nguyen |
| D730,600 | S | 5/2015 | Springell et al. |
| 9,033,316 | B2 | 5/2015 | Hansen et al. |
| D733,376 | S | 6/2015 | Bennett et al. |
| D733,377 | S | 6/2015 | Bennett et al. |
| 9,049,972 | B1 | 6/2015 | Krebs |
| 9,072,415 | B2 | 7/2015 | Krebs |
| 9,072,417 | B2 | 7/2015 | Moyher, Jr. et al. |
| 9,074,622 | B2 | 7/2015 | Morgan et al. |
| D735,957 | S | 8/2015 | Marks et al. |
| D737,527 | S | 8/2015 | Springell et al. |
| 9,107,558 | B2 | 8/2015 | Lenkiewicz et al. |
| D739,101 | S | 9/2015 | Springell et al. |
| 9,125,538 | B2 | 9/2015 | Paliobeis |
| 9,125,540 | B2 | 9/2015 | Tran et al. |
| 9,126,964 | B2 | 9/2015 | Masuno et al. |
| 9,138,113 | B2 | 9/2015 | Nesom et al. |
| 9,138,119 | B1 | 9/2015 | Bantum |
| D740,503 | S | 10/2015 | Tyler |
| D741,559 | S | 10/2015 | Marsden et al. |
| D741,560 | S | 10/2015 | Bennett et al. |
| D742,085 | S | 10/2015 | Bennett et al. |
| 9,149,165 | B2 | 10/2015 | Krebs et al. |
| 9,155,436 | B2 | 10/2015 | Tran et al. |
| 9,155,437 | B2 | 10/2015 | Williams et al. |
| 9,155,439 | B2 | 10/2015 | Liter |
| 9,186,028 | B2 | 11/2015 | White et al. |
| 9,215,959 | B2 | 12/2015 | Heidenga et al. |
| D747,567 | S | 1/2016 | Marks et al. |
| 9,233,402 | B2 | 1/2016 | Morgan |
| 9,247,855 | B2 | 2/2016 | Hansen et al. |
| 9,259,126 | B2 | 2/2016 | Niederman |
| 9,267,698 | B2 | 2/2016 | Stearns |
| 9,271,619 | B2 | 3/2016 | Gordon et al. |
| 9,277,845 | B2 | 3/2016 | Griffith et al. |
| 9,277,846 | B2 | 3/2016 | Makarov et al. |
| 9,279,555 | B2 | 3/2016 | Bassett |
| 9,282,862 | B2 | 3/2016 | Henderson et al. |
| 9,289,709 | B2 | 3/2016 | Barker |
| 9,295,365 | B2 | 3/2016 | Huffman et al. |
| 9,307,881 | B2 | 4/2016 | Salo et al. |
| 9,320,402 | B2 | 4/2016 | Krondorfer et al. |
| 9,320,405 | B2 | 4/2016 | Luedke et al. |
| 9,320,408 | B2 | 4/2016 | Hansen et al. |
| 9,351,623 | B2 | 5/2016 | Carter |
| 9,351,625 | B2 | 5/2016 | Carter |
| 9,376,228 | B1 | 6/2016 | Haley et al. |
| D761,505 | S | 7/2016 | Tyler et al. |
| D762,026 | S | 7/2016 | Tyler |
| 9,380,921 | B2 | 7/2016 | Nguyen et al. |
| 9,392,919 | B2 | 7/2016 | Kasper |
| 9,392,922 | B2 | 7/2016 | Lenkiewicz |
| 9,398,836 | B2 | 7/2016 | Luedke et al. |
| 9,402,516 | B2 | 8/2016 | Pilch |
| 9,402,519 | B2 | 8/2016 | Andrikanich et al. |
| 9,402,521 | B2 | 8/2016 | Bassett et al. |
| 9,402,522 | B2 | 8/2016 | Bassett et al. |
| 9,409,213 | B2 | 8/2016 | Huffman et al. |
| 9,414,733 | B2 | 8/2016 | Vail et al. |
| 9,420,932 | B2 | 8/2016 | Hansen |
| 9,427,128 | B2 | 8/2016 | DeJonge et al. |
| 9,433,335 | B2 | 9/2016 | Nolan et al. |
| 9,439,547 | B2 | 9/2016 | Makarov |
| 9,439,548 | B2 | 9/2016 | Jenson |
| 9,456,726 | B2 | 10/2016 | Reed et al. |
| 9,461,282 | B2 | 10/2016 | Gee, II et al. |
| 9,474,424 | B2 | 10/2016 | Moyher, Jr. et al. |
| 9,480,374 | B2 | 11/2016 | Li et al. |
| 9,480,378 | B2 | 11/2016 | Paliobeis |
| 9,486,121 | B2 | 11/2016 | Kasper et al. |
| 9,492,047 | B2 | 11/2016 | Marsden et al. |
| 9,504,364 | B2 | 11/2016 | Reed et al. |
| 9,504,366 | B2 | 11/2016 | Kasper et al. |
| D774,260 | S | 12/2016 | Manning |
| 9,521,940 | B2 | 12/2016 | Johnson |
| D776,381 | S | 1/2017 | Manning |
| 9,532,693 | B1 | 1/2017 | Tran et al. |
| 9,538,891 | B2 | 1/2017 | Griffith |
| 9,538,896 | B2 | 1/2017 | Hansen et al. |
| 9,549,648 | B2 | 1/2017 | Lenkiewicz, Jr. et al. |
| 9,560,948 | B2 | 2/2017 | Huang et al. |
| D782,759 | S | 3/2017 | Mathiassen et al. |
| 9,585,535 | B2 | 3/2017 | Morgan et al. |
| 9,585,536 | B2 | 3/2017 | Pi et al. |
| 9,591,951 | B2 | 3/2017 | Rukavina |
| 9,591,960 | B2 | 3/2017 | Grove |
| 9,615,703 | B2 | 4/2017 | Moyher, Jr. et al. |
| 9,615,713 | B2 | 4/2017 | Salo et al. |
| 9,622,631 | B2 | 4/2017 | Cipolla |
| 9,635,991 | B2 | 5/2017 | Luo et al. |
| 9,637,258 | B1 | 5/2017 | Haley |
| 9,651,014 | B2 | 5/2017 | Brandon et al. |
| 9,661,972 | B2 | 5/2017 | Bantum |
| 9,661,975 | B2 | 5/2017 | Charlton |
| 9,668,628 | B2 | 6/2017 | Kasper |
| 9,681,787 | B2 | 6/2017 | Makarov et al. |
| 9,687,128 | B2 | 6/2017 | Fan et al. |
| 9,693,663 | B2 | 7/2017 | Kasper |
| 9,693,664 | B2 | 7/2017 | Tran |
| 9,693,665 | B2 | 7/2017 | Khalil et al. |
| 9,700,189 | B2 | 7/2017 | Pilch et al. |
| 9,706,888 | B2 | 7/2017 | Krebs |
| 9,706,889 | B1 | 7/2017 | Lee et al. |
| 9,713,408 | B2 | 7/2017 | Moyher, Jr. et al. |
| 9,713,410 | B2 | 7/2017 | Morgan et al. |
| 9,717,380 | B2 | 8/2017 | Krebs et al. |
| 9,717,382 | B2 | 8/2017 | Morgan |
| 9,717,385 | B2 | 8/2017 | Liter |
| 9,717,389 | B2 | 8/2017 | Johnson et al. |
| 9,723,961 | B1 | 8/2017 | Tran et al. |
| 9,723,964 | B2 | 8/2017 | Inail |
| 9,737,187 | B2 | 8/2017 | Bantum |
| 9,737,189 | B2 | 8/2017 | Luedke et al. |
| 9,756,998 | B2 | 9/2017 | Kasper et al. |
| 9,775,482 | B2 | 10/2017 | Tran et al. |
| 9,775,483 | B2 | 10/2017 | Rukavina et al. |
| 9,775,485 | B2 | 10/2017 | Scholten et al. |
| 9,795,261 | B2 | 10/2017 | Krebs |
| 9,801,514 | B2 | 10/2017 | McIver |
| 9,801,519 | B2 | 10/2017 | Reed, Jr. et al. |
| 9,820,627 | B2 | 11/2017 | Caro, Jr. et al. |
| 9,844,310 | B2 | 12/2017 | Reed et al. |
| D809,232 | S | 1/2018 | Wu |
| 9,854,952 | B2 | 1/2018 | Moyher, Jr. |
| 9,854,953 | B2 | 1/2018 | Fan et al. |
| 9,861,240 | B2 | 1/2018 | Jenson |
| 9,867,514 | B2 | 1/2018 | Vantongeren |
| 9,867,517 | B2 | 1/2018 | Krebs et al. |
| 9,872,595 | B2 | 1/2018 | Hansen et al. |
| 9,877,629 | B2 | 1/2018 | Reindle et al. |
| 9,883,779 | B2 | 2/2018 | Kasper et al. |
| 9,888,821 | B2 | 2/2018 | Scholten et al. |
| 9,901,230 | B2 | 2/2018 | Caro et al. |
| 9,901,232 | B2 | 2/2018 | Krebs |
| 9,918,604 | B2 | 3/2018 | Haley et al. |
| 9,918,606 | B2 | 3/2018 | Tran et al. |
| 9,924,842 | B2 | 3/2018 | Gu et al. |
| 9,931,014 | B2 | 4/2018 | Johnson |
| 9,936,845 | B2 | 4/2018 | Tran et al. |
| 9,949,602 | B2 | 4/2018 | Morgan et al. |
| 9,949,604 | B2 | 4/2018 | Quinn et al. |
| 9,962,051 | B2 | 5/2018 | Kasper |
| 9,968,235 | B2 | 5/2018 | Vail et al. |
| 9,980,617 | B2 | 5/2018 | Denhof |
| 9,986,881 | B2 | 6/2018 | Vantongeren |
| 9,993,127 | B2 | 6/2018 | Krebs |
| 10,004,373 | B2 | 6/2018 | Hansen |
| D823,561 | S | 7/2018 | Casini |
| 10,016,108 | B2 | 7/2018 | Barrett |
| 10,016,110 | B2 | 7/2018 | Makarov |

(56) References Cited

U.S. PATENT DOCUMENTS 10,034,588 B2 7/2018 Kasper et al.
10,064,530 B2 9/2018 Krebs et al.
10,070,762 B2 9/2018 Burnham et al.
D831,908 S 10/2018 Tyler et al.
10,085,610 B2 10/2018 Perry et al.
10,092,155 B2 10/2018 Xia et al.
10,105,024 B2 10/2018 Kasper
10,111,570 B2 10/2018 Scholten et al.
10,117,551 B2 11/2018 Horvath et al.
10,130,224 B2 11/2018 Downey et al.
10,130,227 B2 11/2018 Kim et al.
10,130,235 B2 11/2018 Caro, Jr. et al.
10,136,784 B2 11/2018 Love et al.
10,143,344 B2 12/2018 Krebs
10,143,350 B2 12/2018 DeJonge
10,148,111 B2 12/2018 Reed
10,154,765 B2 12/2018 Khalil
10,159,394 B2 12/2018 Hansen
10,165,917 B2 1/2019 Miller et al.
10,178,934 B2 1/2019 Huffman et al.
10,178,935 B2 1/2019 Morgan
10,182,692 B2 1/2019 Tran
10,188,252 B2 1/2019 Nguyen et al.
10,188,253 B2 1/2019 Miller
10,189,614 B2 1/2019 Pruiett
10,213,074 B2 2/2019 Jenson
10,219,664 B2 3/2019 Lauer
10,219,668 B2 3/2019 Vail et al.
10,219,671 B2 3/2019 Manning et al.
10,219,673 B2 3/2019 Kellis et al.
10,231,587 B2 3/2019 Krebs et al.
10,231,588 B2 3/2019 Love et al.
10,231,590 B2 3/2019 Reed et al.
10,238,251 B2 3/2019 Vantongeren
10,238,253 B2 3/2019 Morrow et al.
10,238,260 B2 3/2019 Lenkiewicz et al.
10,252,409 B2 4/2019 Pruiett et al.
10,252,444 B2 4/2019 Hart et al.
10,271,703 B2 4/2019 Tran et al.
D850,030 S 5/2019 Tian et al.
10,278,557 B2 5/2019 Rukavina
10,285,548 B2 5/2019 Gu et al.
10,285,552 B2 5/2019 Marsden et al.
10,307,033 B2 6/2019 Krebs et al.
10,321,795 B2 6/2019 Fan et al.
10,327,615 B2 6/2019 Huang et al.
10,327,616 B2 6/2019 Moyher, Jr. et al.
10,342,402 B2 7/2019 Lenkiewicz et al.
10,368,713 B2 8/2019 DeJonge
10,376,123 B2 8/2019 Luo et al.
10,376,124 B2 8/2019 McDowell et al.
10,383,496 B2 8/2019 Vail et al.
10,398,268 B2 9/2019 Krebs et al.
10,398,271 B2 9/2019 Moyher, Jr. et al.
10,398,274 B2 9/2019 Kasper
10,398,280 B2 9/2019 Krebs et al.
10,405,721 B2 9/2019 Salo et al.
10,413,149 B2 9/2019 Johnson
10,433,691 B2 10/2019 Pougher et al.
10,448,797 B2 10/2019 Gregorich et al.
10,456,000 B2 10/2019 Rukavina
10,456,001 B2 10/2019 Tran
10,470,625 B2 11/2019 Burgess et al.
10,501,927 B2 12/2019 Pleasants
11,134,815 B2 10/2021 Liu et al.
D948,813 S 4/2022 Dexter
D992,842 S 7/2023 Yao
D995,960 S 8/2023 Liu et al.
11,730,333 B2 8/2023 Quintero et al.
D998,918 S 9/2023 Zhang
2007/0214755 A1 9/2007 Corney et al.
2007/0240567 A1 10/2007 Kiern et al.
2015/0040342 A1 2/2015 Henderson
2015/0040344 A1 2/2015 Henderson
2015/0108244 A1 4/2015 Pruiett et al.
2015/0230679 A1 8/2015 Henderson
2016/0120389 A1* 5/2016 Schultheis ..... A47L 13/26 15/145
2016/0227976 A1 8/2016 Krondorfer et al.
2016/0242614 A9 8/2016 Kellis et al.
2016/0324381 A1 11/2016 Kasper
2016/0367100 A1 12/2016 Tran et al.
2017/0000305 A1 1/2017 Gordon et al.
2017/0071431 A1 3/2017 Reed et al.
2017/0127900 A1 5/2017 Wright et al.
2017/0143860 A1 5/2017 Kellis et al.
2017/0215572 A1 8/2017 Lenkiewicz et al.
2017/0231445 A1 8/2017 Kasper
2017/0265700 A1 9/2017 Khalil et al.
2017/0265702 A1 9/2017 Lee
2017/0273523 A1 9/2017 Kasper et al.
2017/0281222 A1 10/2017 Bissell
2017/0296007 A1 10/2017 Warren et al.
2017/0296009 A1 10/2017 Carter et al.
2017/0296013 A1 10/2017 Warren et al.
2017/0356121 A1 12/2017 Perry et al.
2017/0360267 A1 12/2017 Jenson
2017/0367551 A1 12/2017 Krebs
2018/0078104 A1 3/2018 Register et al.
2018/0078106 A1 3/2018 Scholten et al.
2018/0084964 A1 3/2018 Pi et al.
2018/0092502 A1 4/2018 Hansen et al.
2018/0110201 A1 4/2018 Mohyer, Jr. et al.
2018/0110387 A1 4/2018 Reindle et al.
2018/0110388 A1 4/2018 Xia et al.
2018/0116476 A1 5/2018 Bloemendaal et al.
2018/0125315 A1 5/2018 Kasper, Jr. et al.
2018/0125322 A1 5/2018 Scholten et al.
2018/0140148 A1 5/2018 Paulla et al.
2018/0140159 A1 5/2018 Tran et al.
2018/0153365 A1 6/2018 Morrow et al.
2018/0168419 A1 6/2018 Johnson et al.
2018/0177368 A1 6/2018 Acker et al.
2018/0177374 A1 6/2018 Nguyen
2018/0184863 A1 7/2018 Kasper
2018/0213995 A1 8/2018 Krebs et al.
2018/0228337 A1 8/2018 Vail et al.
2018/0229255 A1 8/2018 Pruiett et al.
2018/0230689 A1 8/2018 Schaafsma
2018/0235418 A1 8/2018 Lauer
2018/0235425 A1 8/2018 Ding et al.
2018/0249871 A1 9/2018 Rukavina et al.
2018/0249875 A1 9/2018 Hooley et al.
2018/0263444 A1 9/2018 Krebs
2018/0303300 A1 10/2018 Kasper et al.
2018/0303588 A1 10/2018 Ha
2018/0325341 A1 11/2018 Xia et al.
2018/0333021 A1 11/2018 Bohlen et al.
2018/0333736 A1 11/2018 Krebs
2018/0333753 A1 11/2018 Nolin et al.
2018/0338658 A1 11/2018 Krebs et al.
2018/0344112 A1 12/2018 Krebs et al.
2018/0344114 A1 12/2018 Scholten et al.
2018/0360290 A1 12/2018 Perry et al.
2018/0361434 A1 12/2018 Rickey et al.
2018/0368646 A1 12/2018 Buehler et al.
2019/0000286 A1 1/2019 Kasper
2019/0000288 A1 1/2019 Burnham et al.
2019/0000291 A1 1/2019 Scholten et al.
2019/0009309 A1 1/2019 Rickey et al.
2019/0021565 A1 1/2019 Fester
2019/0024614 A1 1/2019 Nolin
2019/0045996 A1 2/2019 Caro, Jr. et al.
2019/0059665 A1 2/2019 Krebs
2019/0059673 A1 2/2019 Tran et al.
2019/0059679 A1 2/2019 Huffman et al.
2019/0059682 A1 2/2019 Hansen
2019/0067971 A1 2/2019 Reed
2019/0069738 A1 3/2019 Horvath et al.
2019/0069739 A1 3/2019 Miller et al.
2019/0075989 A1 3/2019 Krebs et al.
2019/0082624 A1 3/2019 Lee et al.
2019/0082925 A1 3/2019 Conrad et al.
2019/0090706 A1 3/2019 Love et al.

(56) References Cited

U.S. PATENT DOCUMENTS

| | | | |
|---|---|---|---|
| 2019/0090710 | A1 | 3/2019 | Marcus et al. |
| 2019/0104906 | A1 | 4/2019 | Royale et al. |
| 2019/0115775 | A1 | 4/2019 | Izard et al. |
| 2019/0117031 | A1 | 4/2019 | Xie |
| 2019/0117033 | A1 | 4/2019 | Miller |
| 2019/0125151 | A1 | 5/2019 | Tran |
| 2019/0125152 | A1 | 5/2019 | Bloom et al. |
| 2019/0127131 | A1 | 5/2019 | Pruiett |
| 2019/0142232 | A1 | 5/2019 | McRorie et al. |
| 2019/0142238 | A1 | 5/2019 | Nguyen |
| 2019/0153982 | A1 | 5/2019 | Nolin |
| 2019/0159644 | A1 | 5/2019 | Lenkiewicz et al. |
| 2019/0159646 | A1 | 5/2019 | Luyckx et al. |
| 2019/0127964 | A1 | 6/2019 | Pleasants |
| 2019/0167059 | A1 | 6/2019 | Brown et al. |
| 2019/0167062 | A1 | 6/2019 | Krebs et al. |
| 2019/0174985 | A1 | 6/2019 | Kellis et al. |
| 2019/0183300 | A1 | 6/2019 | Yuen et al. |
| 2019/0183303 | A1 | 6/2019 | Yuen et al. |
| 2019/0183304 | A1 | 6/2019 | Yuen et al. |
| 2019/0183307 | A1 | 6/2019 | Irfan et al. |
| 2019/0183311 | A1 | 6/2019 | Diana et al. |
| 2019/0183312 | A1 | 6/2019 | Manning et al. |
| 2019/0184604 | A1 | 6/2019 | Hart et al. |
| 2019/0191951 | A1 | 6/2019 | Rukavina et al. |
| 2019/0191952 | A1 | 6/2019 | Johnson et al. |
| 2019/0200822 | A1 | 7/2019 | Morrow et al. |
| 2019/0208700 | A1 | 7/2019 | Hahn et al. |
| 2019/0216011 | A1 | 7/2019 | Hahn et al. |
| 2019/0216012 | A1 | 7/2019 | Hahn et al. |
| 2019/0216014 | A1 | 7/2019 | Hahn et al. |
| 2019/0216278 | A1 | 7/2019 | Gu et al. |
| 2019/0216282 | A1 | 7/2019 | Pohlman et al. |
| 2019/0231159 | A1 | 8/2019 | Tran |
| 2019/0234423 | A1 | 8/2019 | Schaafsma et al. |
| 2019/0239709 | A1 | 8/2019 | Thomas |
| 2019/0246854 | A1 | 8/2019 | Ward et al. |
| 2019/0258267 | A1 | 8/2019 | Hahn et al. |
| 2019/0261822 | A1 | 8/2019 | Ward et al. |
| 2019/0261827 | A1 | 8/2019 | Krebs et al. |
| 2019/0269291 | A1 | 9/2019 | Royale |
| 2019/0274509 | A1 | 9/2019 | Moyher, Jr. et al. |
| 2019/0275456 | A1 | 9/2019 | Burgess |
| 2019/0290089 | A1 | 9/2019 | Johnson et al. |
| 2019/0298136 | A1 | 10/2019 | Yiu et al. |
| 2019/0301675 | A1 | 10/2019 | Rickey |
| 2019/0313865 | A1 | 10/2019 | Lenkiewicz et al. |
| 2019/0313870 | A1 | 10/2019 | Ward et al. |
| 2019/0313872 | A1 | 10/2019 | Ward et al. |
| 2019/0327886 | A1 | 10/2019 | Hahn et al. |
| 2019/0343347 | A1 | 11/2019 | Diana et al. |
| 2019/0343359 | A1 | 11/2019 | Diana et al. |
| 2019/0343360 | A1 | 11/2019 | Diana et al. |
| 2019/0343361 | A1 | 11/2019 | Diana et al. |
| 2019/0350427 | A1 | 11/2019 | Dejonge |
| 2019/0357748 | A1 | 11/2019 | McDowell et al. |
| 2019/0365177 | A1 | 12/2019 | Gordon et al. |
| 2019/0365182 | A1 | 12/2019 | Manning et al. |
| 2019/0365184 | A1 | 12/2019 | Vail et al. |
| 2019/0374082 | A1 | 12/2019 | Salo et al. |
| 2019/0380557 | A1 | 12/2019 | Krebs et al. |
| 2023/0284857 | A1 | 9/2023 | Nguyen et al. |

OTHER PUBLICATIONS

Bissell BARKBATH Dual Use Portable Dog Bath & Deep Cleaner, available in Amazon.com, first available Sep. 30, 2019. Site visited Aug. 9, 2023. URL:https://www.amazon.com/Bissell-BARKBATH-Portable-Cleaner-2592/dp/B07YLDNM1P (Year: 2019).

U.S. Appl. No. 29/837,848, filed May 9, 2022; Notice of Allowance dated Aug. 31, 2023; 30 pages.

Yadea Carpet Cleaner, available in Amazon.com, first available Dec. 11, 2022. Site visited Aug. 9, 2023. URL:https:/www.amazon.co.jp/-/en/Cleaner-Washable-Cleaning-Supplies-R6/dp/BOBPSH4R7H (Year: 2022).

US Notice of Allowance; U.S. Appl. No. 29/837,848; Filing Date: May 9, 2022; Date of Mailing: Oct. 19, 2023; pp. 1-76.

Non-Final Office Action issued in U.S. Appl. No. 18/491,082 dated Jul. 5, 2024; 18 pages.

* cited by examiner

SPOT CLEANER APPARATUS

CROSS-REFERENCE TO RELATED APPLICATIONS

This application claims priority from U.S. patent application 63/162,250 filed on Mar. 17, 2021. Its content is incorporated herewith in its entirety.

TECHNICAL FIELD

This disclosure generally relate to vacuum-based cleaning apparatuses and more particularly to portable spot cleaner apparatuses.

BACKGROUND

Spot cleaners are commonly used in facilities such as homes in order to clean a dirty or soiled surface. Spot cleaners typically include a vacuum assembly creating a suction to remove the dirty or soiled particulates from the surface via a brush, wand or the like. Spot cleaners may also include a fluid supply tank or reservoir, for instance containing a mixture of water and a cleaning detergent, that may be applied to the dirty or soiled surface to loosen the particulate to be removed. A pump may be used to apply the fluid to the surface, and the suction created by the vacuum assembly draws the liquid as well as the loosened particulates into an additional tank or reservoir. Various spot cleaners may heat the fluid before its application to improve efficiency. Various spot cleaners may be portable due to their compactness and transportability, for instance via an integrated handle. As another possibility, various portable spot cleaners heat the cleaning fluid sufficiently to create steam for improved cleaning efficiency, increasing the energy consumption of the device. However, various portable spot cleaners may be difficult to fill, empty and transport. In addition, various portable spot cleaners may not offer a user intuitive control over functions such as the suction rate, the temperature of the applied fluid and the flow rate of the applicable fluid.

SUMMARY

In accordance with a first aspect, there is provided a spot cleaner apparatus comprising: a clean fluid tank configured for holding a cleaning fluid; a dirty fluid tank including an integrated liquid/air separator; a cleaning head fluidly coupled to the clean fluid tank, the cleaning head including one or more vacuum inlets and a fluid-nebulizing orifice configured to dispense the cleaning fluid in a mist-like fashion; a pump assembly fluidly coupling the clean fluid tank to the cleaning head; a fluid heater configured to heat the cleaning fluid at or between the clean fluid tank and the fluid-nebulizing orifice; and a vacuum assembly configured for drawing a vacuum airflow from one or more vacuum inlets in the cleaning head through the integrated liquid/air separator in the dirty fluid tank.

Further in accordance with the first aspect, for example, the fluid heater is configured for heating the cleaning fluid to a temperature below the boiling point of the cleaning fluid.

Still further in accordance with the first aspect, for example, the fluid heater is configured for heating the cleaning fluid to a temperature of about 60 degrees Celsius.

Still further in accordance with the first aspect, for example, the clean fluid tank is non-removably received on a main housing.

Still further in accordance with the first aspect, for example, the integrated liquid/air separator includes a pair of separator tubes integrally formed in and projecting from a bottom wall of the dirty fluid tank, a first of the pair of separator tubes in fluid communication with the cleaning head and a second of the pair of separator tubes in fluid communication with the vacuum assembly.

Still further in accordance with the first aspect, for example, the first of the pair of separator tubes includes a check valve configured to prevent backflow into an inlet of the first of the pair of separator tubes, and the second of the pair of separator tubes includes a float configured to prevent rising fluid in the dirty fluid tank from entering into the second of the pair of separator tubes.

Still further in accordance with the first aspect, for example, the cleaning head includes a plurality of side-by-side of the one or more vacuum inlets disposed adjacent a plurality of brushes.

Still further in accordance with the first aspect, for example, the dirty fluid tank includes a dirty fluid tank base with a gasket extending about an upper end of the dirty fluid tank base and a dirty fluid tank lid removably mounted to the upper end of the dirty fluid tank base.

Still further in accordance with the first aspect, for example, the clean fluid tank includes a clean fluid tank base with a gasket extending about an upper end of the clean fluid tank base and a clean fluid tank lid removably mounted to the upper end of the clean fluid tank base.

Still further in accordance with the first aspect, for example, the pump assembly is disposed upstream of the fluid heater relative to a direction of the cleaning fluid flowing through the spot cleaner apparatus.

Still further in accordance with the first aspect, for example, a main housing includes a base portion and a casing defining an inner cavity, the inner cavity housing the pump assembly and the vacuum assembly.

Still further in accordance with the first aspect, for example, a handle is mounted to a main housing and rotatable about a vertical axis between an unlocked position whereby the dirty fluid tank and the clean fluid tank are unblocked by the handle in a vertical direction and a locked position whereby the dirty fluid tank and the clean fluid tank are blocked by the handle in the vertical direction.

In accordance with a second aspect, there is provided a spot cleaner apparatus comprising: a fluid delivery system comprising a clean fluid tank receivable on a main housing of the spot cleaner apparatus, and a pump assembly fluidly coupling the clean fluid tank to a cleaning head to deliver a cleaning fluid stored in the clean fluid tank via a fluid-ejecting orifice in the cleaning head; and a fluid recovery system comprising a dirty fluid tank receivable on the main housing and a vacuum assembly fluidly coupling the dirty fluid tank to the cleaning head to draw a vacuum airflow from one or more vacuum inlets in the cleaning head through an integrated liquid/air separator in the dirty fluid tank.

Further in accordance with the second aspect, for example, the fluid delivery system further comprises a fluid heater configured to heat the cleaning fluid before delivery via the cleaning head.

Still further in accordance with the second aspect, for example, the cleaning head is fluidly coupled to the main housing via a partitioned hose configured to simultaneously deliver the cleaning fluid from the clean fluid tank to the cleaning head and draw airflow from the cleaning head towards the dirty fluid tank.

Still further in accordance with the second aspect, for example, a control panel is provided on an outside surface of the main housing, the control panel operatively connected to a printed circuit board configured to control one or more operations of the fluid delivery system and the fluid recovery system.

Still further in accordance with the second aspect, for example, the clean fluid tank is non-removably received on the main housing.

Still further in accordance with the second aspect, for example, the integrated liquid/air separator includes a pair of separator tubes integrally formed in and projecting from a bottom wall of the dirty fluid tank, a first of the pair of separator tubes in fluid communication with the cleaning head and a second of the pair of separator tubes in fluid communication with the vacuum assembly.

Still further in accordance with the second aspect, for example, the clean fluid tank includes a clean fluid tank base with a gasket extending about an upper end of the clean fluid tank and a clean fluid tank lid removably mounted to the upper end of the clean fluid tank base.

Still further in accordance with the second aspect, for example, the fluid-ejecting orifice in the cleaning head is a fluid nebulizer configured to disperse the cleaning fluid in a mist-like fashion.

Many further features and combinations thereof concerning the present improvements will appear to those skilled in the art following a reading of the instant disclosure.

DESCRIPTION OF THE DRAWINGS

FIGS. 13A-130 are perspective and top views of an interior of the spot cleaner apparatus of FIG. 12;

DETAILED DESCRIPTION

Figure 1A:
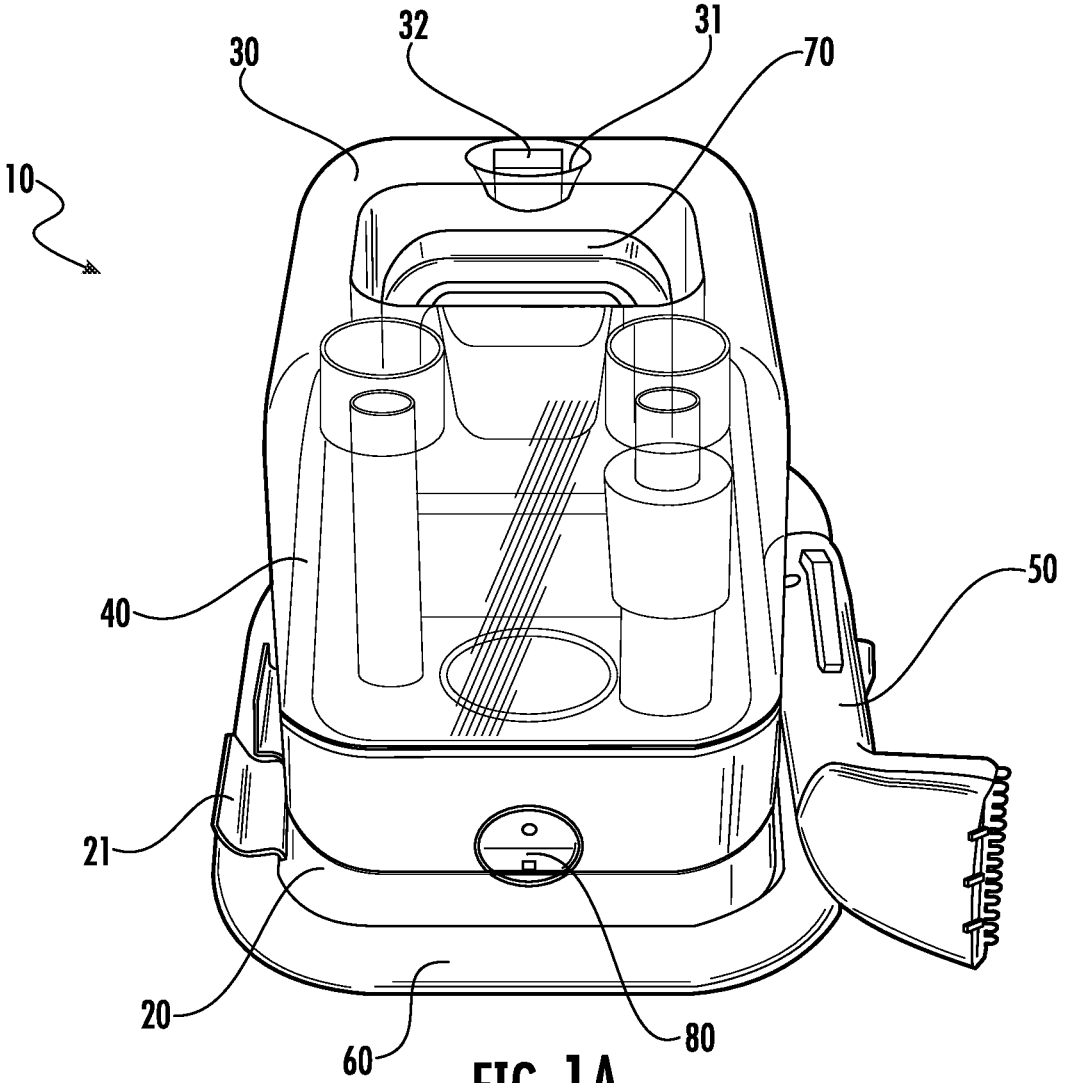
FIGS. 1A-1D are raised front, side, top perspective and bottom perspective views, respectively, of a spot cleaner apparatus in accordance with an embodiment of the present disclosure.
Figure 1B:
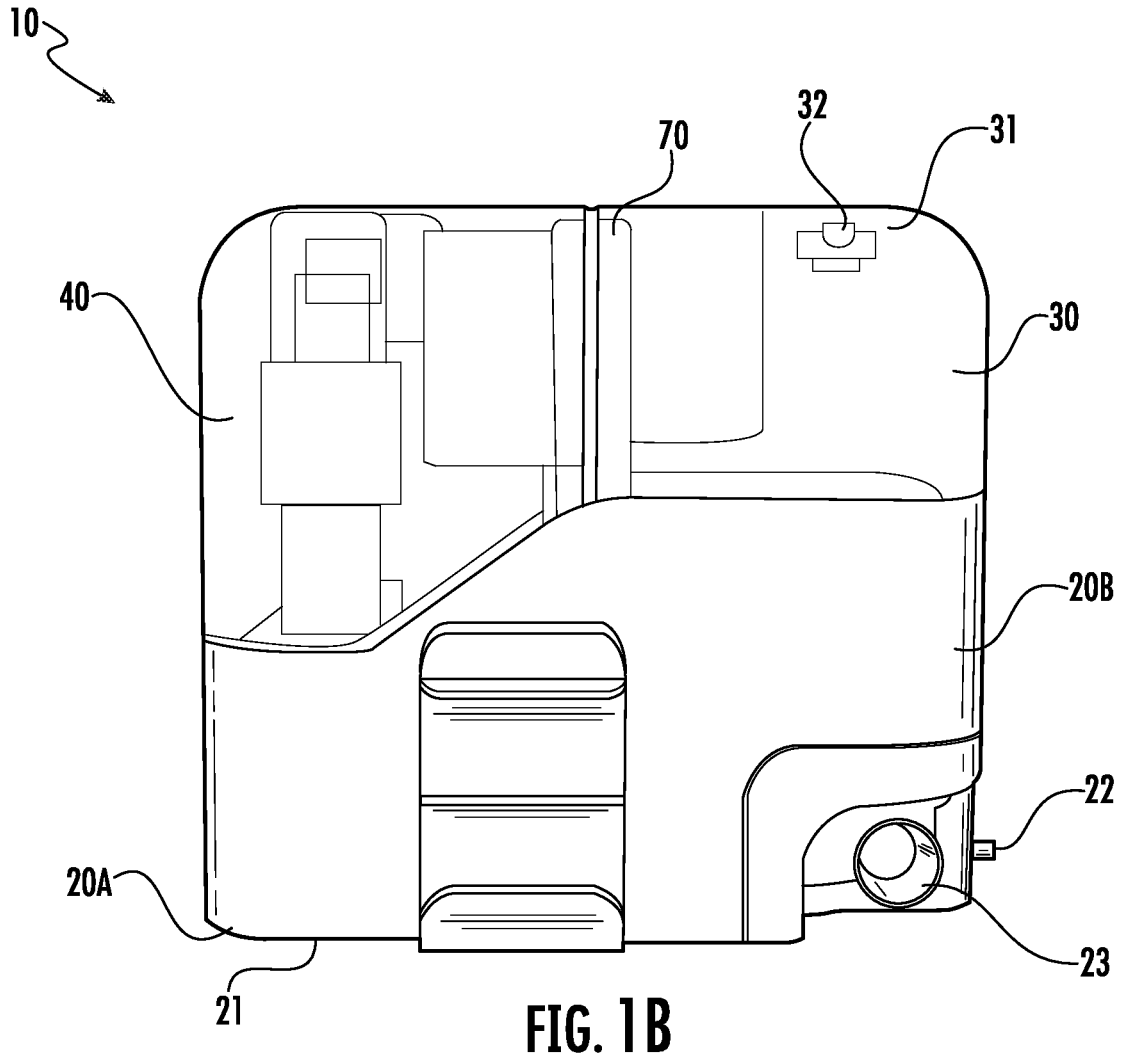
Figure 1C:
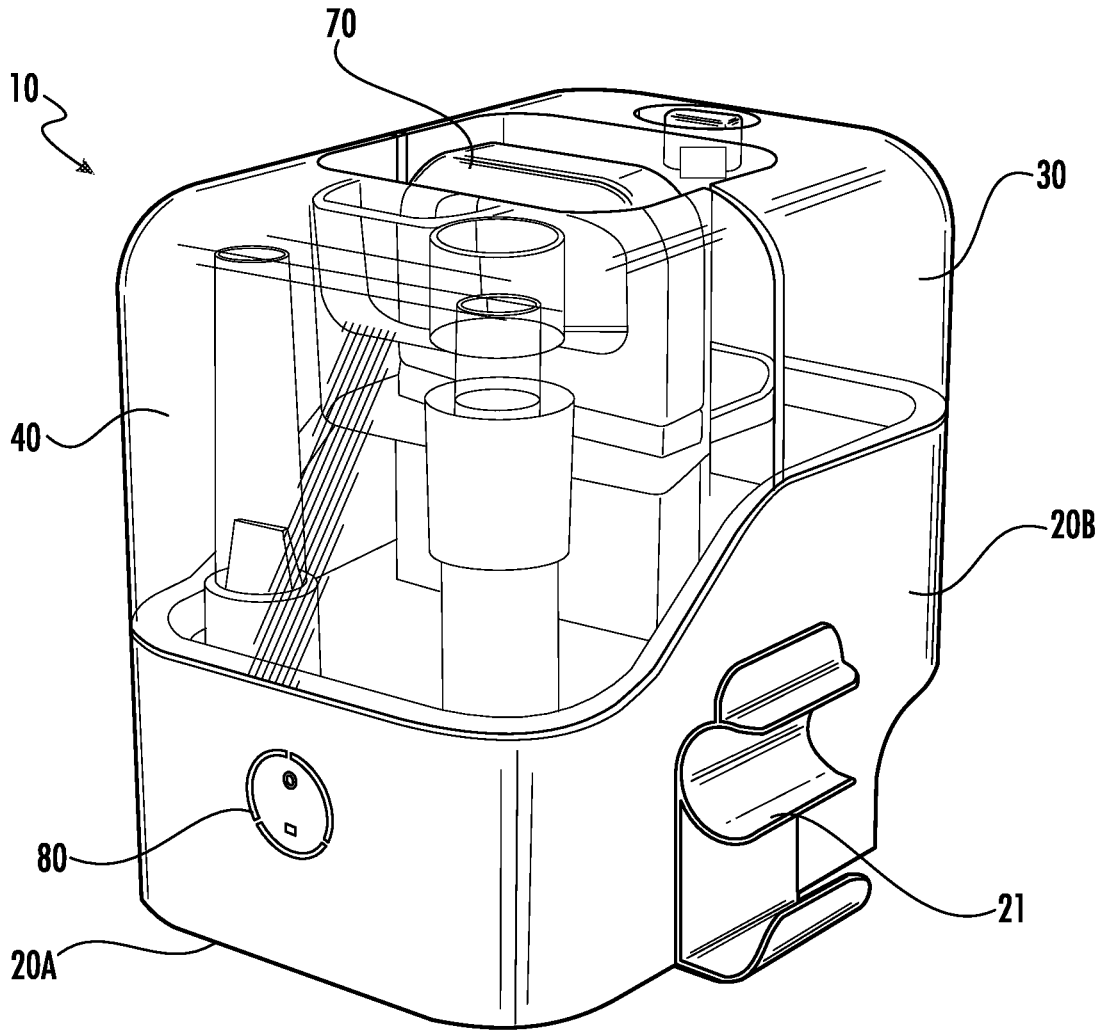

Referring to the drawings and more particularly to FIGS. 1A-1D, a spot cleaner apparatus in accordance with the present disclosure is generally shown at 10. The spot cleaner apparatus 10 is used to clean a dirty or soiled surface, for instance by discharging a cleaning fluid onto the surface and removing the fluid along with dirt, debris or other soiled matter via a vacuum inlet. Such surfaces may include carpets, upholstery or other like surfaces susceptible to being soiled or stained. The spot cleaner apparatus 10 is said to be a self-contained apparatus in that, outside of the power it receives from the power grid, the spot cleaner apparatus 10 may discharge fluid and clean a soiled surface when powered and filled with a liquid. In another embodiment, the spot cleaner apparatus 10 has its own battery, and may be operated without being connected to a power source. In an embodiment, the fluid includes water in a liquid or vapour form, with or without a cleaning agent, for example in a stream of air.

The spot cleaner apparatus 10 is shown as having a main housing 20 which forms a structural part of the spot cleaner apparatus 10 and encloses various components of the spot cleaner apparatus 10. The main housing 20 includes a base 20A and a casing 20B. The casing 20B defines an inner cavity so as to conceal the interior components of the spot cleaner apparatus 10 and is mounted to the base 20A, while the interior components may be mounted to the base 20A. The base 20A may be shaped to snugly receive the casing 20B, and/or to mate or to connect in any appropriate way. Retaining means such as tabs or other like attachments may be provided to retain the casing 20B to the base 20A. Fasteners such as bolts or screws may be contemplated as well. In other cases, the internal components may be mounted to or integrated with the casing 20B while the base 20A acts as a bottom cover. Other configurations are contemplated, with the housing 20 having an access door instead of a base and casing assembly.

The main housing 20 supports a clean fluid tank 30 for holding a cleaning solution and a dirty fluid tank 40 for holding the recovered soiled matter and cleaning solution from the surface being cleaned. As will be discussed in further detail below, a cleaning head 50 is fluidly coupled to the main housing 20 via a flexible hose 60. Other fluid conduits may be contemplated as well. The hose 60 may be partitioned to simultaneously deliver fluid from the clean fluid tank 30 to the cleaning head 50 while drawing an airflow containing debris-containing fluid away from the cleaning head 50. For instance, the hose 60 may include concentric inner and outer channels for such bidirectional flow, forming feed and return conduits. Other means for simultaneous flows may be contemplated as well, for instance two separate fluid conduits between the main housing 20 and the cleaning head 50, or a side-by-side arrangement between feed and return conduits.

The shown spot cleaner apparatus 10 may include a handle 70 and may be said to be portable as it is easily transportable from one location to another, for instance by grabbing the handle 70. The shown handle 70 is attachable to the main housing 20. In other cases, one or more handles may be moulded or otherwise formed into the body of the spot cleaner apparatus 10 to facilitate transport. In other cases, the base 20A or casing 20B may include recesses, cutouts or mouldings acting as handles for a user to carry the spot cleaner apparatus 10 from underneath. Casters or like wheels may also be present for the apparatus 10 to be rollingly displaced. While the spot cleaner apparatus 10 is shown as a portable extraction cleaner, in other embodiments, aspects of the present disclosure may be applicable to other types of surface cleaners, for instance upright vacuum cleaners movable along a surface.

Figure 1D:
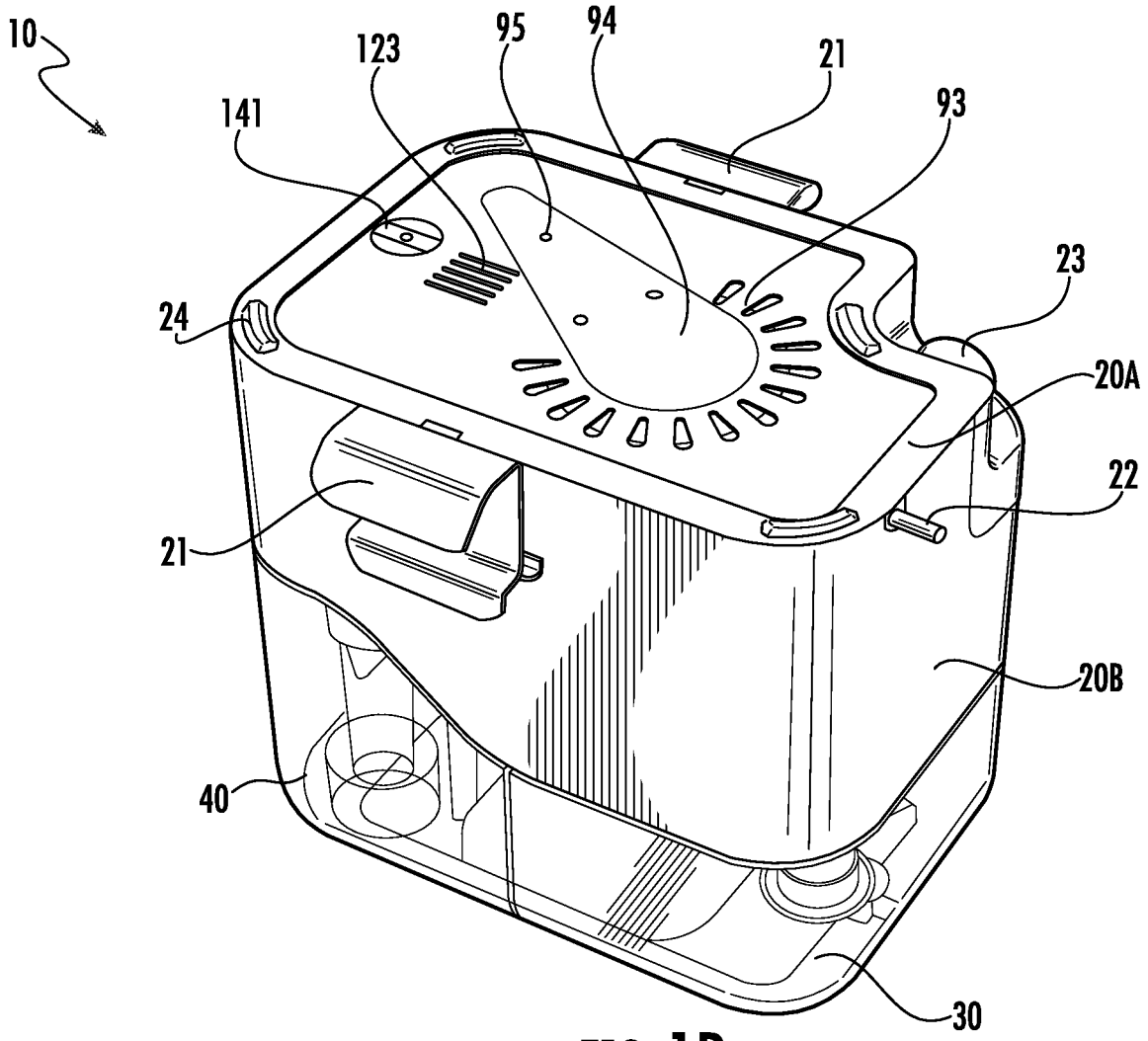

A variety of retaining means for the cleaning head 50 and hose 60 may be included on the main housing 20, for instance clips 21 and pin 22 (FIG. 1D). The clips 21 and pin 22 may be removable attachments to the main housing 20, or in other cases may be moulded or otherwise integrated into the main housing 20. The hose 60 may be removably or non-removably attached to the main housing 20 at housing inlet/outlet 23. A plurality of seating pads 24 or other types of legs on the underside of the base 20A may elevate the base 20A from the ground, for instance to facilitate venting of the various components housed within the main housing 20. As will be discussed in further detail below, a control panel 80 on an outside surface of the main housing 20 may allow a user to control various functions of the spot cleaner apparatus 10.

The clean fluid tank 30, also referred to as a clean fluid supply tank or reservoir, holds a cleaning fluid to be applied to the surface to be cleaned via the hose 60. The cleaning fluid may include a mixture of water and various types of cleaning agents or detergents. Other mixtures may be contemplated as well. In some cases, the cleaning fluid includes only water. As will be discussed in further detail below, in the shown case the clean fluid tank 30 is non-removably attached to the main housing 20. As users may tend to lift the apparatus 10 via the clean fluid tank 30, the non-removability may ensure that the fluid tank 30 remains connected in spite of the raising action. The cleaning fluid may be poured or otherwise inserted into the clean fluid tank 30 via a funnel-like opening 31 in a top surface thereof, and excess fluid may be drained underneath the base 20A, as will be discussed in further detail below. The opening 31 may be threaded and sealable by a cap or cover 32, although other opening configurations to the clean fluid tank 30 be contemplated as well, with an opening without cover being contemplated. The shown clean fluid tank 30 may be transparent so that a user may see the quantity of cleaning fluid held within. Similarly, in other cases the clean fluid tank 30 may be translucent and/or opaque. Markings or other volume identifiers may be present on an outside wall of the clean fluid tank 30 as well.

Figure 5:
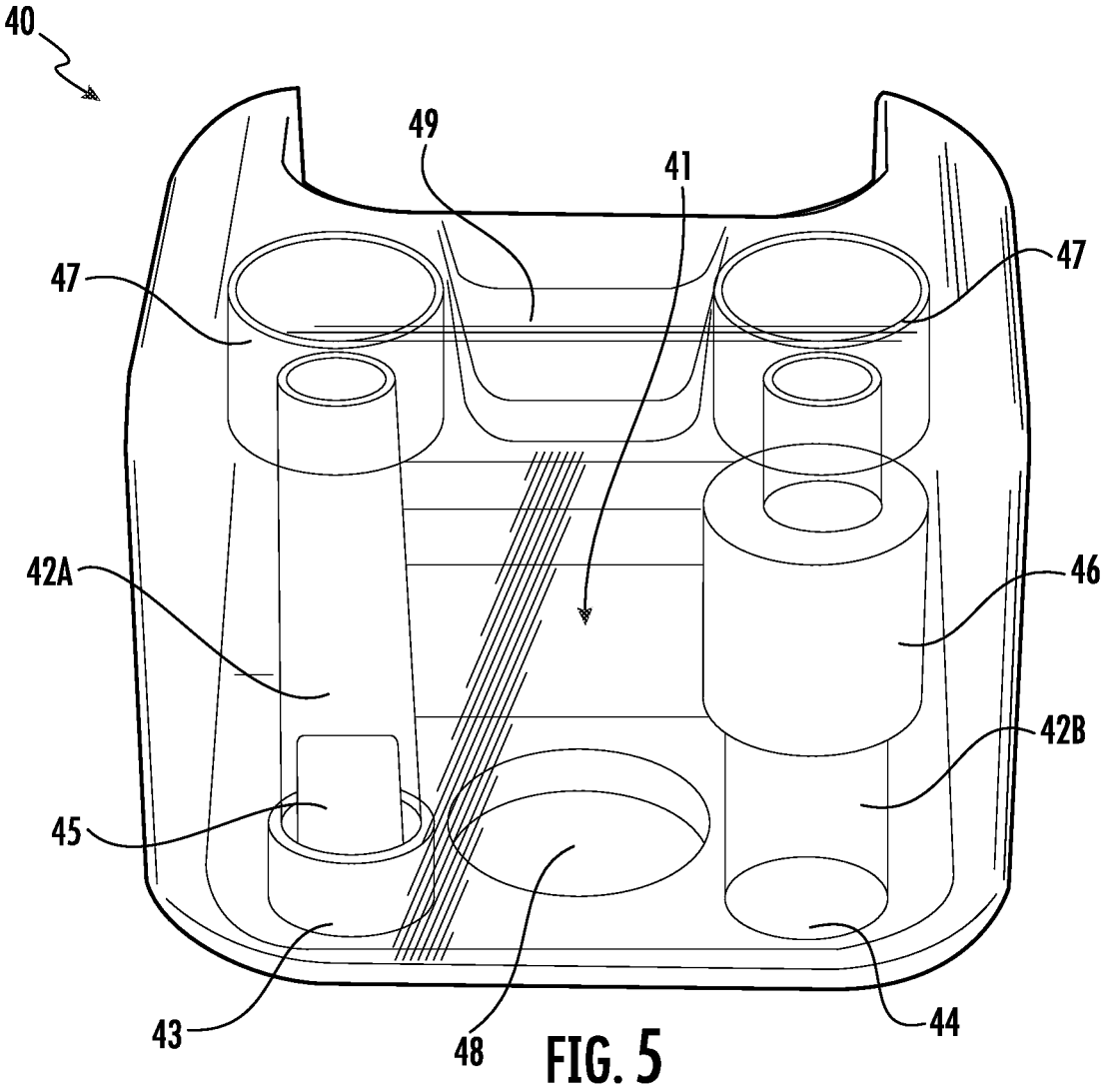
FIG. 5 is a raised rear view of a dirty fluid tank for the spot cleaner apparatus of FIG. 1.
Figure 6:
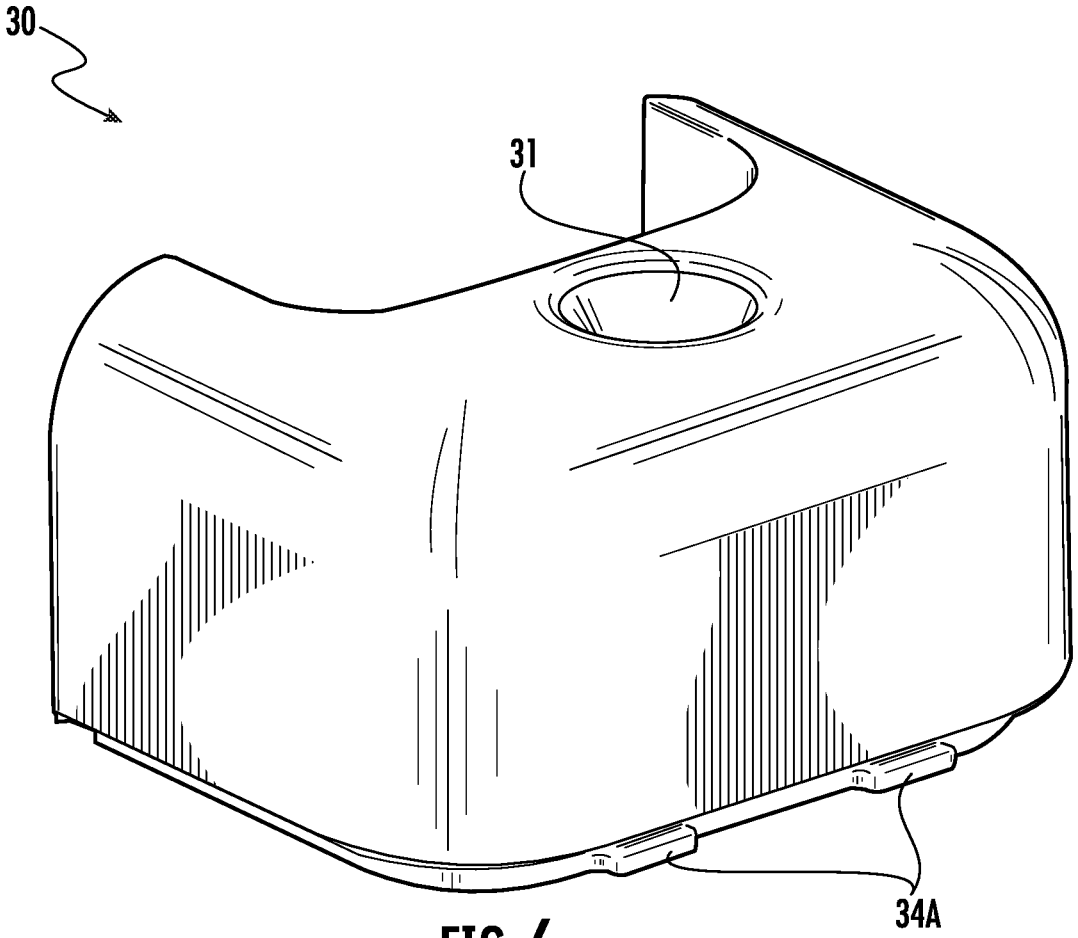
FIG. 6 is a perspective view of a clean fluid tank for the spot cleaner apparatus of FIG. 1.
Figure 7:
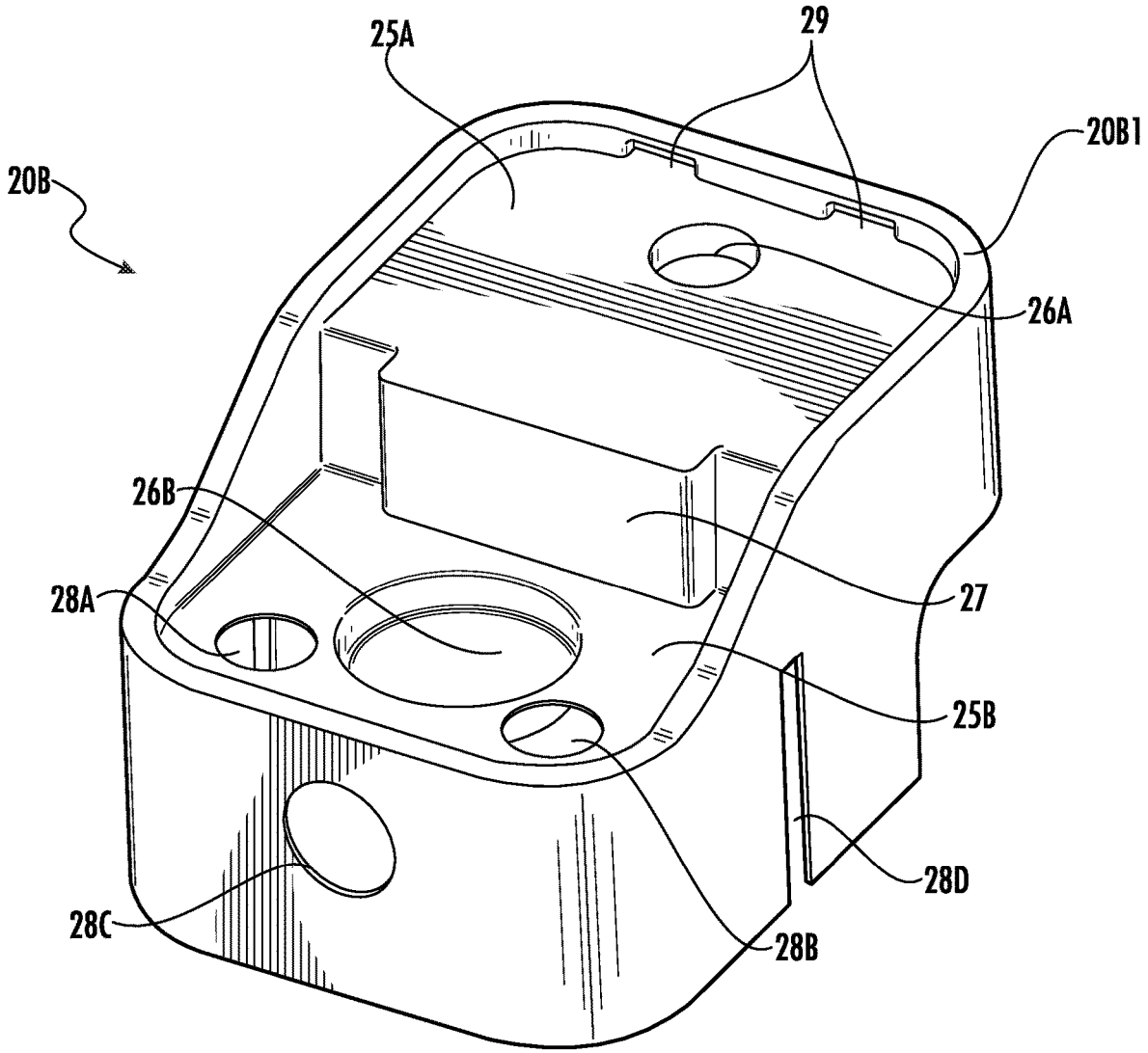
FIG. 7 is a perspective view of a casing for the spot cleaner apparatus of FIG. 1.
Figure 8A:
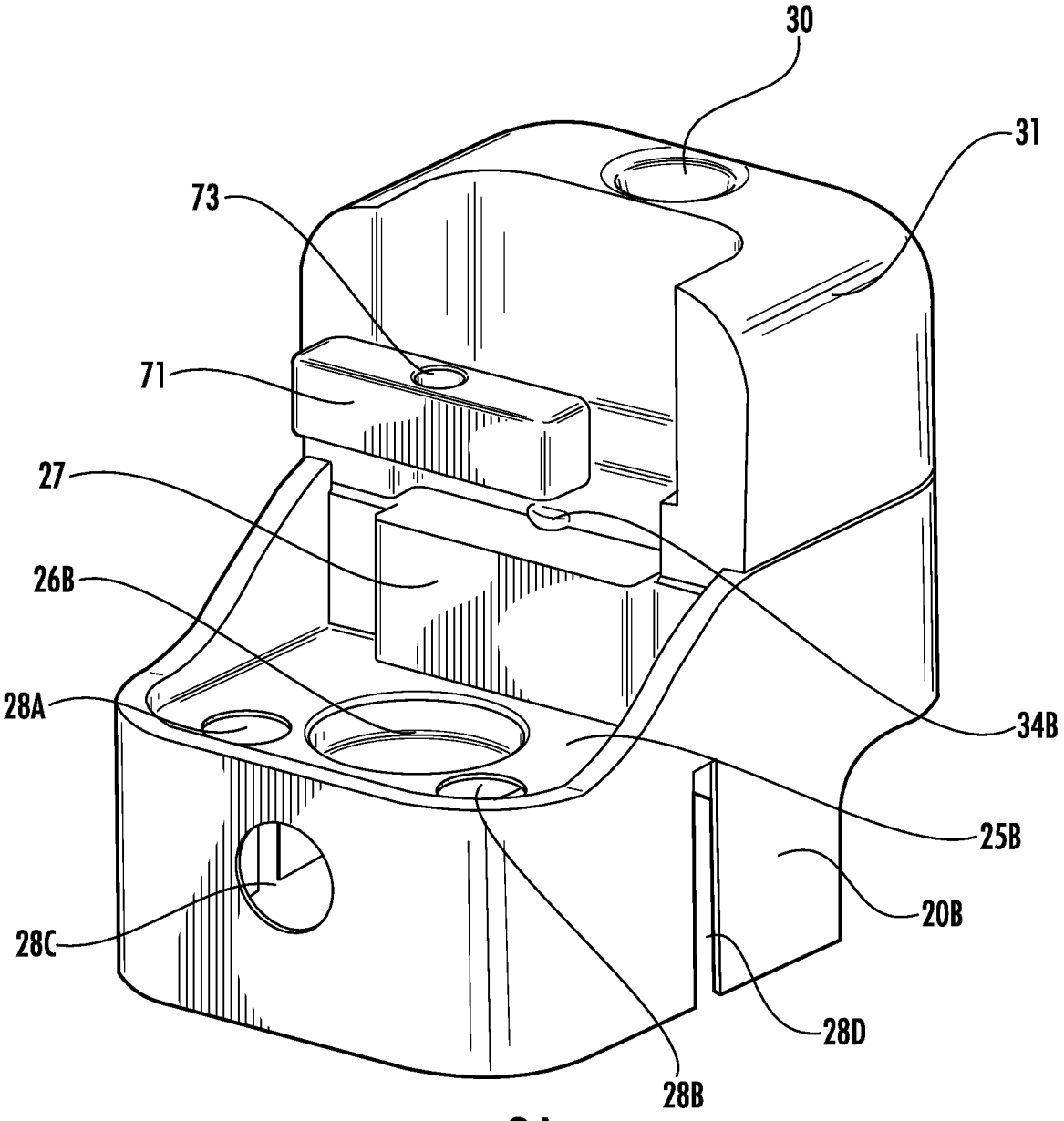
FIGS. 8A-8B are perspective and cross-sectional views of the clean fluid tank of FIG. 6 secured to the casing of FIG. 7.
Figure 8B:
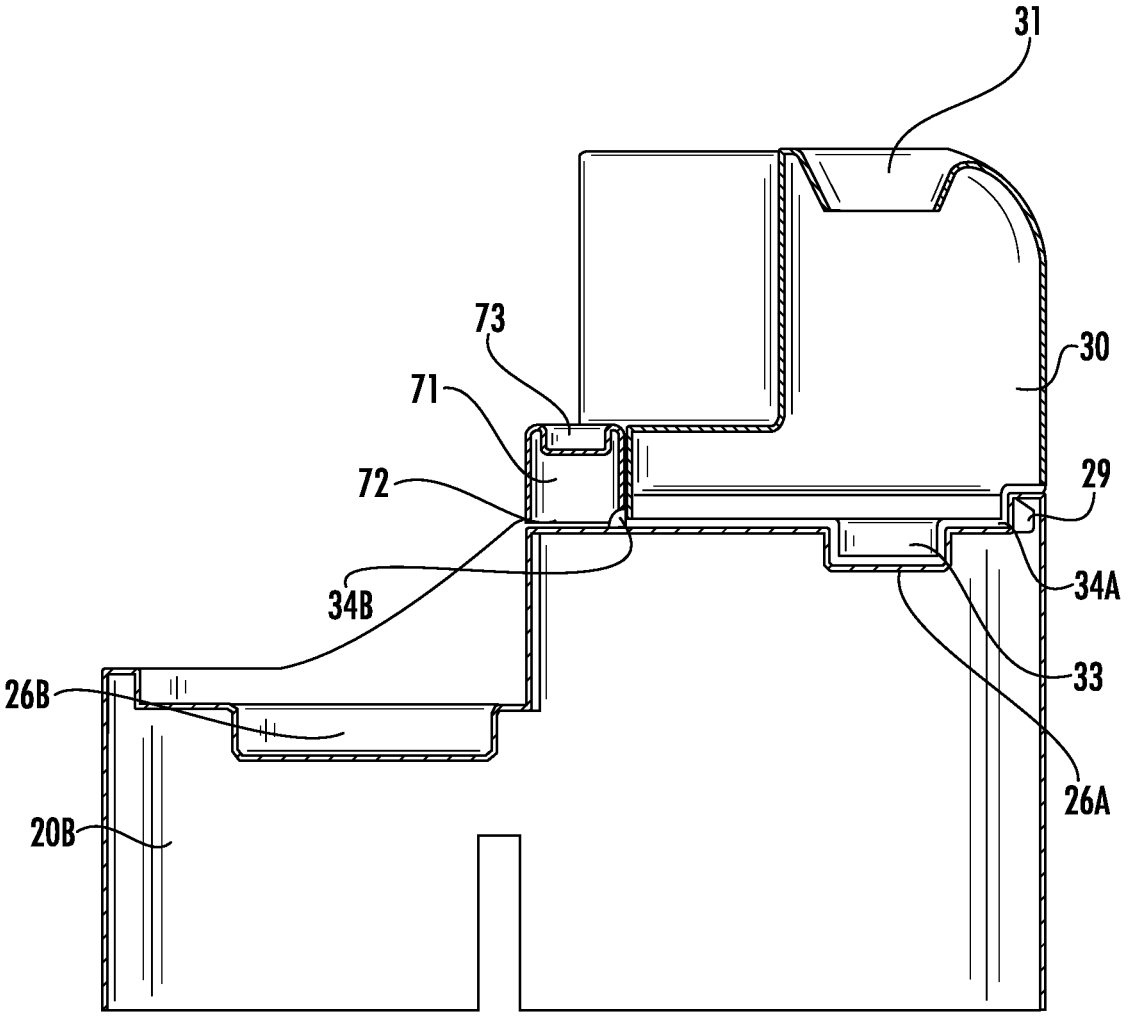

Referring to FIG. 5, the dirty fluid tank 40, also referred to as a recovery tank or reservoir, holds dirt, debris, and other soiled matter along with cleaning fluid recovered by the cleaning head 50 (FIG. 1A) from the surface being cleaned. As will be discussed in further detail below, the dirty fluid tank 40 may include an integrated liquid/air separator 41 for separating the recovered liquid from the flow of suction air. The shown dirty fluid tank 40 is removably attached to the main housing 20. As such, it may be detached and removed, for instance to be emptied and cleaned when its capacity has been reached. The dirty fluid tank 40 may be clear or translucent so that a user may see the quantity of recovered fluid in the tank. Markings or other volume identifiers may be present on an outside wall of the dirty fluid tank 40 as well.

Referring concurrently to FIGS. 2A-4B, the interior of the main housing 20 is shown in greater detail. The base 20A supports various components that may be molded or otherwise attached to the surface of the base 20A. Protrusions, clips, mouldings or other such features may be present on the surface of the base 20A to facilitate such attachment. Other constructions are contemplated. The base may include a raised vented portion 20A1, for instance to provide additional venting or cooling to the internal components within the main housing 20.

A vacuum assembly 90 within the main housing 20 provides suction airflow to the cleaning head 50 through the hose 60. The vacuum assembly 90 includes an electric motor 91 powered by a power source such as the power grid via a power cord (not shown) or an onboard battery (not shown). The electric motor 91 drives a centrifugal fan 92 which draws air from the cleaning head 50 and exhausts the air through vacuum exhausts 93 on the underside of the base 20A, as can be seen in FIG. 1D. The fan 92 may additionally or alternatively provide a cooling flow for various components within the main housing 20. Other vacuum and exhaust means may be contemplated as well. An access door 94 (FIG. 1D) on the underside of the base 20A may provide additional access to the vacuum assembly 90. In the shown case, the access door 94 is fastened to the underside of the base 20A via a plurality of fasteners 95, although other retaining means, for instance clips or hinges, may be contemplated as well. The centrifugal fan 92 is one option among others to create a vacuum effect, an axial fan, a vacuum pump being alternative examples among others.

A dirty fluid tank outlet tube 100 is fluidly coupled to the vacuum assembly 90, for instance via a tube or conduit 96 (FIG. 2A), and is operable to draw air from the dirty fluid tank 40. The dirty fluid tank outlet tube 100 may be moulded to the surface of the base 20A as shown. Alternatively, the dirty fluid tank outlet tube 100 may be a removable tube that is attachable to the base 20A. A gasket 101 (FIG. 2A) is provided to connect and seal the dirty fluid tank outlet tube 100 to the dirty fluid tank 40 and prevent water or air leakage from the dirty fluid tank 40. Other sealing means may be contemplated as well. A grid 102 at the opening of the dirty fluid tank outlet tube 100 may prevent unwanted recovered matter in the dirty fluid tank 40 from entering the airstream towards the vacuum assembly 90.

Figure 2A:
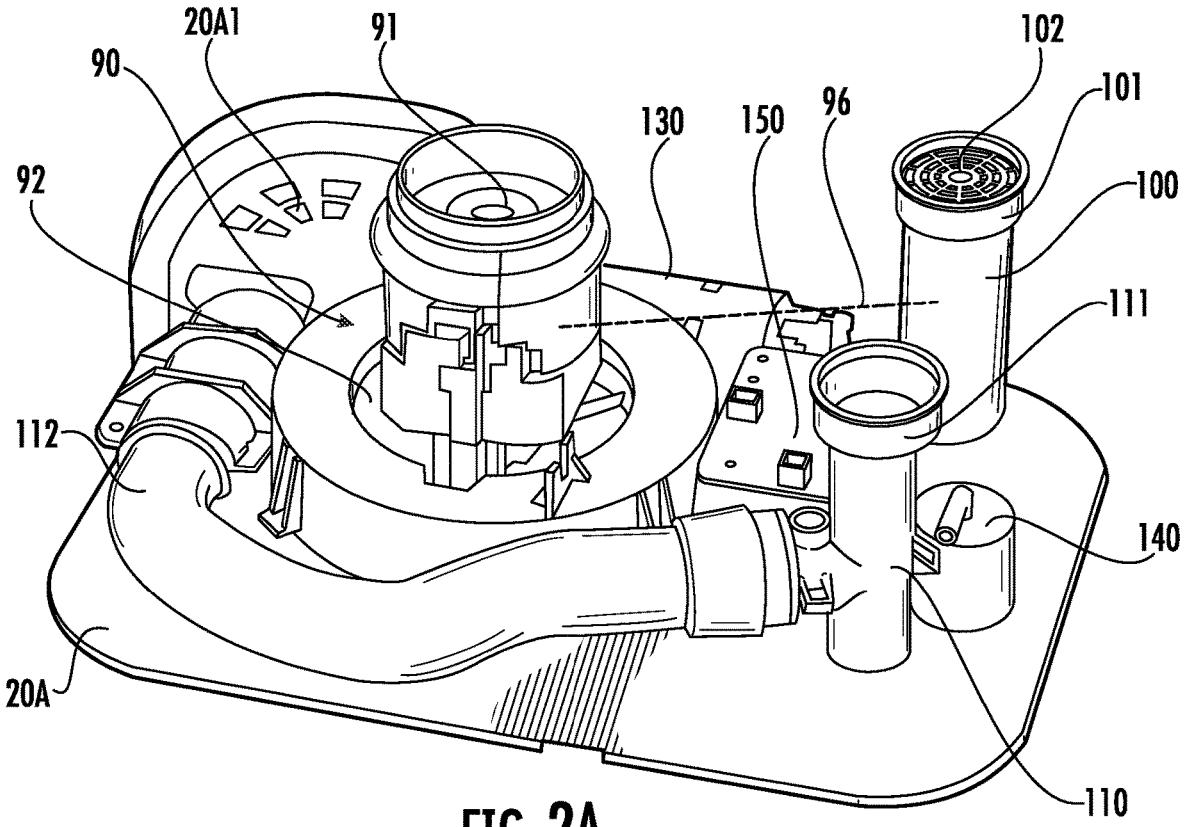
FIGS. 2A-2B are perspective views of an interior of the spot cleaner apparatus of FIG. 1.

Referring to FIG. 2A, a dirty fluid tank inlet tube 110 fluidly couples the cleaning head 50 to the dirty fluid tank 40. A gasket 111 may be provided to connect and seal the dirty fluid tank inlet tube 110 to the dirty fluid tank 40 and prevent fluid or air leakage from the dirty fluid tank 40. Other sealing means may be contemplated as well. Tubing 112 fluidly couples the hose 60 via the housing inlet/outlet 23 to the dirty fluid tank inlet tube 110. In some cases, the tubing 112 may extend through the housing inlet/outlet 23 and connect directly to the hose 60. Alternatively, the housing inlet/outlet 23 may act as an intermediary connector between the hose 60 and the tubing 112. As discussed above, the hose 60 may be removably or non-removably attached to the main housing 20. The tubing 112 may include multiple sections that are joined together, for instance to give same the optional elbow shape of FIG. 2A. The dirty fluid tank inlet tube 110 and tubing 112 may be removable from the main housing 20, for instance to be cleaned. In the shown case, the dirty fluid tank inlet tube 110 is removably mountable to an inlet tube support 113 (FIG. 2B) moulded into the base 20A. Other attachment means for the dirty fluid tank inlet tube 110 may be contemplated as well.

Figure 2B:
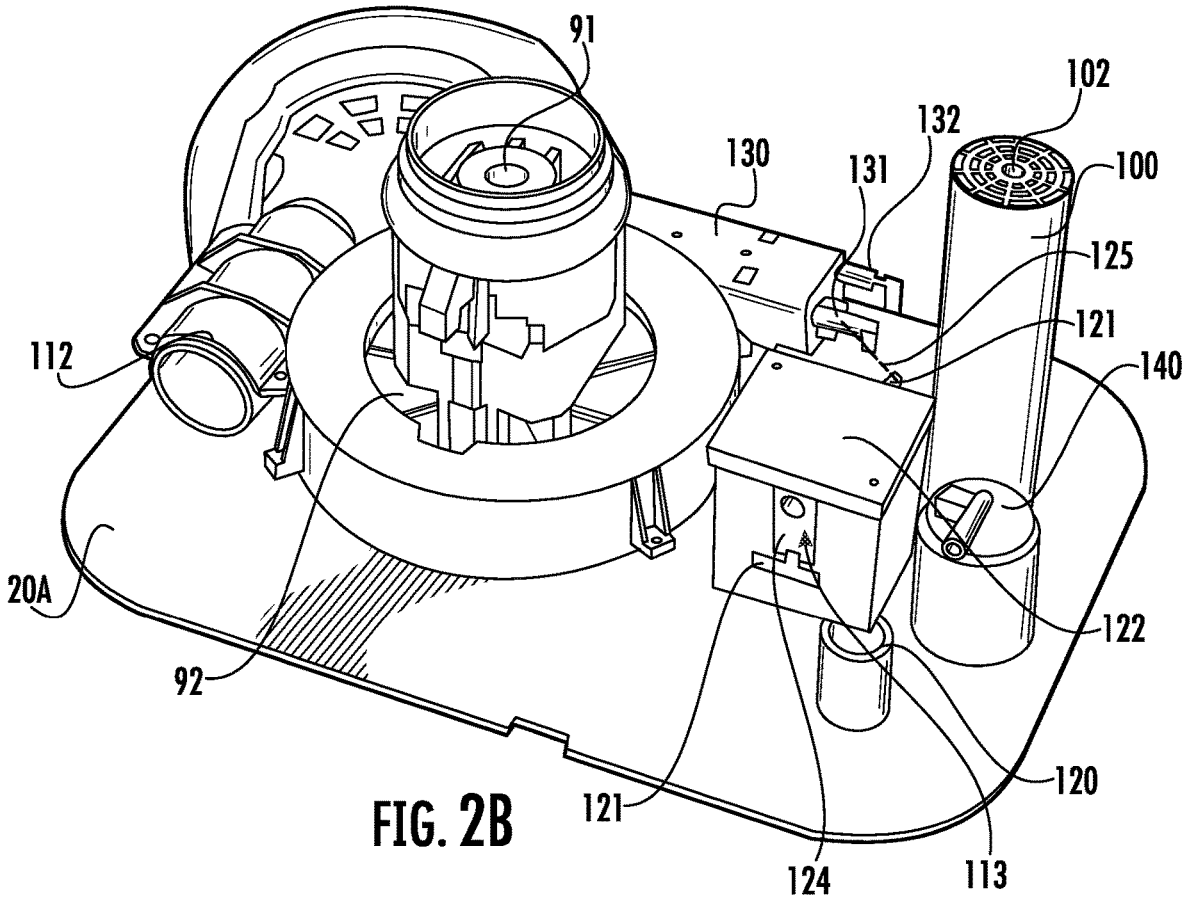

As shown in FIG. 2B, a pump assembly 120 is provided for pumping the fluid stored in the clean fluid tank 30 to the cleaning head. A pump 121 is enclosed in its own air chamber, the shown pump cap 122 acting as the top of the air chamber. The pump 121 may be a single-stage fluid pump having a single impeller (not shown), although other pump types, such as a reciprocating pump, e.g., electromagnetic pump, may be contemplated as well. Referring additionally to FIG. 1D, the pump 121 is vented through its own pump exhaust 123 on the underside of the base 20A. The pump chamber includes various sealing means, for instance gasket 124. As such, in the shown case, there is no airflow between the inside of the pump chamber and the other components within the main housing 20, for instance the vacuum assembly 90. Thus, the pump 121 may be protected or sheltered from various heat sources within the main housing such as a heater 130 (as discussed below) and the vacuum assembly 90, which may improve the overall durability of the pump 121. In use, the pump 121 draws power from one of the above-mentioned power sources and directs cleaning fluid from the clean fluid tank 30 to the cleaning head 50 via hose 60. Various tubes, pipes or other fluid conduits may be provided to direct the cleaning solution between the clean fluid tank 30 and the pump assembly 120. For instance, a conduit 35 (FIG. 4A) may direct the cleaning solution from the clean fluid tank 30 to the pump assembly 120.

A heater 130 is optionally provided to heat the fluid from the clean fluid tank 30 before it is applied to the surface to be cleaned. In the shown case, the heater 130 is an in-line heater, although other heater types may be contemplated as well. For instance, the heater 130 may be integrated within the hose 60 or provided as an optional add-on attachment to the main housing 20. The shown heater 130 includes a heater inlet 131 receiving cleaning fluid drawn from the clean fluid tank 30 via the pump 121 and a heater outlet 132 directing the now-heated cleaning fluid to the cleaning head 50 via the hose 60. For instance, the heater outlet 132 may be fluidly coupled to the housing inlet/outlet 23 via a conduit 133 (FIG. 11) to deliver the cleaning solution to the hose 60 and the cleaning head 50. In the shown case, the pump 121 is upstream of the heater 130, i.e. cleaning fluid first passes through the pump 121 before arriving at the inlet 131 of the heater 130, for instance via a conduit 125 (FIG. 2B). The reverse configuration may be contemplated as well. In various cases, a user may selectively control the outputted temperature of cleaning fluid exiting the heater 130, for instance via the control panel 80, as will be discussed in further detail below. Different temperature settings may be available. The average temperature of the cleaning fluid heated by the heater 130 may be approximately 60 degrees Celsius, although other temperatures may be contemplated as well. The heater 130 is operable to heat the cleaning fluid to a temperature below the boiling point of the cleaning fluid, for instance 100 degrees Celsius in the case of a primarily water-based cleaning fluid.

A drain 140 for the clean fluid tank 30 may be housed within the main housing 20. The drain 140 is fluidly coupled to an outlet 33 at a bottom of the clean fluid tank 30, for instance via tubes, pipes or other fluid conduits (not shown). As the illustrated clean fluid tank 30 is non-removably attached to the main housing 20, the drain 140 allows the clean fluid tank 30 to be drained of any remaining cleaning fluid after a cleaning process is completed. Such draining may prevent the growth of mold, mildew or other bacteria resulting from leftover liquid remaining in the clean fluid tank 30 after storage. The drain 140 may also be used after cleaning the clean fluid tank 30. As shown in FIG. 1D, a drain plug 141 on the underside of the base 20A may be removed to evacuate the fluid from the drain 140. Other draining means may be contemplated as well.

Figure 3:
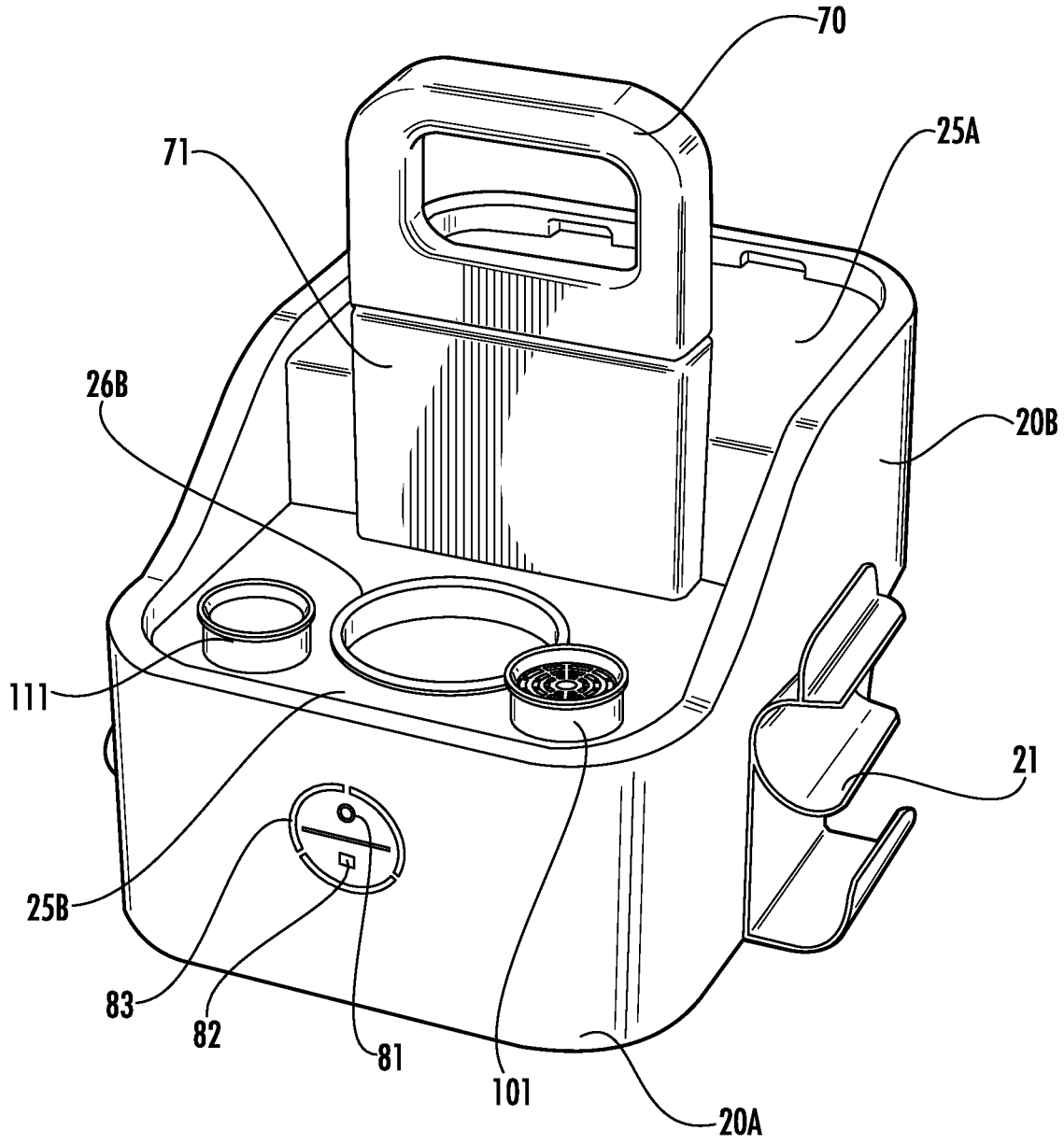
FIG. 3 is a perspective view of a housing of the spot cleaner apparatus of FIG. 1.

As shown in FIG. 3, the casing 20B includes a pair of upper surfaces for receiving the fluid tanks 30, 40. In particular, a clean fluid tank-receiving surface 25A is operable to non-removably receive the clean fluid tank 30, while the dirty fluid tank-receiving surface 25B is operable to receive the dirty fluid tank 40. While FIG. 3 shows the casing 20B without the non-removable clean fluid tank 30 for illustrative purposes, it is understood that, once installed, the clean fluid tank 30 would not be removable from the casing 20B. The surfaces 25A, 25B include various features for delivering and removing fluids to or from the tanks 30, 40, as will be discussed in further detail below. The surfaces 25A and 25B may be in a stepped arrangement, as shown.

Referring to FIG. 5, the dirty fluid tank 40 is shown with an integrated liquid/air separator 41 for separating the recovered liquid and dirt, debris and/or other soiled matter from the surface to be cleaned from the air stream. The separator 41 includes two separator or riser tubes: a first separator tube 42A receiving a mixture of debris-filled liquid and air from the dirty fluid tank inlet 43, and a second separator tube 42B through which the separated air stream exits via the dirty tank outlet 44. The dirty tank inlet 43 is in fluid communication with the dirty fluid tank inlet tube 110, while the dirty tank outlet 44 is in fluid communication with the dirty fluid tank outlet tube 100. The separator tubes 42A, 42B are moulded or otherwise formed so as to integrally project from a bottom wall of the dirty fluid tank 40. As such, the tubes 42A, 42B are said to be integrated with the dirty fluid tank 40 as they are non-removable from the dirty fluid tank 40. The non-removable feature of the tubes 42A and 42B to the bottom wall of the tank 40 prevents leaks at the junction between the tubes 42A and 42B and the bottom wall of the tank 40. In addition, the tubes 42A, 42B may be easily cleaned when the dirty fluid tank 40 is removed from the main housing 20 by running clean water through the tubes 42A, 42B. As discussed above, gaskets 101, 111 aid in sealing the tubes 42A, 42B when the dirty fluid tank 40 is mounted to the dirty fluid tank-receiving surface 25B of the casing 20B. As the tubes 42A, 42B are integrated within the dirty fluid tank 40, they do not require additional fasteners or mounting hardware that a user may accidentally lose when cleaning or otherwise manipulating the dirty fluid tank 40.

In the shown case, the first separator tube 42A includes a check valve 45 to prevent backflow into the dirty fluid tank inlet tube 110, such as a duckbill valve. Other backflow-preventing means may be contemplated as well. In addition, the shown second separator tube 42B includes a float 46 fitted about the exterior of the tube 42B. As the fluid level rises in the dirty fluid tank 40, the float 46 rises with it and eventually rises sufficiently to prevent any liquid from entering into the second separator tube 42B. In the shown case, a covering 47 moulded into a top surface of the dirty fluid tank 40 may engage with the float 46 to block the flow of liquid through the second separator tube 42B when the fluid level rises sufficiently, although other liquid blocking means into the second separator tube 42B may be contemplated as well. In the shown case, there is a covering 47 positioned above each of separator tube 42A, 42B, for instance to aid in diverting the flow of liquid and air.

In an exemplary embodiment, suction is created in the dirty fluid tank 40 by the vacuum assembly 90 drawing air from the second separator tube 42B. This flow of air induced by suction passes sequentially from the cleaning head 50, to the hose 60, the tubing 112, the dirty fluid tank inlet tube 110, the first separator tube 42A, into the tank 40, and out via the second separator tube 42B. As such, cleaning fluid and soiled matter can be suctioned from the surface to be cleaned through the cleaning head 50 and stored into the dirty fluid tank 40. As the fluid level in the dirty fluid tank 40 rises, the rising float 46 may rise as well to block the liquid from entering into the airstream of the second separator tube 42B towards the vacuum assembly 90. In some cases, the float 46 may block the airstream as well, requiring a user to empty the contents of the dirty fluid tank 40 before continuing to use the spot cleaner apparatus 10. The apparatus 10 may emit an alarm when the pressure at the assembly 90 is below a given level, as this may indicate that the float 46 has shut off the air passage. A semi-permeable float that blocks fluids but allows airflow may be contemplated as well.

A removable cover 48 may be provided on the bottom wall or other location of the dirty fluid tank 40 to allow access within, for instance to empty the dirty fluid tank 40 once it fills up with recovered matter or to clean the inside of the dirty fluid tank 40. The cover 48 may be a snap-on or screw-type cover, although other cover types may be contemplated as well. In the shown case, the cover 48 extends or protrudes downwardly from the bottom of the dirty fluid tank 40 when attached, to aid in aligning the dirty fluid tank 40 on the dirty fluid tank-receiving surface 25B, as will be discussed in further detail below. In the shown case, the dirty fluid tank 40 may include a moulded handle 49 on an upper surface of the dirty fluid tank to facilitate transport of the dirty fluid tank 40, for instance to empty its contents or clean the dirty fluid tank 40. Other handles or transport means for the dirty fluid tank 40 may be contemplated as well.

Figure 4A:
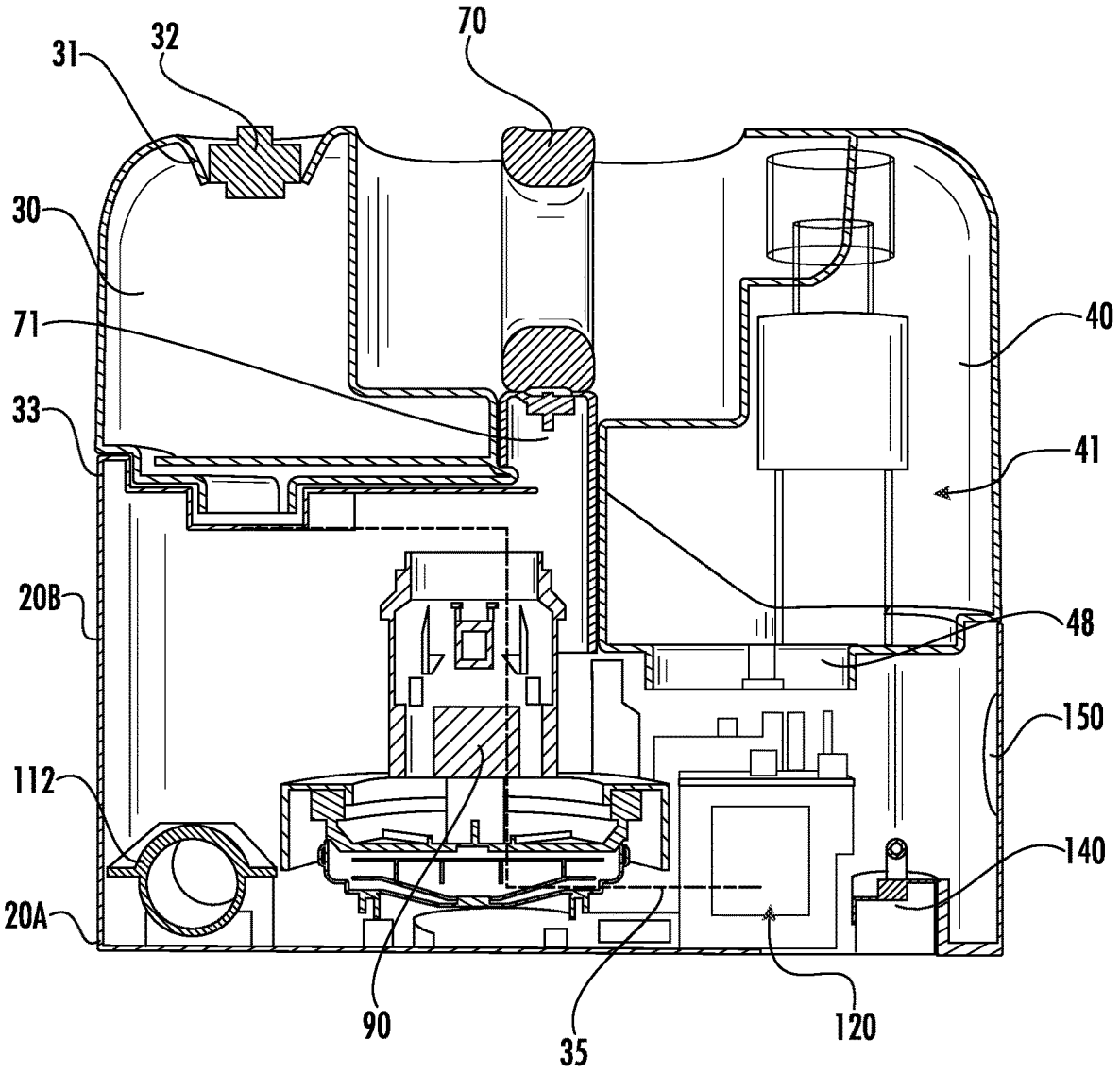
FIGS. 4A-4B are cross-sectional views of the spot cleaner apparatus of FIG. 1 with a handle in respective locked and unlocked positions.
Figure 4B:
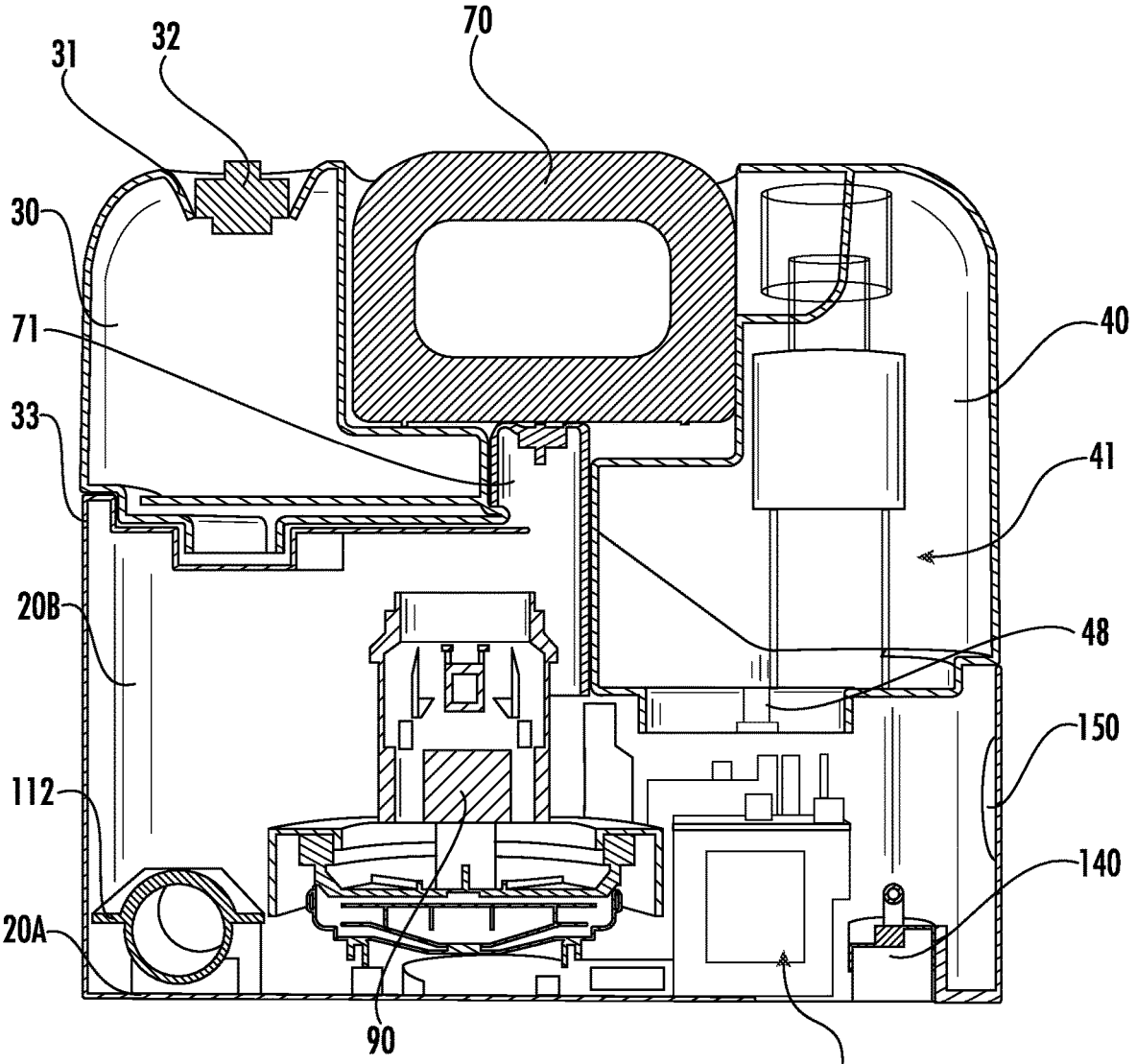

Referring again to FIGS. 3-4B, the handle 70 attaches to a handle support block 71 which is mounted to the casing 20B, for instance via fasteners, tabs, clips or other attachment means. In the shown case, as will be discussed in further detail below, the handle's 70 attachment to the handle support block 71 allows the handle 70 to rotate about a vertical axis while remaining attached to the handle support block 71. In FIG. 4A, the handle 70 is oriented in a first or unlocked orientation whereby it does not overlap with the tanks 30, 40, allowing the dirty fluid tank 40 to be removed. In FIG. 4B, the handle 70 is oriented in a second or locked orientation (e.g. ninety degrees from the first orientation), in which locked orientation the handle 70 overlaps portions of the tanks 30, 40. In this orientation, the handle 70 blocks the removable dirty fluid tank 40 and, in cases where the clean fluid tank 30 is removable, the clean fluid tank 30 in place. The handle 70 is thus rotatable between the first and second orientations. In some cases, the attachment between the handle 70 and handle support block 71 allows the handle to be partially lifted as it rotates, preventing the handle from rubbing against the surfaces of the tanks 30, 40. Other handle orientations may be contemplated as well. In the shown case, when assembled to the main housing 20, the tanks 30, 40 are shaped to form a recess or pocket for the handle 70 to sit within and freely rotate unencumbered, unless the tank 40 is misinstalled. The handle support block 71 may act as a partition between the tanks 30, 40 when they are mounted to the main housing 20. In some cases, the positioning of the handle 70 may be detectable and have an effect on the operability of the spot cleaner apparatus 10, as will be discussed in further detail below.

Referring to FIGS. 6-8B, as discussed above, the casing 20B includes the clean fluid tank-receiving surface 25A and the dirty fluid tank-receiving surface 25B. Surface 25A includes a recess 26A for receiving the protruding outlet 33 of the clean fluid tank 30. Recess 26A defines a pathway or conduit for the cleaning fluid to travel from the clean fluid tank 30 to the pump 121 or heater 130. The dirty fluid tank-receiving surface 25B includes a recess 26B for receiving the protruding cover 48 of the dirty fluid tank 40, for alignment and stable mating. The shown casing 20B includes a handle support attachment 27 to which the handle support block 71 attaches. The surface 25B further includes a cutout 28A for the dirty fluid tank inlet tube 110 to protrude through and a cutout 28B for the dirty fluid tank outlet tube 100 to protrude through. The casing 20B may further include a cutout 28C on a front surface thereof for the control panel 80 and cutouts 28D on sides thereof to accommodate the attachment of clips 21 for the cleaning head 50 or hose 60. Other arrangements may be contemplated as well.

The shown clean fluid tank 30 includes a pair of rear locking ribs 34A (FIG. 6) along a rear lower edge thereof and a front locking rib 34B (FIG. 8B) along a front lower edge thereof to enable the non-removable attachment of the clean fluid tank 30 to the casing 20B. Upon installation of the clean fluid tank 30 to the clean fluid tank-receiving surface 25A, the rear locking ribs 34A engage with a pair a corresponding recesses 29 in an upper sidewall or skirt 20B1 of the casing 20B. The front locking rib 34B engages with a recess 72 (FIG. 8B) in a lower edge of the handle support block 71. In an embodiment, the clean fluid tank 30 is first installed on the clean fluid tank-receiving surface 25A with the rear locking ribs 34A engaging with the recess 29. Then, the handle support block 71 is installed onto the casing 20B with the front locking rib 34B engaging with the recess 72. In such an arrangement, the clean fluid tank 30 is non-removably installed to the casing 20B, as the engagement between respective locking ribs 34A, 34B and recesses 29, 72, as well as the positioning of outlet 33 within recess 26A, prevent movement of the clean fluid tank 30 relative to the casing 20B in all directions. Other fastening means to non-removably attach the clean fluid tank 30 to the casing 20B may be contemplated as well, such as hidden fasteners or rivets. The shown handle support block 71 includes a handle attachment cavity 73 on an upper surface therefore for attaching the handle 70 in a rotatable fashion, as discussed above. Other handle fastening means may be contemplated as well. In an embodiment, the clean fluid tank 30 could be removed, but in a manner that involves tools and/or a specific procedure.

Figure 9A:
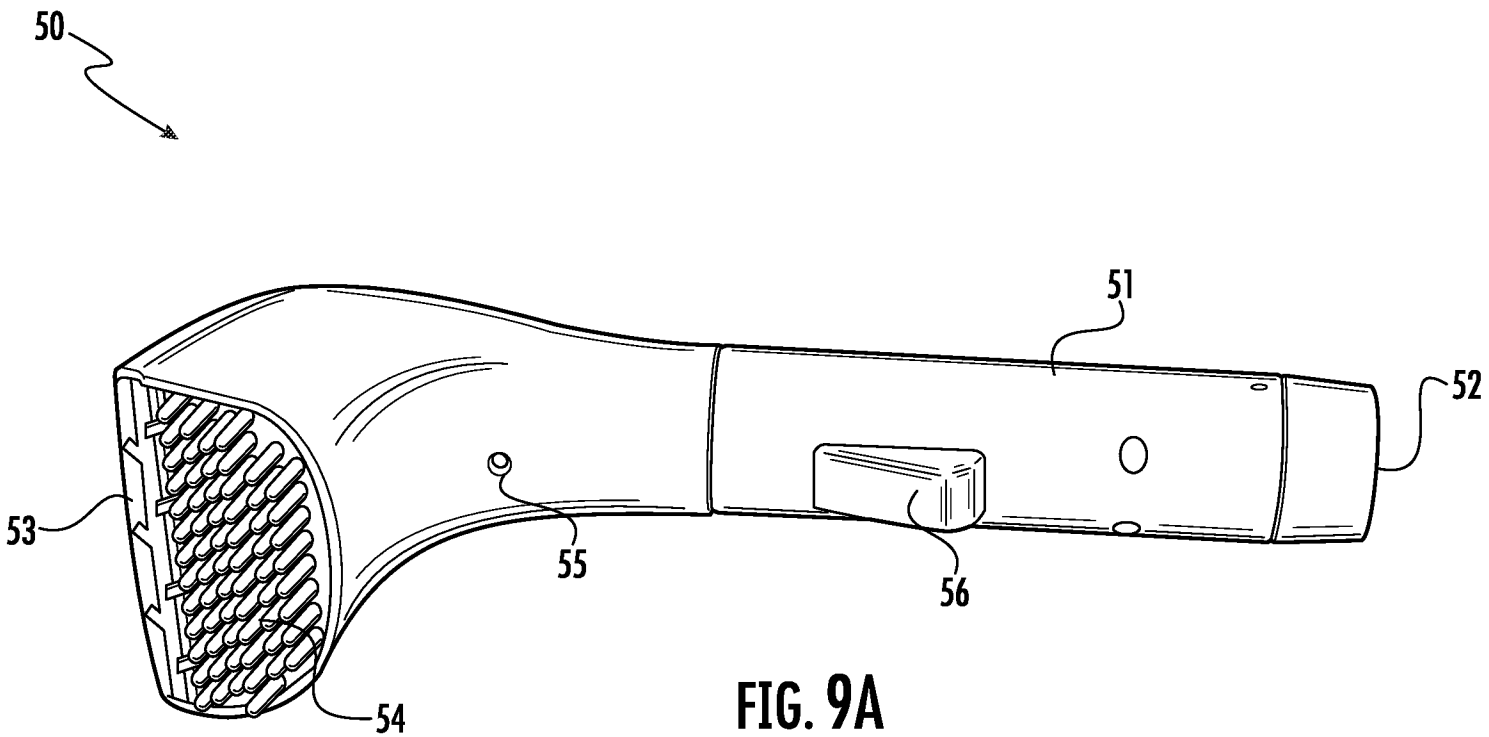
FIGS. 9A-9B are perspective views of two exemplary cleaning heads for the spot cleaner apparatus of FIG. 1.

Referring to FIG. 9A, an exemplary cleaning head 50, also referred to as a fluid distributor or a fluid distribution and recovery device, is shown. As discussed above, the cleaning head 50 is fluidly coupled to the main housing via the hose 60, or via another fluid conduit. The hose 60, also referred to as a fluid and vacuum supply conduit, supplies both suction and cleaning fluid to the cleaning head 50 so that a user may clean a surface with the cleaning head 50. The dual operation can be done via dedicated conduits, as described above. The shown cleaning head 50 includes a handle 51 for the user to hold and a hose attachment 52 for attaching the hose 60. The hose attachment 52 may include partitioning to separate the fluid to be output via the cleaning head 50, and airflow of the suction into the cleaning head 50. The cleaning head 50 includes a plurality of vacuum inlets 53 at a distal end thereof for recovering cleaning fluid and soiled matter from the surface being cleaned. The shown cleaning head 50 includes a plurality of side-by-side inlets 53, although other arrangements and patterns may be contemplated as well, for instance different rows of inlets 53. In the shown case, the inlets 53 are disposed adjacent a plurality of brushes or bristles 54 for agitating or loosing the surface to be cleaned. In other cases, the cleaning head 50 may not include such brushes or bristles. In an embodiment, the bristles 54 are made of a polymer, such as silicone. Other means for loosing the soiled matter or otherwise generating friction may be contemplated as well. The shown handle 51 curves towards the inlets 53 and brushes 54, although other configurations may be contemplated as well.

The cleaning head 50 further includes an orifice 55 for dispersing the cleaning fluid towards the surface to be cleaned to aid in loosing the soiled matter to be recovered by the vacuum inlets 53. The direction at which the fluid exits the orifice 55 may vary, for instance parallel to direction of the airflow entering the inlets 53. In the shown case, the fluid is nebulized as it exits the orifice 55 due to the size of the orifice 55, the temperature of the fluid due to the heater 130, and the pressure of the fluid due to the pump 121. By nebulized, it is intended that the cleaning fluid exits the orifice 55 appearing like a mixture of liquid and mist in a spray bottle-like fashion. Other fluid exit means may be contemplated as well. By nebulizing the heated cleaning fluid upon delivery, the cleaning head 50 may disperse the cleaning fluid in a mist-like fashion. As such, the cleaning fluid may be well distributed across the surface to be cleaned without needing to heat the cleaning fluid to its boiling point to achieve steam. In another embodiment, the fluid is vaporized. In various cases, steam may be produced by heating the cleaning fluid below or above its boiling point. In cases where the optional heater 130 is not present, the cleaning head 50 may still distribute the cleaning fluid in a mist-like form due to the pressure from the pump 121 and the nebulized effect from the orifice 55. In other cases, the orifice 55 may be shaped to distribute the cleaning fluid in a jet or fan-like stream.

The shown cleaning head 50 further includes a trigger 56. In some cases, squeezing the trigger 56 may interrupt a continuous flow of cleaning fluid to the orifice 55. In other cases, squeezing the trigger 56 may induce the flow of cleaning fluid to the orifice 55. In other cases, squeezing the trigger 56 may induce or cut off the flow of suction from the cleaning head 50. For instance, in some cases a user may wish to saturate a stained surface with cleaning fluid, interrupt suction for a given amount of time to allow the fluid to permeate into the stained surface, and the reengage the suction flow to draw in the soiled matter and the cleaning fluid. Other modes of operation may be contemplated as well. In an embodiment, the use of the trigger 56 causes a simultaneous and concurrent jetting of cleaning fluid and vacuuming of the cleaning fluid with soiled matter, to limit dampening of the surface being cleaned.

Figure 9B:
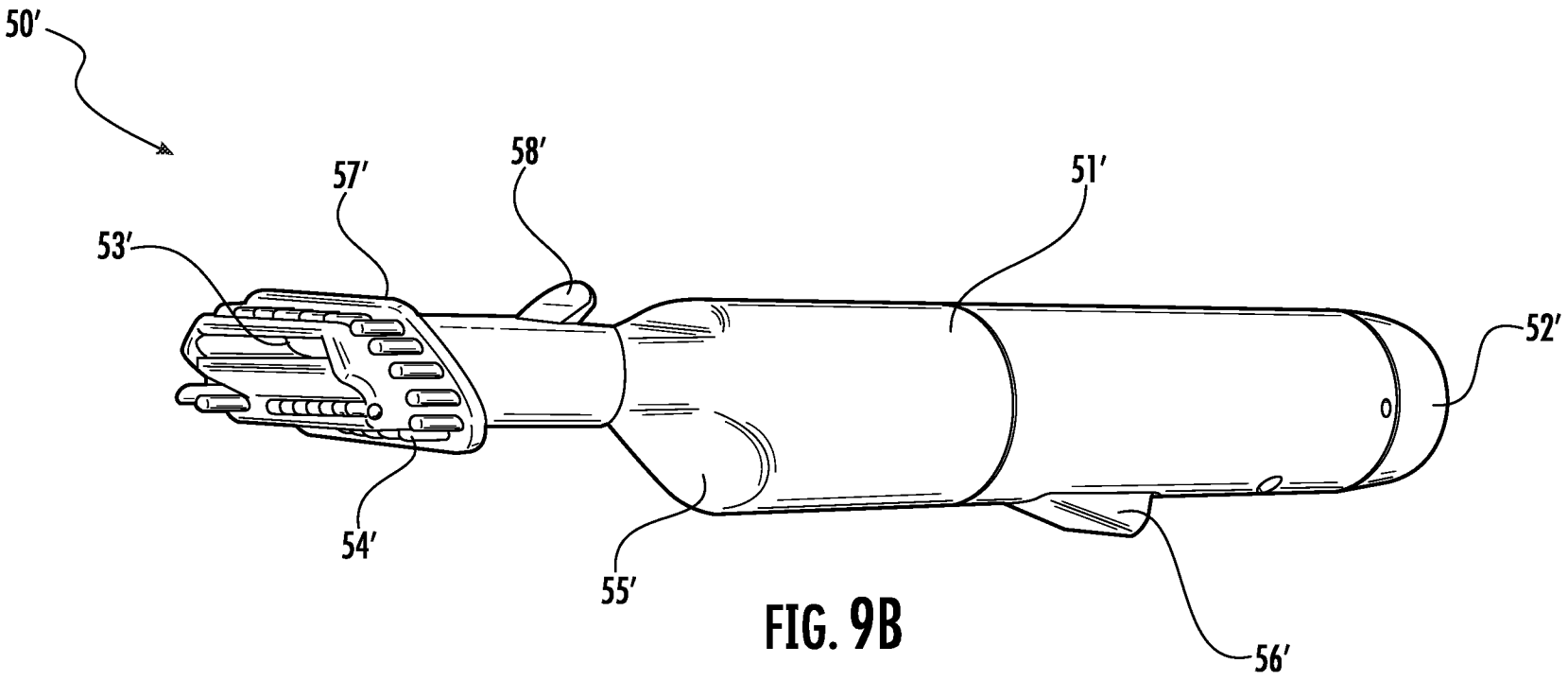

Referring to FIG. 9B, another embodiment of a cleaning head 50' is shown. In the shown case, the handle 51' extends axially towards a single inlet 53' and two surrounding rows of brushes 54'. While FIG. 9B shows cleaning head 50' to have a single inlet 53', other numbers of inlets may be contemplated as well. The shown orifice 55' directs the cleaning fluid axially, although other directions may be contemplated as well. The shown cleaning head 50' includes a removable end piece 57' on which the inlet 53' and brushes 54' are disposed. A clip 58' may be provided to attach or detach the removable end piece 57', although other attachment means may be contemplated as well.

Referring to FIGS. 2A-3, the control panel 80 is present on an exterior surface of the main housing 20 for controlling the operations of the spot cleaner apparatus 10. In the shown embodiment, although not necessarily the case in all embodiments, the control panel 80 includes a power button 81, a fluid temperature button 82 and plurality of lights 83. Other buttons or status indicators may be contemplated as well. In some cases, the control panel 80 may include a graphical user interface.

The control panel 80 may be operatively connected to a PC board 150 for controlling the operations and functions of the spot cleaner apparatus 10, and actuatable components thereof. In the shown case, the PC board 150 is mounted to the pump cap 122 within the interior of the main housing 20, although other locations for the PC board 150 may be contemplated as well. The power button 81 may be used to turn the spot cleaner apparatus 10 on or off, for instance by activating or deactivating the vacuum assembly 90. In some cases, the power button 81 may be used to cycle through different vacuum speeds, while in other cases an additional dedicated button may be provided for this. The temperature control button 82 may be used to cycle through different temperature setting for the heater 130 and/or to turn off the heater 130. Additional controls may be provided to control the flow of cleaning fluid provided by the pump 121. As discussed above, a user may alternatively or concurrently control the flow of suction or cleaning fluid via the trigger 56 on the cleaning head 50. Other control means may be contemplated as well.

In an embodiment, the temperature of the cleaning fluid may be inversely controlled via the selected flow rate of the cleaning fluid. For instance, in the shown case, by decreasing the flow rate of the cleaning fluid, the cleaning fluid would flow at a lower rate through the in-line fluid heater 130 (FIG. 2B), allowing the heater 130 to heat the cleaning fluid to a higher temperature. As such, the temperature control button 82 on the control panel 80 may, through the PC board 150, inversely control the flow rate of the cleaning fluid via the pump assembly 120. In other cases, adjusting the temperature control button 82 may cause the PC board 150 to increase or decrease the wattage delivered to the heater 130 to directly either increase or decrease the heat delivered to the cleaning fluid. Other means for controlling the optional heater 130 may be contemplated as well.

Various means for controlling the flow rate of the cleaning fluid delivered to the cleaning head 50 via the pump assembly 120 may be contemplated. In the shown case, a button on the control panel 80, for instance the temperature control button 82 or a dedicated flow rate button (not shown), may be connected to the PC board 150, which may control the operations of the pump assembly 120. In other cases, the PC board 150 may be omitted and the flow rate of the cleaning fluid may be controlled via alternate means. For instance, as the spot cleaner apparatus 10 is turned on, full power may be delivered to the pump assembly 120 by default. A user may subsequently reduce the power to reduce the flow rate, and consequently increase the fluid temperature in cases where the optional heater 130 is present. Power may be reduced, for instance, via a control knob that may act as a voltage selector or dimmer switch for the power delivered to the pump assembly. Alternatively, a physical restrictor may be provided within one of the tubes or conduits to selectively reduce the flow rate of the cleaning fluid. Similarly, a device may be used to externally squeeze or kink one of the tubes or conduits to selectively reduce the flow rate of the cleaning fluid. Other means for controlling the flow rate of the cleaning fluid may be contemplated as well.

The lights 83 may indicate various statuses of the spot cleaner apparatus 10, for instance: an on/off state, a vacuum assembly 90 setting, a heater 130 temperature setting, a pump 121 pressure setting, and/or a heater 130 on/off state. Other status indications may be contemplated as well. In other cases, other visual or auditory status indicators may be provided. Other modes of operation may be contemplated as well. For instance, the control panel 80 may allow for independent control of the various fluid delivery equipment, such as the pump 121 and heater 130, from the various fluid recovery equipment, such as the vacuum assembly 90. As such, in a sequential mode of operation, a user may first engage the pump 121 and heater 130 to deliver cleaning fluid to a soiled or stained surface. Then, after waiting an appropriate amount of time for the cleaning fluid to penetrate the surface and loosen the dirt, debris or other soiled matter, the user may disengage the fluid delivery equipment and engage the vacuum assembly 90 to recover the liquid, dirt and other debris. The power button 81 may permit a user to cycle between such a sequential mode of operation and a mode of operation whereby the fluid delivery and recovery equipment are engaged simultaneously. In an embodiment, the control panel 80 is controlled in IoT mode, for instance using WIFI®, Bluetooth®, or other telecommunications protocol.

In the shown case, the dirty fluid tank 40 is greater in volume than the clean fluid tank 30. The shown dirty fluid tank 40 is approximately one and a half times greater in volume than the shown clean fluid tank 30, although other size differences may be contemplated as well. The dirty fluid tank 40 may be sized greater, for instance, to account for the additional matter (i.e. dirt and other soiled matter) from the surface being cleaned in addition to the recovered cleaning fluid, or in the event that external liquid is vacuumed by the apparatus 10. As can be seen in FIGS. 4A-4B, the height of the dirty fluid tank 40 is greater than the height of the clean fluid tank 30. As such, as the recovered cleaning fluid accumulates in the dirty fluid tank 40, the rising fluid is less likely to reach the top of the second separator tube 42B, requiring the float 46 to seal the tube 42B. Other tank size considerations may be contemplated as well.

The spot cleaner apparatus 10 may include a controller integrated with the PC board 150 which is in charge of the operation of the spot cleaner apparatus 10. The controller may be a processing unit, and may have a non-transitory computer-readable memory communicatively coupled to the processing unit and comprising computer-readable program instructions executable by the processing unit for operating the spot cleaner apparatus 10. The controller is powered, for instance, by being connected to the grid by a power cord, or by connection to a battery. The controller may be wired via the PC board 150 to the various powered components of the spot cleaner apparatus 10, such as the vacuum assembly 90, pump 121 and heater 130. Moreover, the controller may include various other sensors, such as temperature sensors (e.g., thermocouple) and water level sensors. In some cases, the controller may connect to a position sensor operable to detect the rotational positioning of the handle 70. In such cases, the controller may only allow the spot cleaner apparatus 10 to operate when the handle 70 is in a given position, for instance the "locked" position shown in FIG. 4B. The controller may be controlled via a user interface, for instance the control panel 80.

Figure 10:
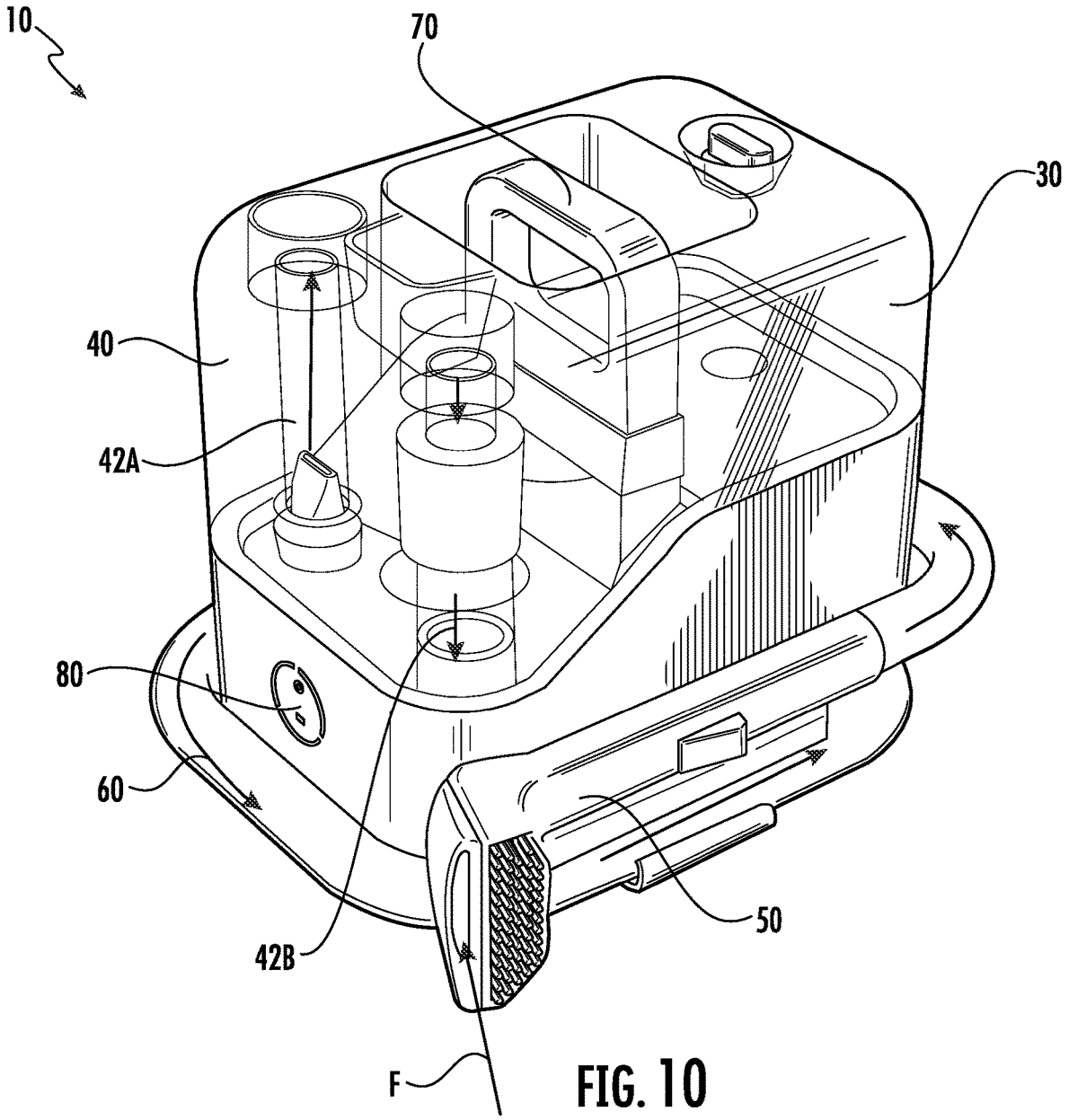
FIG. 10 is a perspective view showing an exemplary mode of operation of the spot cleaner apparatus of FIG. 1.
Figure 11:
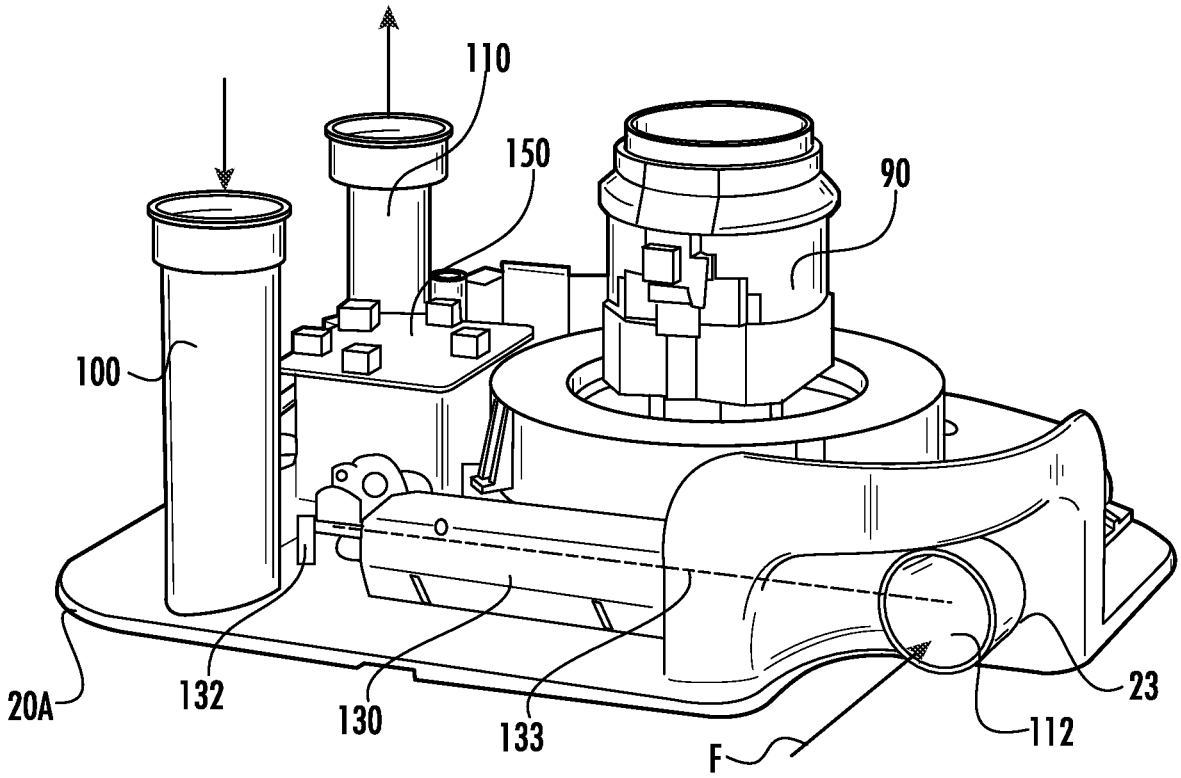
FIG. 11 is a perspective view showing the exemplary mode of operation of FIG. 10 with regards to the interior compartment of the spot cleaner of FIG. 1.

Referring to FIGS. 10-11, the spot cleaner apparatus 10 may provide a simple solution for cleaning various soiled surfaces such as stains on carpets or upholstery. In an exemplary embodiment, when power is provided to the pump 121, the pump 121 takes cleaning fluid from the clean fluid tank 30 and pumps it through the heater 130 which heats the cleaning fluid to a temperature below boiling. The fluid may pass through the heater 130 without being heated. The cleaning fluid then passes through the hose 60 or appropriate dedicated conduit and exits the cleaning head 50 through a small orifice 55 to nebulize the cleaning fluid, making it look like mist or steam. This cleaning fluid may soak the carpet or other surface to remove the stain before the vacuum assembly 90 sucks or draws in the mixture of fluid, dirt, debris and/or other soiled matter.

Simultaneously or subsequently, when power is provided to the motor 91, the fan 92 generates a vacuum airflow, denoted as F in FIGS. 10-11. The vacuum airflow F passes through the vacuum inlet(s) 53 in the cleaning head 50, through the hose 60, into the main housing 20 and into the dirty fluid tank 40 via tubing 112 and the dirty fluid tank inlet tube 110. The integrated liquid/air separator 41 within the dirty fluid tank 40 then separates the vacuum airflow F from the cleaning fluid and recovered soiled matter before the vacuum airflow F arrives at the vacuum assembly 90. The vacuum airflow F is then exhausted through the vacuum exhaust 93 on the underside of the base 20A. The clean fluid tank 30, pump assembly 120, heater 130, hose 60, and cleaning head 50 may thus form a fluid delivery system. Similarly, the cleaning head 50, hose 60, dirty fluid tank 40, and vacuum assembly 90 may form a fluid recovery system. Other modes of operation may be contemplated as well.

Referring to FIGS. 12A-22, there is shown an alternative spot cleaner apparatus 1010 in accordance with the present disclosure. The spot cleaner apparatus 1010 is used to clean a dirty or soiled surface, for instance by discharging a cleaning fluid onto the surface and removing the fluid along with dirt, debris or other soiled matter via a vacuum inlet. The spot cleaner apparatus 1010 includes a main housing 1020, similar to main housing 20, which forms a structural part of the spot cleaner apparatus 1010 and encloses various components of the spot cleaner apparatus 1010. The main housing 1020 supports a clean fluid tank 1030, similar to clean fluid tank 30, for holding a cleaning solution and a dirty fluid tank 1040, similar to dirty fluid tank 1040, for holding the recovered soiled matter and cleaning solution from the surface being cleaned. More generally, when applicable, the various characteristics, options and alternatives of the spot cleaner apparatus 10 are also usable in the spot cleaner apparatus 1010, and vice-versa, with like reference numerals referring to like features, though in the 1000's (i.e., +1000). For example, the main housing 20 in the spot cleaner apparatus 10 is equivalent to the main housing 1020 in the spot cleaner apparatus 1010.

Referring to FIGS. 12A-12D, The spot cleaner apparatus 1010 is shown as having a main housing 1020 which includes a base or base portion 1020A and a casing 1020B. The casing 1020B defines an inner cavity so as to conceal the interior components of the spot cleaner apparatus 1010 and is mounted to the base 1020A, while the interior components may be mounted to the base 1020A or to surfaces of the casing 1020B. The main housing 1020 supports a clean fluid tank 1030 for holding a cleaning solution and a dirty fluid tank 1040 for holding the recovered soiled matter and cleaning solution from the surface being cleaned. As will be discussed in further detail below, clean fluid tank 1030 is formed of a clean tank body 1030A with a removable clean tank lid 1030B. Similarly, dirty fluid tank 1040 is formed of a dirty fluid tank body 1040A with a removable dirty fluid tank lid 1040B.

Cleaning head 1050 is fluidly coupled to the main housing 1020 via a flexible hose 1060. Other fluid conduits may be contemplated as well. As will be discussed in further detail below, the hose 1060 may be partitioned to simultaneously deliver fluid from the clean fluid tank 1030 to the cleaning head 1050 while drawing an airflow or fluid flow containing debris-containing fluid away from the cleaning head 1050.

The shown spot cleaner apparatus 1010 may include a handle 1070 and may be said to be portable as it is easily transportable from one location to another, for instance by grabbing the handle 1070, without necessarily requiring lifting equipment, with manual force being sufficient to transport the spot cleaner apparatus 1010. The shown handle 1070 is attachable to the main housing 1020. In other cases, one or more handles may be moulded or otherwise formed into the body of the spot cleaner apparatus 1010 to facilitate transport. In other cases, the base 1020A or casing 1020B may include recesses, cutouts or mouldings acting as handles for a user to carry the spot cleaner apparatus 1010 from underneath. Casters or like wheels may also be present for the apparatus 1010 to be rollingly displaced. While the spot cleaner apparatus 1010 is shown as a portable extraction cleaner, in other embodiments, aspects of the present disclosure may be applicable to other types of surface cleaners, for instance upright vacuum cleaners movable along a surface.

A variety of retaining means for the cleaning head 1050 and hose 1060 may be included on the main housing 1020, for instance clips 1021. The clips 1021 may be removable attachments to the main housing 1020, or in other cases may be moulded or otherwise integrated into the main housing 1020. The hose 1060 may be removably or non-removably attached to the main housing 1020 at housing inlet/outlet 1023. A plurality of seating pads or other types of legs 1024 on the underside of the base 1020A may elevate the base 1020A from the ground, for instance to facilitate venting of the various components housed within the main housing 1020. The legs 1024 are optional. As will be discussed in further detail below, a control panel 1080 on an outside surface of the main housing 1020 may allow a user to control various functions of the spot cleaner apparatus 1010.

The clean fluid tank 1030, also referred to as a clean fluid supply tank or reservoir, holds a cleaning fluid to be applied to the surface to be cleaned via the hose 1060. The cleaning fluid may include a mixture of water and various types of cleaning agents or detergents. Other mixtures may be contemplated as well. In some cases, the cleaning fluid includes only water. As will be discussed in further detail below, in the shown case the clean fluid tank 1030 is non-removably attached to the main housing 1020. As users may tend to lift the apparatus 1010 via the clean fluid tank 1030, the non-removability may ensure that the fluid tank 1030 remains connected in spite of the raising action. Moreover, the non-removability may reduce the number of manipulations and reduce spill risks. The cleaning fluid may be poured or otherwise inserted into the clean fluid tank 1030 by removing the clean tank lid 1030B to allow access to an interior volume of the clean tank body 1030A. Excess fluid may be drained in a similar manner. A closing or locking mechanism may be provided for locking the clean tank body 1030A and clean tank lid 1030B together, as will be discussed in further detail below. The shown clean fluid tank 1030 may be transparent so that a user may see the quantity of cleaning fluid held within. Similarly, in other cases the clean fluid tank 1030 may be translucent and/or opaque. Markings or other volume identifiers may be present on an outside wall of the clean fluid tank 1030 as well.

Referring to FIGS. 16A-16D, the dirty fluid tank 1040, also referred to as a recovery tank or reservoir, holds dirt, debris, and other soiled matter along with cleaning fluid recovered by the cleaning head 50 (FIG. 12A) from the surface being cleaned. As will be discussed in further detail below, the dirty fluid tank 1040 may include an integrated liquid/air separator 1041 for separating the recovered liquid from the flow of suction air. The shown dirty fluid tank 1040 is removably attached to the main housing 1020. As such, it may be detached and removed, for instance to be emptied and cleaned when its capacity has been reached by removing the dirty tank lid 1040B to allow access to an interior volume of the dirty tank body 1040A. The dirty fluid tank 1040 may be clear or translucent so that a user may see the quantity of recovered fluid in the tank. Markings or other volume identifiers may be present on an outside wall of the dirty fluid tank 1040 as well.

Referring concurrently to FIGS. 13A-15B, exemplary components housed in the interior of the main housing 1020 are shown in greater detail. The base 1020A supports various components that may be molded or otherwise attached to the surface of the base 1020A. Protrusions, clips, mouldings or other such features may be present on the surface of the base 1020A to facilitate such attachment. Other constructions are contemplated.

Figure 12A:
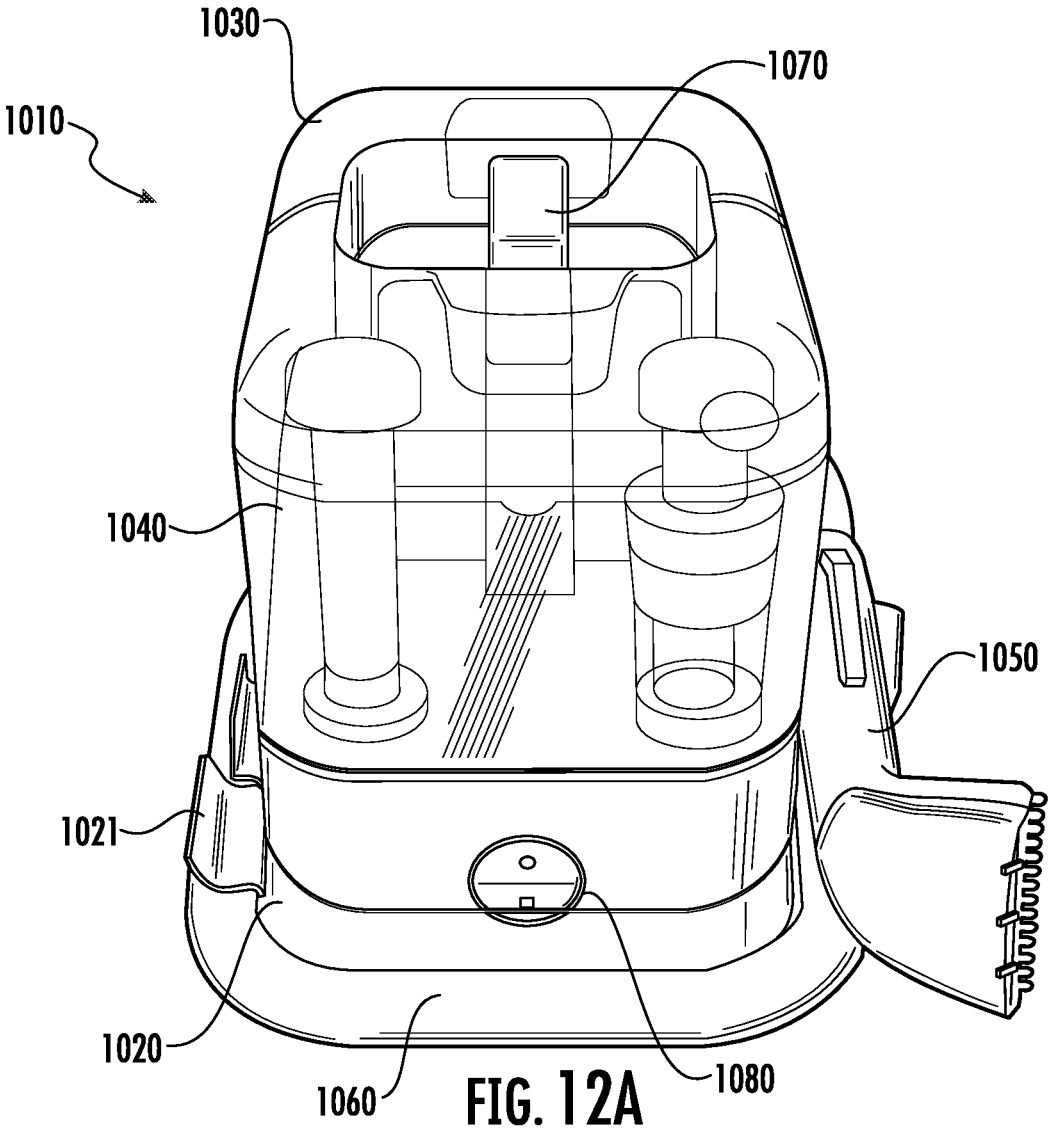
FIGS. 12A-12D are raised front, side, top perspective and bottom perspective views, respectively, of a spot cleaner apparatus in accordance with another embodiment of the present disclosure.
Figure 12B:
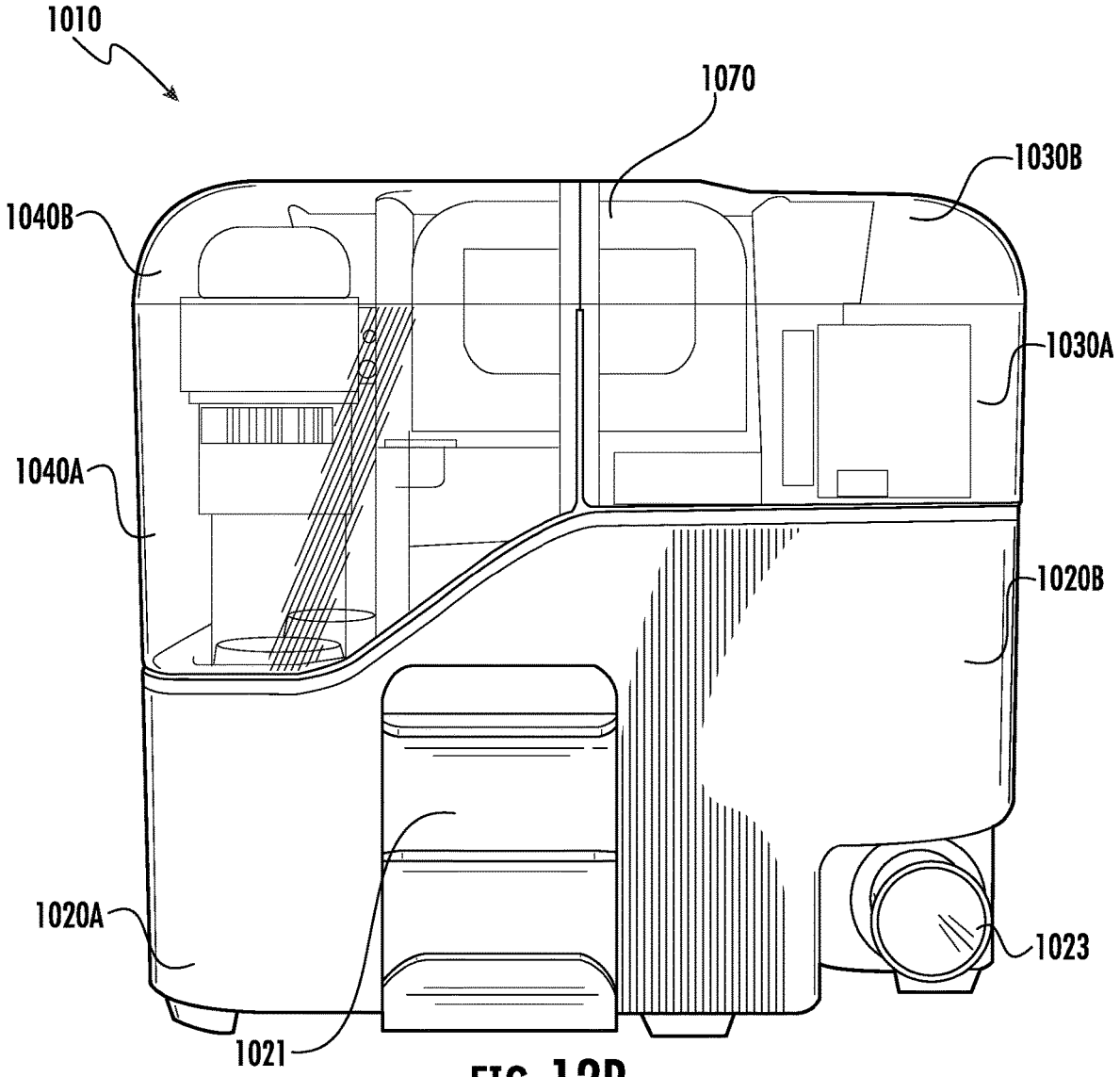
Figure 12C:
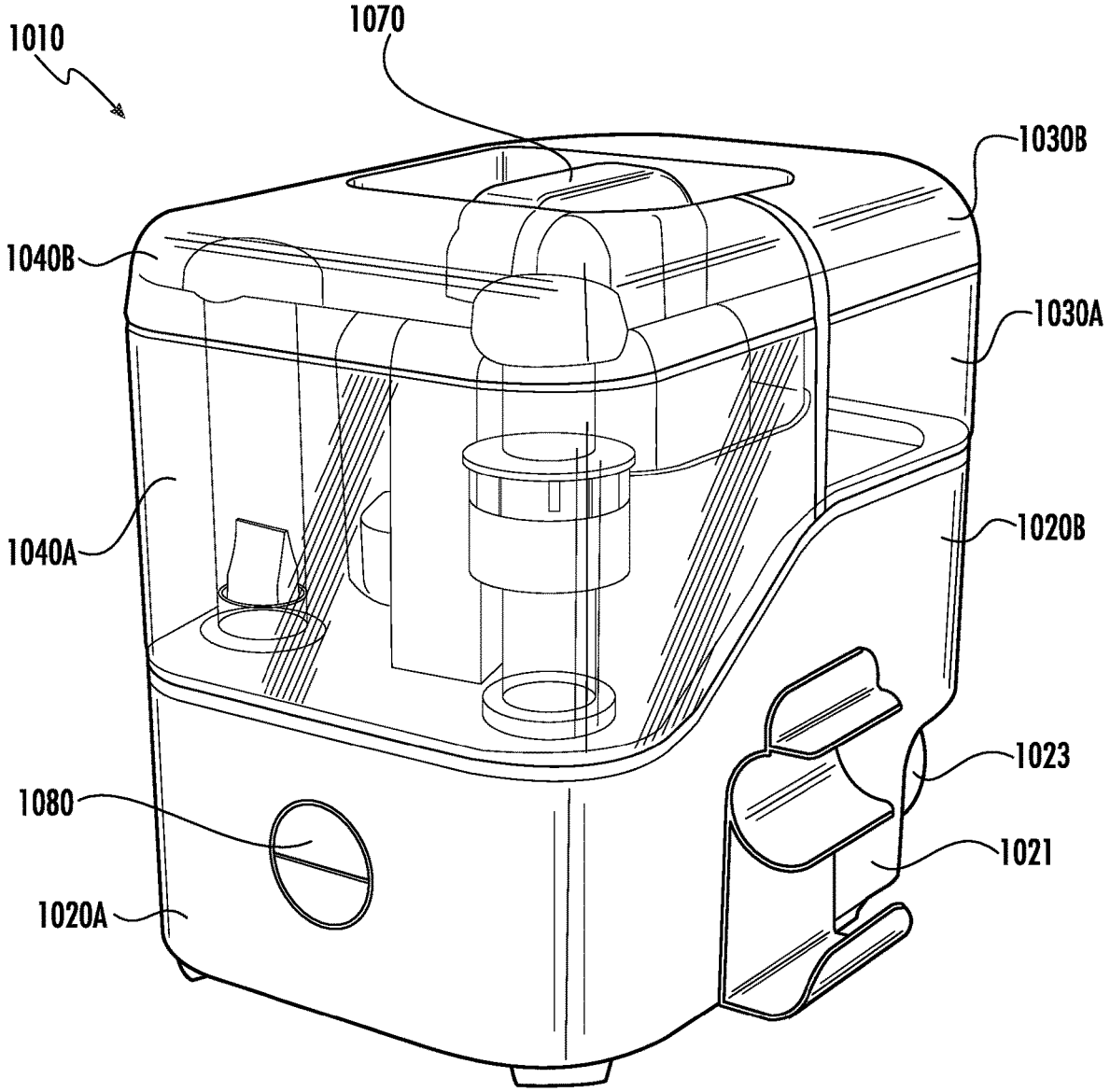
Figure 12D:
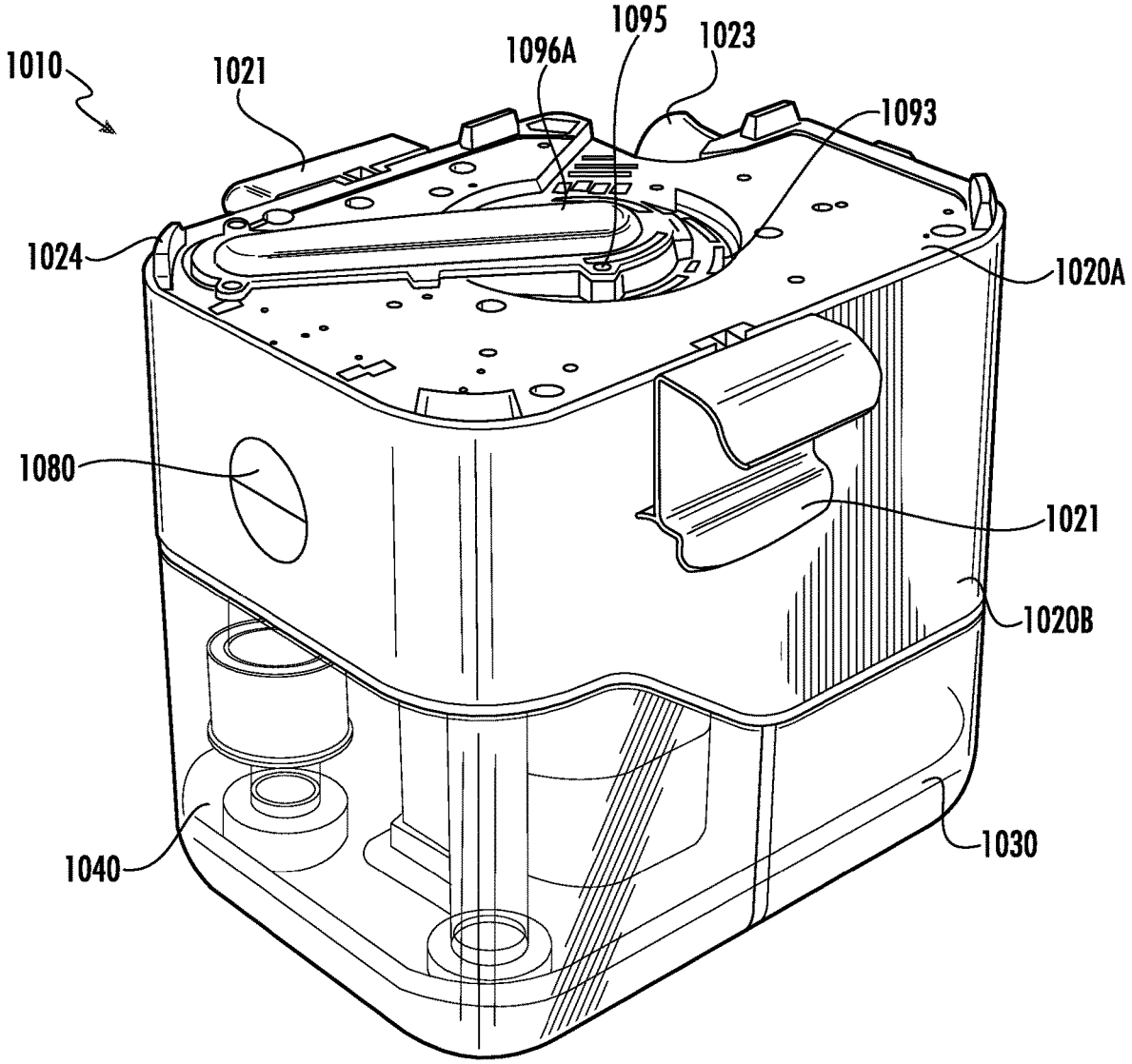

A vacuum assembly 1090 within the main housing 1020 provides suction airflow to the cleaning head 1050 through the hose 1060. The vacuum assembly 1090 includes an electric motor 1091 powered by a power source such as the power grid via a power cord 1160 (see FIG. 21) or an onboard battery (not shown). The electric motor 1091 drives a centrifugal fan 1092 which draws air from the cleaning head 1050 and exhausts the air through vacuum exhausts 1093 on the underside of the base 1020A, as can be seen in FIG. 12D. The fan 1092 may additionally or alternatively provide a cooling flow for various components within the main housing 1020. Other vacuum and exhaust means may be contemplated as well. The centrifugal fan 1092 is one option among others to create a vacuum effect, an axial fan, a vacuum pump being alternative examples among others.

A dirty fluid tank outlet tube 1100 is fluidly coupled to the vacuum assembly 1090, for instance via a tube or conduit 1096 (see FIG. 22), and is operable to draw air from the dirty fluid tank 1040. A bottom cover 1096A for conduit 1096 may be fastened to the underside of the base 1020A via a plurality of fasteners 1095 (see FIG. 12D), although other retaining means, for instance clips or hinges, may be contemplated as well. An additional conduit 1097 may act as a safety conduit in case of overflow and return excess fluid escaping into conduit 1096 back into the dirty fluid tank 1040 (FIG. 22) or to a drain outlet. The dirty fluid tank outlet tube 1100 may be moulded to the surface of the base 1020A as shown. Alternatively, the dirty fluid tank outlet tube 1100 may be a removable tube that is attachable to the base 1020A. A gasket 1101 (FIG. 13A) is optionally provided to connect and seal the dirty fluid tank outlet tube 1100 to the dirty fluid tank 1040 and prevent water or air leakage from the dirty fluid tank 1040. Other sealing means may be contemplated as well. A grid 1102 at the opening of the dirty fluid tank outlet tube 1100 may prevent unwanted recovered matter in the dirty fluid tank 1040 from entering the airstream towards the vacuum assembly 1090. The grid 1102 is optional.

Figure 13A:
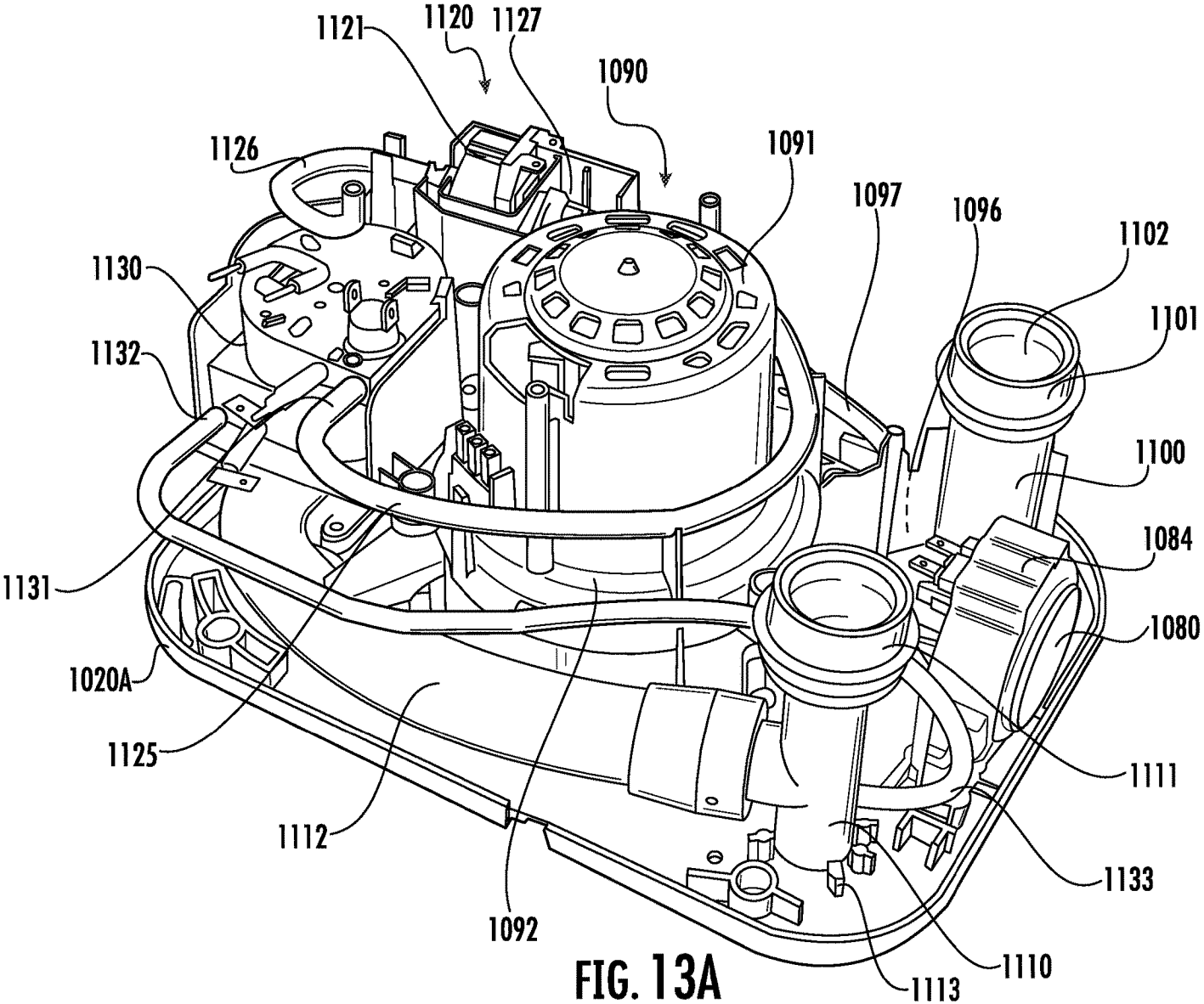
Figure 13B:
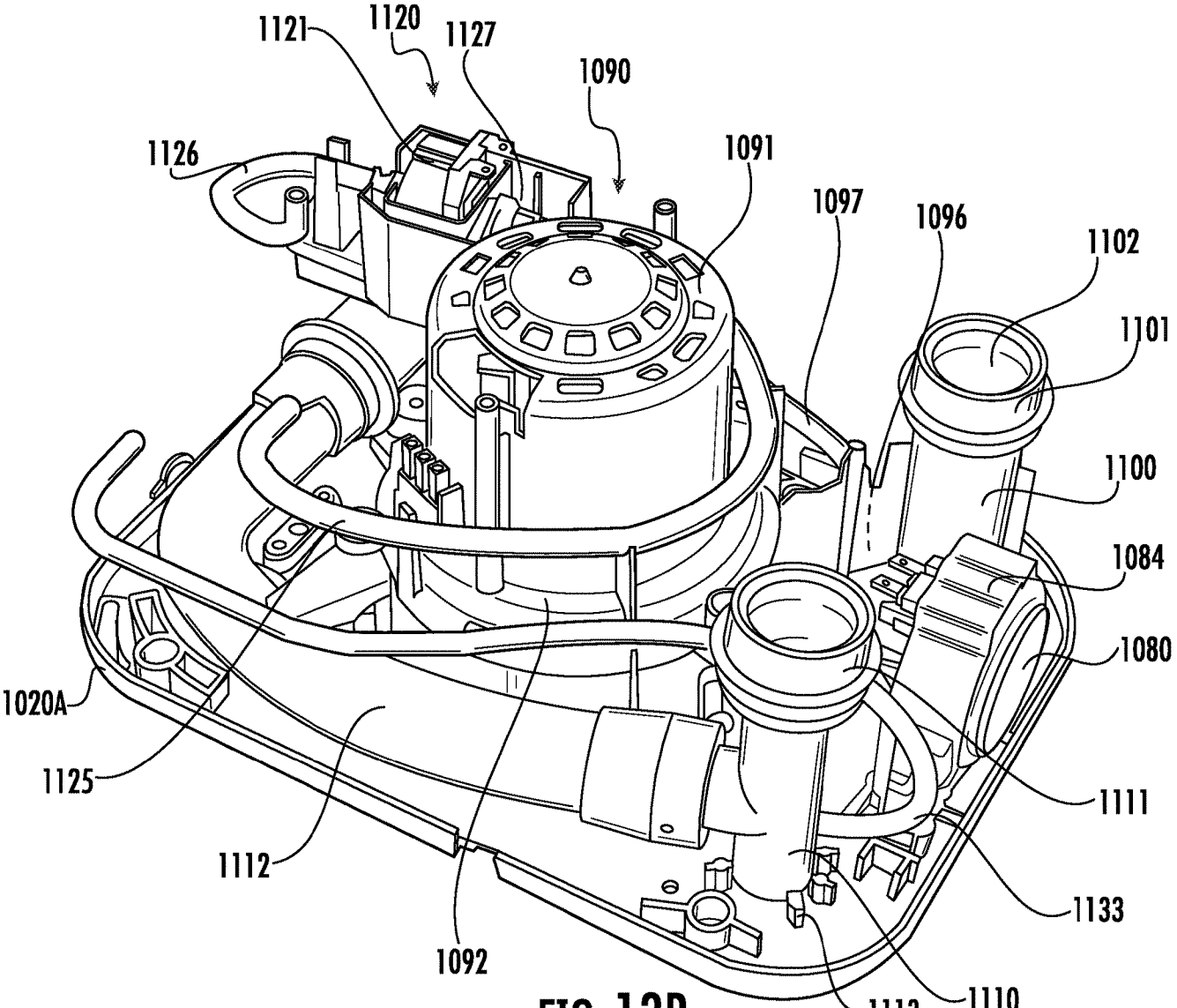

Referring to FIGS. 13A-13B, a dirty fluid tank inlet tube 1110 fluidly couples the cleaning head 1050 to the dirty fluid tank 1040. A gasket 1111 or like seal may be provided to connect and seal the dirty fluid tank inlet tube 1110 to the dirty fluid tank 1040 and prevent fluid or air leakage from the dirty fluid tank 1040. Other sealing means may be contemplated as well. Tubing 1112 fluidly couples the hose 1060 via the housing inlet/outlet 1023 to the dirty fluid tank inlet tube 1110. In some cases, the tubing 1112 may extend through the housing inlet/outlet 1023 and connect directly to the hose 1060. Alternatively, the housing inlet/outlet 1023 (FIG. 12D) may act as an intermediary connector between the hose 1060 and the tubing 1112. As discussed above, the hose 1060 may be removably or non-removably attached to the main housing 1020. The tubing 1112 may include multiple sections that are joined together, for instance to give same the optional elbow shape of FIG. 13A-13B, or may be have a flexible conduit portion. The dirty fluid tank inlet tube 1110 and tubing 1112 may be removable from the main housing 1020, for instance to be cleaned. In the shown case, the dirty fluid tank inlet tube 1110 is removably seated within inlet tube supports 1113 (FIGS. 13A-13B) moulded into the base 1020A. Other attachment means for the dirty fluid tank inlet tube 1110 may be contemplated as well.

Figure 13C:
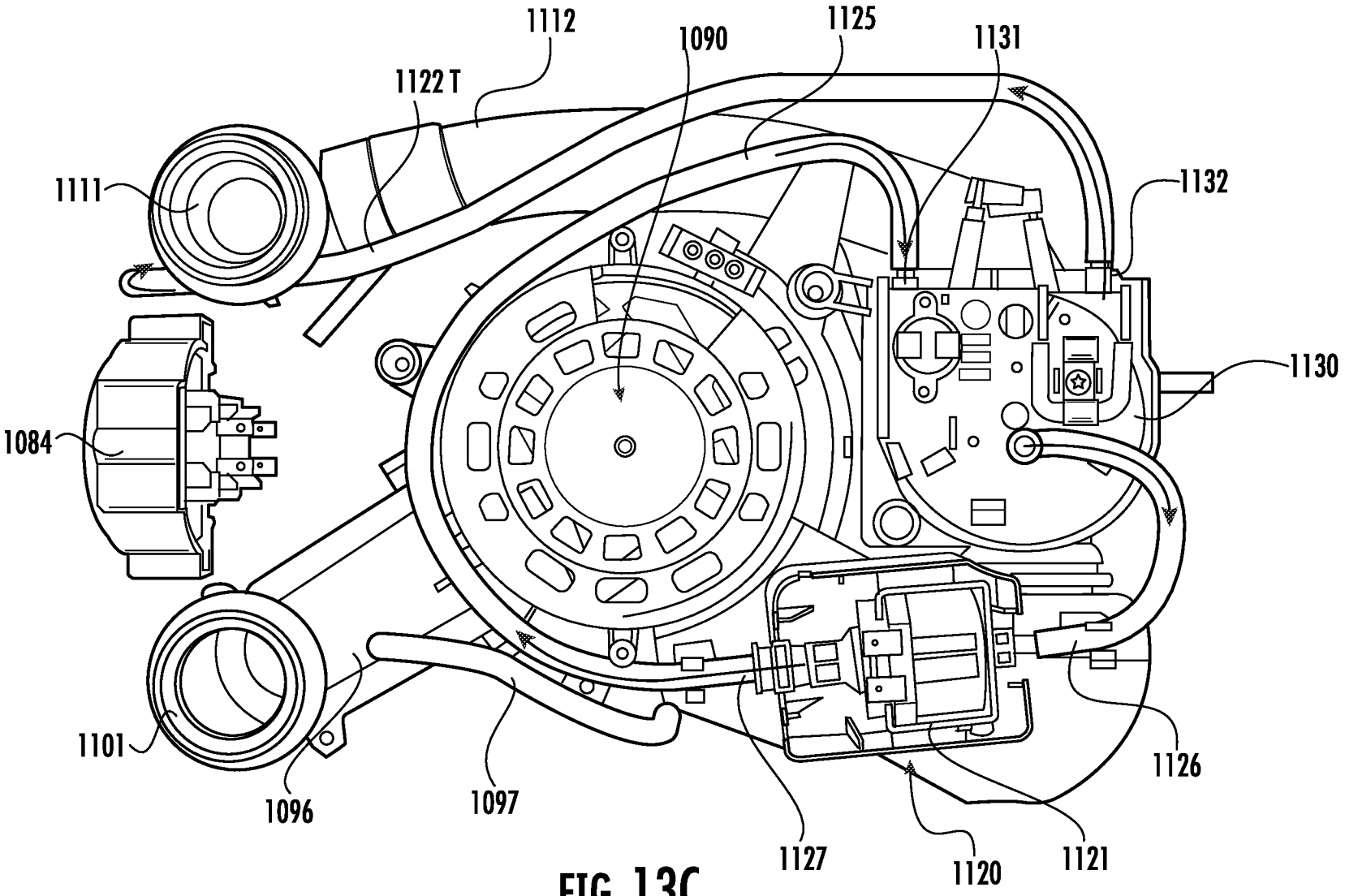

As shown in FIGS. 13A-13C, a pump assembly 1120 is provided for pumping the fluid stored in the clean fluid tank 1030 to the cleaning head. A pump 1121 may be enclosed in its own air chamber, or may be a self-contained unit. The pump 1121 may be a single-stage fluid pump having a single impeller (not shown), although other pump types, such as a reciprocating pump, e.g., electromagnetic pump, may be contemplated as well. Various sealing means for the pump 1121 within the main housing 1020 may be contemplated. In use, the pump 1121 draws power from one of the above-mentioned power sources and directs cleaning fluid from the clean fluid tank 1030 to the cleaning head 1050 via hose 1060. Various tubes, pipes or other fluid conduits may be provided to direct the cleaning solution between the clean fluid tank 1030, the pump assembly 1120, and the hose 1060. For instance, a pump inlet conduit 1126 may direct the cleaning solution from the clean fluid tank 1030 to the pump assembly 1120, while a pump outlet conduit 1127 may direct fluid away from the pump assembly 1120, as will be discussed in further detail below.

Figure 22:
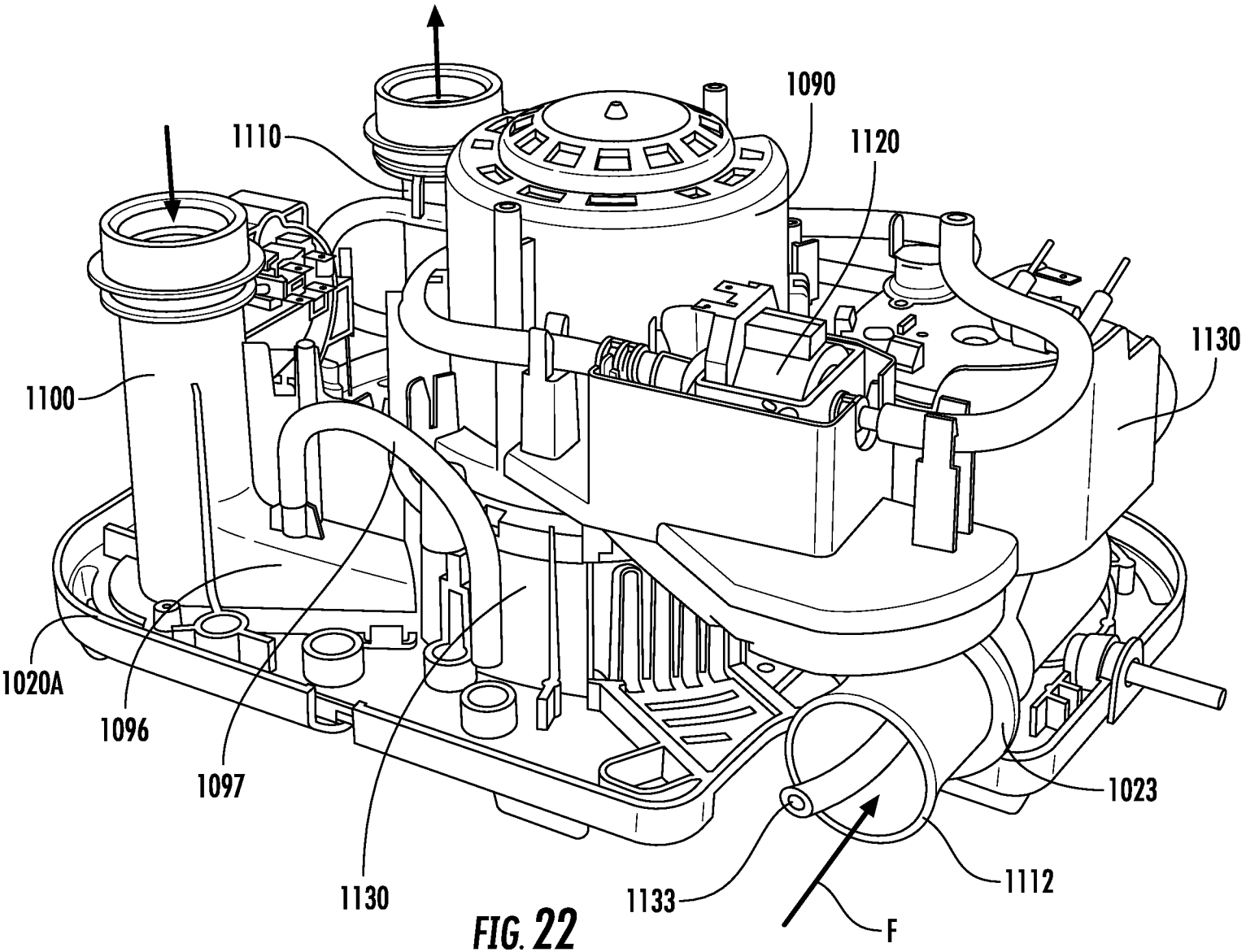
FIG. 22 is a perspective view showing the exemplary mode of operation of FIG. 10 with regards to the interior compartment of the spot cleaner of FIG. 12.

A heater 1130 is illustratively provided to heat the fluid from the clean fluid tank 1030 before it is applied to the surface to be cleaned. In the shown case, the heater 1130 is an in-line heater, although other heater types may be contemplated as well. For instance, the heater 1130 may be integrated within the hose 1060 or provided as an optional add-on attachment to the main housing 1020. The shown heater 1130 includes a heater inlet 1131 receiving cleaning fluid drawn from the clean fluid tank 1030 via the pump 1121, illustratively via pump outlet conduit 1127 exiting the pump 1121, and a heater outlet 1132 directing the now-heated cleaning fluid to the cleaning head 1050 via the hose 1060. For instance, the heater outlet 1132 may be fluidly coupled to a conduit 1133 which passes through tubing 1112 ((FIG. 13A-13B) towards outlet 1023 where conduit 1133 continues through hose 1060 to deliver the cleaning solution to the cleaning head 1050, forming concentric (or eccentric) inner and outer feed and return channels for bidirectional flow (FIG. 22). In the shown case, the pump 1121 is upstream of the heater 1130, i.e. cleaning fluid first passes through the pump 1121 before arriving at the inlet 1131 of the heater 1130, for instance via a conduit 1125 (FIGS. 13A-130). The reverse configuration may be contemplated as well. In various cases, a user may selectively control the outputted temperature of cleaning fluid exiting the heater 1130, for instance via the control panel 1080, as will be discussed in further detail below. Different temperature settings may be available. The average temperature of the cleaning fluid heated by the heater 1130 may be approximately 60 degrees Celsius notably for energy efficiency, although other temperatures may be contemplated as well. The heater 1130 is operable to heat the cleaning fluid to a temperature below the boiling point of the cleaning fluid, for instance 100 degrees Celsius in the case of a primarily water-based cleaning fluid.

As discussed above, the illustrated clean fluid tank 1030 is non-removably attached to the main housing 1020. As such, the clean tank lid 1030B may be removed to allow the clean fluid tank 1030 to be drained of any remaining cleaning fluid after a cleaning process is completed. Such draining may prevent the growth of mold, mildew or other bacteria resulting from leftover liquid remaining in the clean fluid tank 1030 after storage. Other draining means may be contemplated as well.

Figure 14:
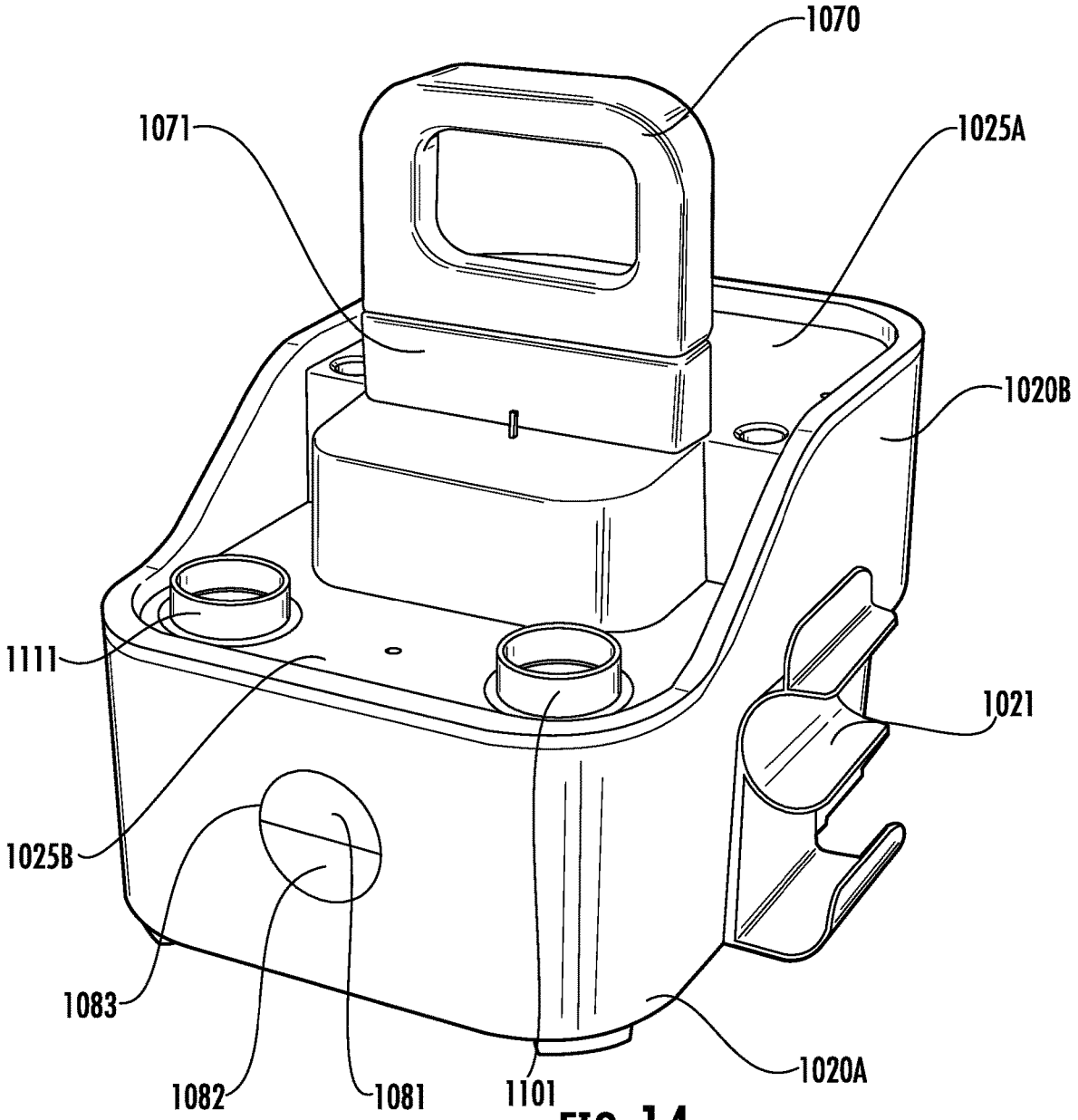
FIG. 14 is a perspective view of a housing of the spot cleaner apparatus of FIG. 12.

As shown in FIG. 14, the casing 1020B includes a pair of upper surfaces for receiving the fluid tanks 1030, 1040. In particular, a clean fluid tank-receiving surface 1025A is operable to non-removably receive the clean fluid tank 1030, while the dirty fluid tank-receiving surface 1025B is operable to receive the dirty fluid tank 1040. While FIG. 14 shows the casing 1020B without the non-removable clean fluid tank 1030 for illustrative purposes, it is understood that, once installed, the clean fluid tank 1030 would not be removable from the casing 1020B. The surfaces 1025A, 1025B include various features for delivering and removing fluids to or from the tanks 1030, 1040, as will be discussed in further detail below. The surfaces 1025A and 1025B may be in a stepped arrangement, as shown.

Referring to FIGS. 16A-16D, the dirty fluid tank 1040 is shown with an integrated liquid/air separator 1041 for separating the recovered liquid and dirt, debris and/or other soiled matter from the surface to be cleaned from the air stream. The separator 1041 includes two separator or riser tubes: a first separator tube 1042A receiving a mixture of debris-filled liquid and air from the dirty fluid tank inlet 1043, and a second separator tube 1042B through which the separated air stream exits via the dirty tank outlet 1044. The dirty tank inlet 1043 is in fluid communication with the dirty fluid tank inlet tube 1110, while the dirty tank outlet 1044 is in fluid communication with the dirty fluid tank outlet tube 1100. The separator tubes 1042A, 1042B are moulded or otherwise formed so as to integrally project from a bottom wall of the dirty fluid tank 1040. As such, the tubes 1042A, 1042B are said to be integrated with the dirty fluid tank 1040 as they are non-removable from the dirty fluid tank 1040. The non-removable feature of the tubes 1042A and 1042B to the bottom wall of the tank 40 prevents leaks at the junction between the tubes 1042A and 1042B and the bottom wall of the tank 1040, and may result in weight saving. In addition, the tubes 1042A, 1042B may be more easily cleaned when the dirty fluid tank 1040 is removed from the main housing 1020 by running clean water through the tubes 1042A, 1042B. As discussed above, gaskets 1101, 1111, if present, may aid in sealing the tubes 1042A, 1042B when the dirty fluid tank 1040 is mounted to the dirty fluid tank-receiving surface 1025B of the casing 1020B. As the tubes 1042A, 1042B are integrated within the dirty fluid tank 1040, they do not require additional fasteners or mounting hardware that a user may accidentally lose when cleaning or otherwise manipulating the dirty fluid tank 1040.

In the shown case, the first separator tube 1042A may include a check valve 1045 to prevent backflow into the dirty fluid tank inlet tube 1110, such as a duckbill valve. Other backflow-preventing means may be contemplated as well, optionally. In addition, the shown second separator tube 1042B may optionally include a float 1046 fitted about the exterior of the tube 1042B. As the fluid level rises in the dirty fluid tank 1040, the float 1046 rises with it and eventually rises sufficiently to prevent any liquid from entering into the second separator tube 1042B. Optical sensors are another possibility. In the shown case, a pair of removable tube covers 1047' may removably attach to the top ends of each tube 1042A, 1042B, for instance to aid in diverting the flow of liquid and air. In addition, the removable tube cover 1047' at the top of the second separator tube 1042B may engage with the float 1046 to block the flow of liquid through the second separator tube 1042B when the fluid level rises sufficiently. Removal of the removable tube covers 1047', for instance via a twisting or pulling motion, may assist in the cleaning of the tubes 1042A, 1042B.

Referring to FIGS. 13A and 16A-16D, in an exemplary embodiment, suction is created in the dirty fluid tank 1040 by the vacuum assembly 1090 drawing air from the second separator tube 1042B. This flow of air induced by suction passes sequentially from the cleaning head 1050, to the hose 1060, the tubing 1112, the dirty fluid tank inlet tube 1110, the first separator tube 1042A, into the tank 1040, and out via the second separator tube 1042B. As such, cleaning fluid and soiled matter can be suctioned from the surface to be cleaned through the cleaning head 1050 and stored into the dirty fluid tank 1040. As the fluid level in the dirty fluid tank 1040 rises, the rising float 1046 may rise as well to block the liquid from entering into the airstream of the second separator tube 1042B towards the vacuum assembly 1090. In some cases, the float 1046 may block the airstream as well, requiring a user to empty the contents of the dirty fluid tank 1040 before continuing to use the spot cleaner apparatus 1010. The apparatus 1010 may emit an alarm when the pressure at the assembly 1090 is below a given level, as this may indicate that the float 1046 has shut off the air passage. A semi-permeable float that blocks fluids but allows airflow may be contemplated as well.

Referring to FIGS. 16A-16D, a removable dirty tank lid 1040B is illustratively attached to an upper end of the dirty tank body 1040A and is removable to allow access within, for instance to empty the dirty fluid tank 1040 once it fills up with recovered matter or to clean the inside of the dirty fluid tank 1040. The shown dirty tank lid 1040B may be secured to the dirty tank base 1040A via a dirty tank latch 1040D hingedly mounted to the dirty tank base 1040A that latches onto a corresponding ledge or notch 1040E on the dirty tank lid 1040B. In other embodiments, the dirty tank latch 1040D may be positioned on the dirty tank lid 1040B and latch onto a corresponding ledge or notch 1040E on the dirty tank base 1040A. Other fastening means may be contemplated as well, such as clip-based, snap-on or screw-type covering means for dirty tank lid 1040B. In the shown case, a silicone seal or gasket 1040C extends about an upper perimeter of the dirty tank base 1040A to provide a watertight seal when the dirty tank lid 1040B is securely mounted to the dirty tank base 1040A. Other sealing means may be contemplated. In the shown case, the dirty fluid tank 1040 may include a moulded handle 1049 on an upper surface of the dirty fluid tank to facilitate transport of the dirty fluid tank 1040, for instance to empty its contents or clean the dirty fluid tank 1040. Other handles or transport means for the dirty fluid tank 1040 may be contemplated as well.

Figure 15A:
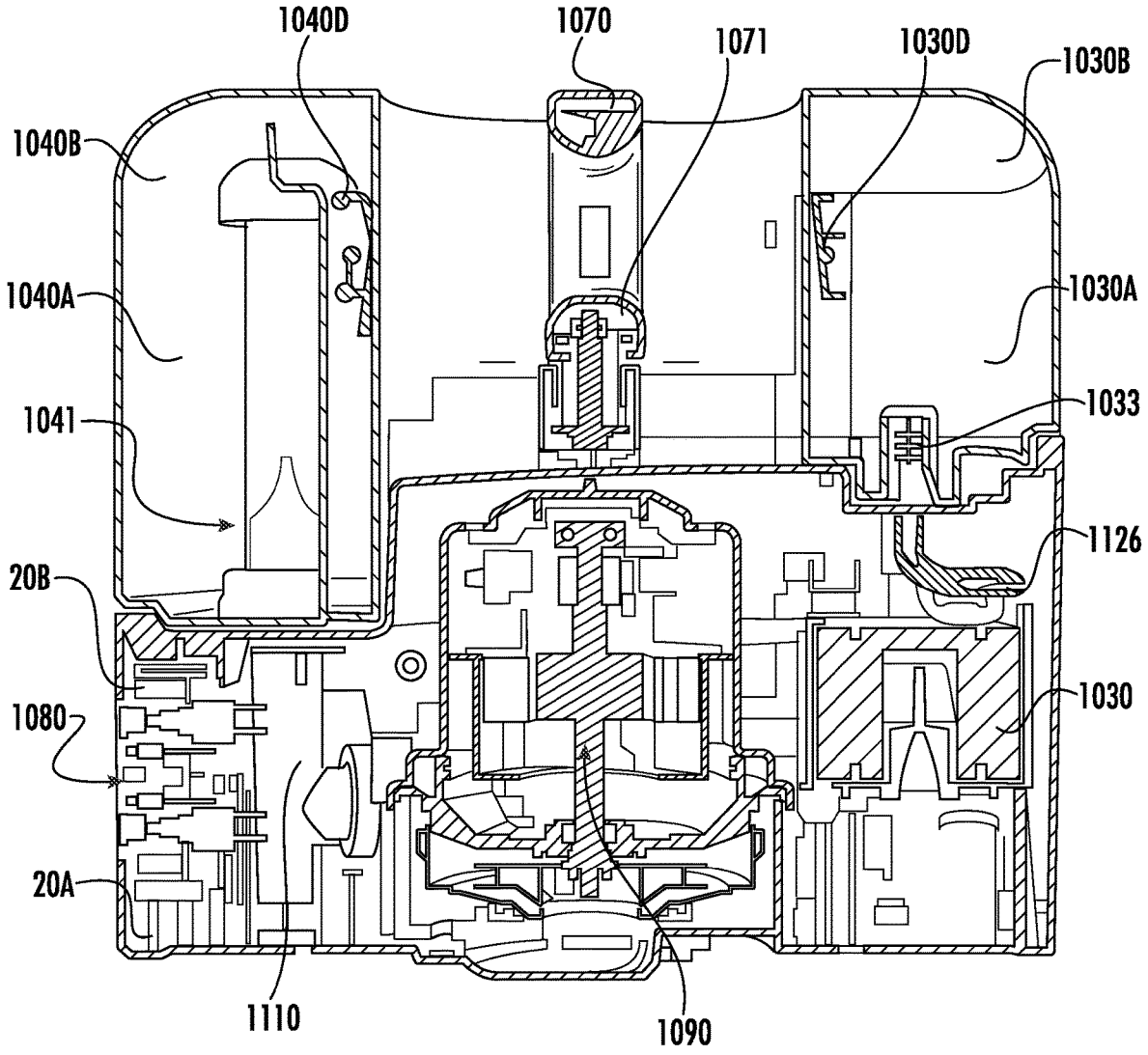
FIGS. 15A-15B are cross-sectional views of the spot cleaner apparatus of FIG. 12 with a handle in respective locked and unlocked positions.
Figure 15B:
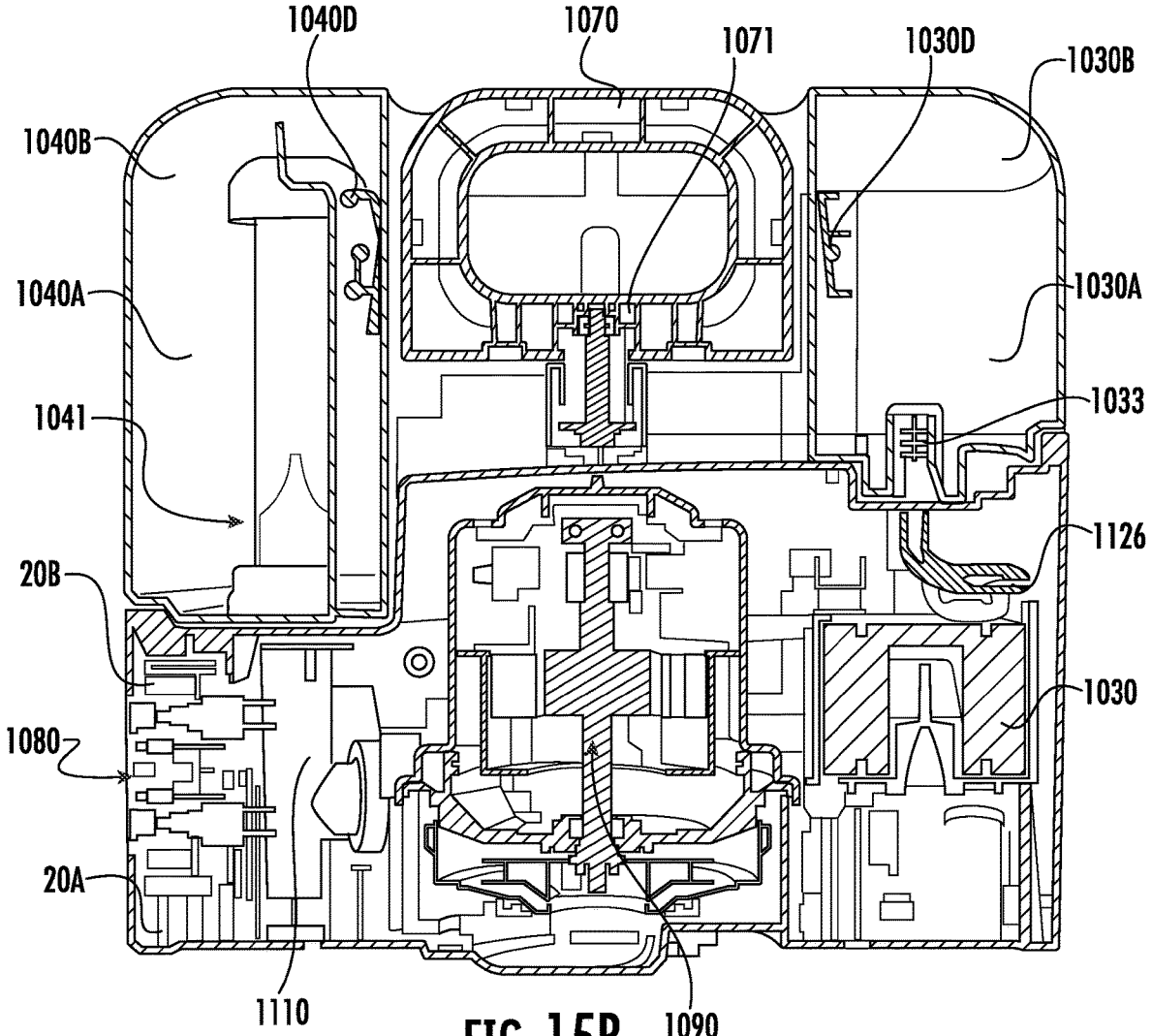
Figure 16A:
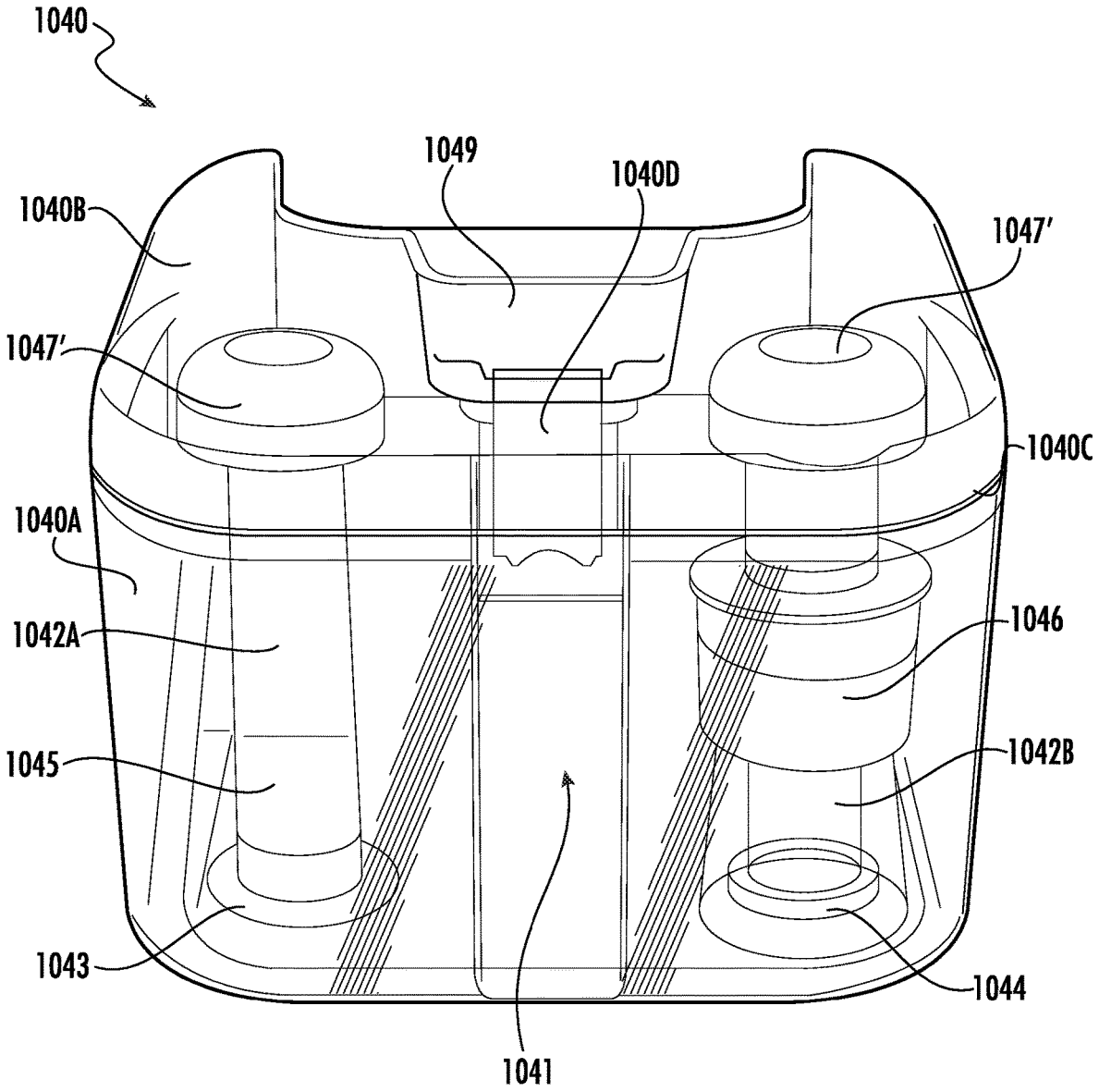
FIGS. 16A-16D are raised rear, cross-sectional, raised perspective, and lowered exploded perspective views, respectively, of a dirty fluid tank for the spot cleaner apparatus of FIG. 12.
Figure 16B:
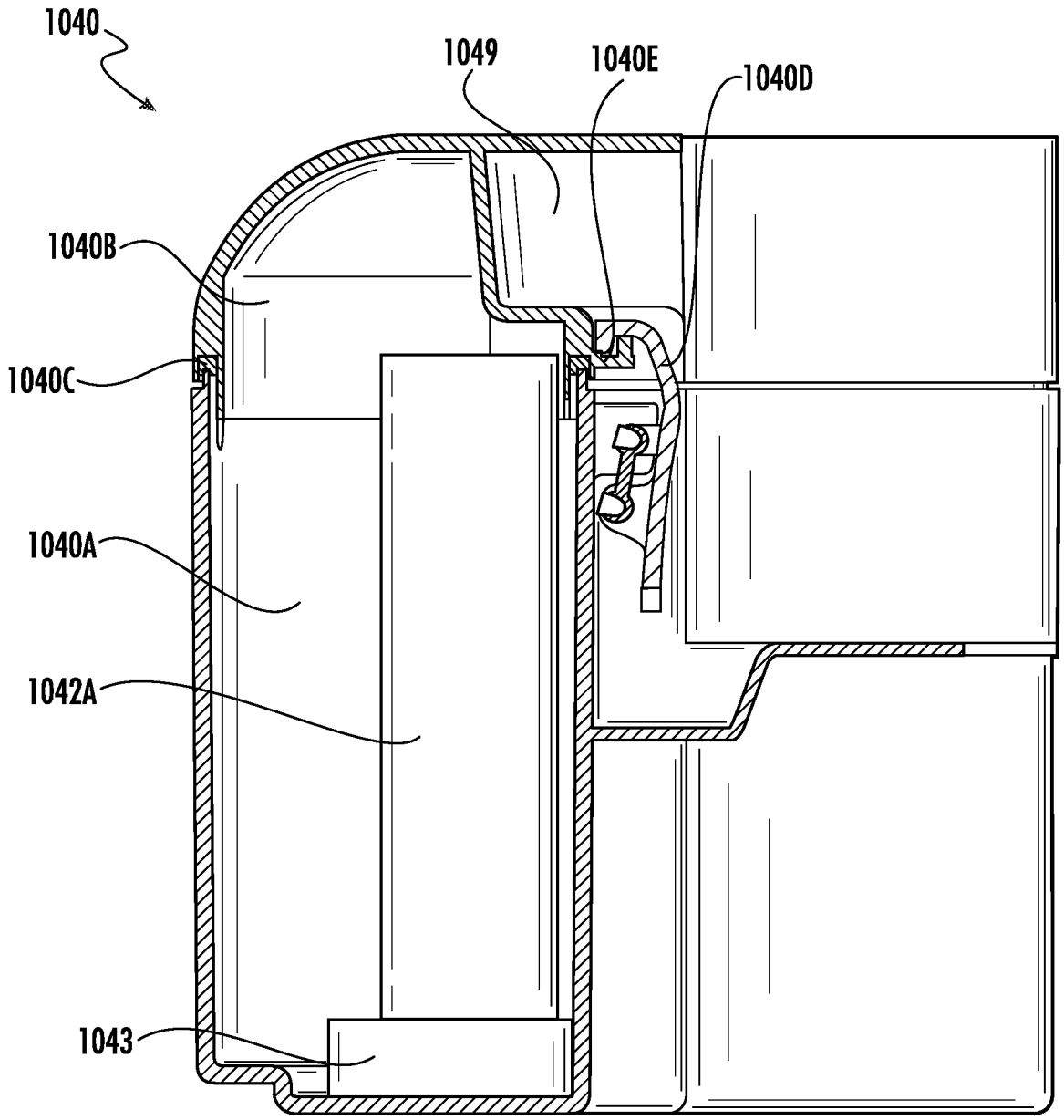
Figure 16C:
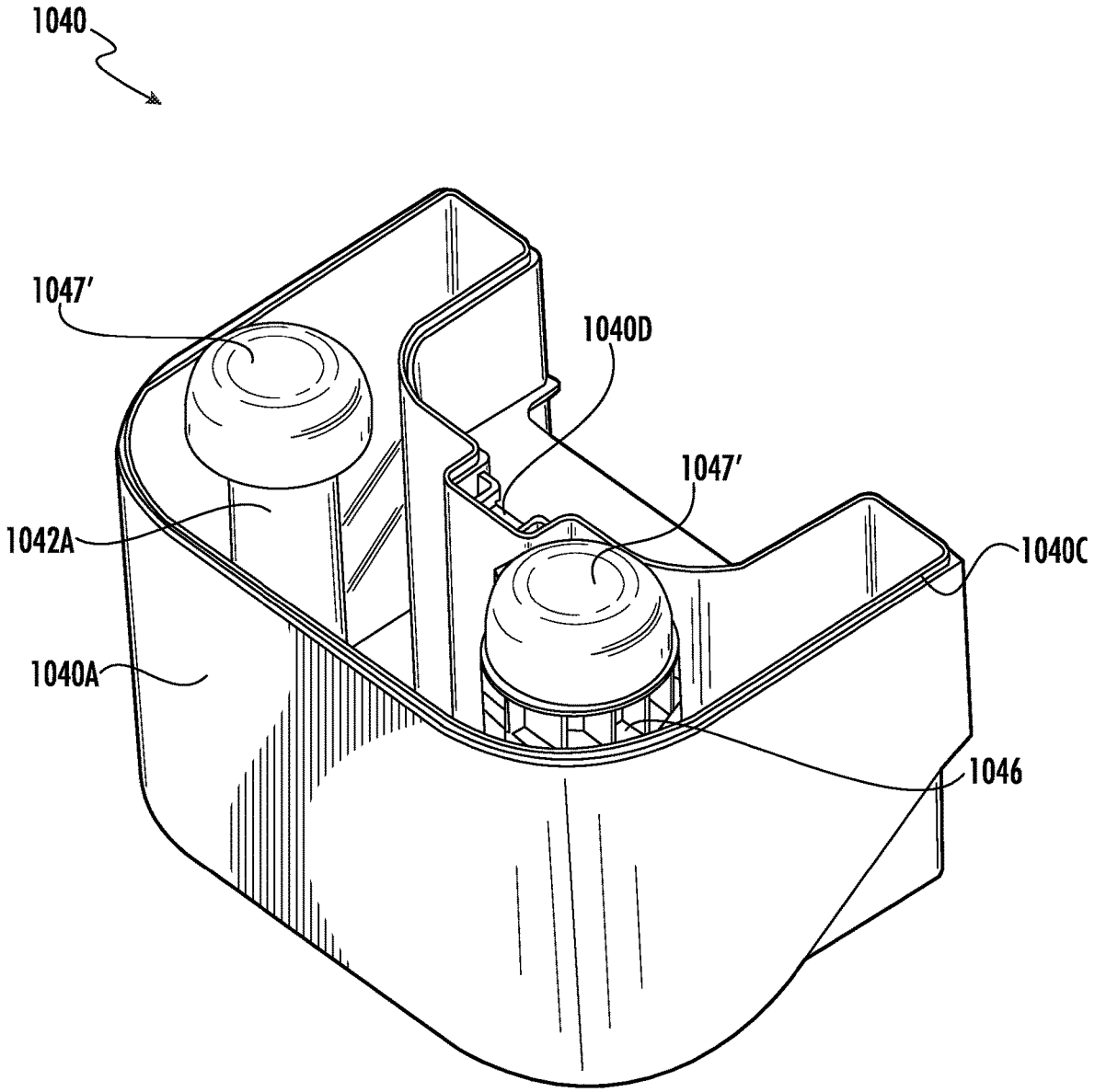
Figure 16D:
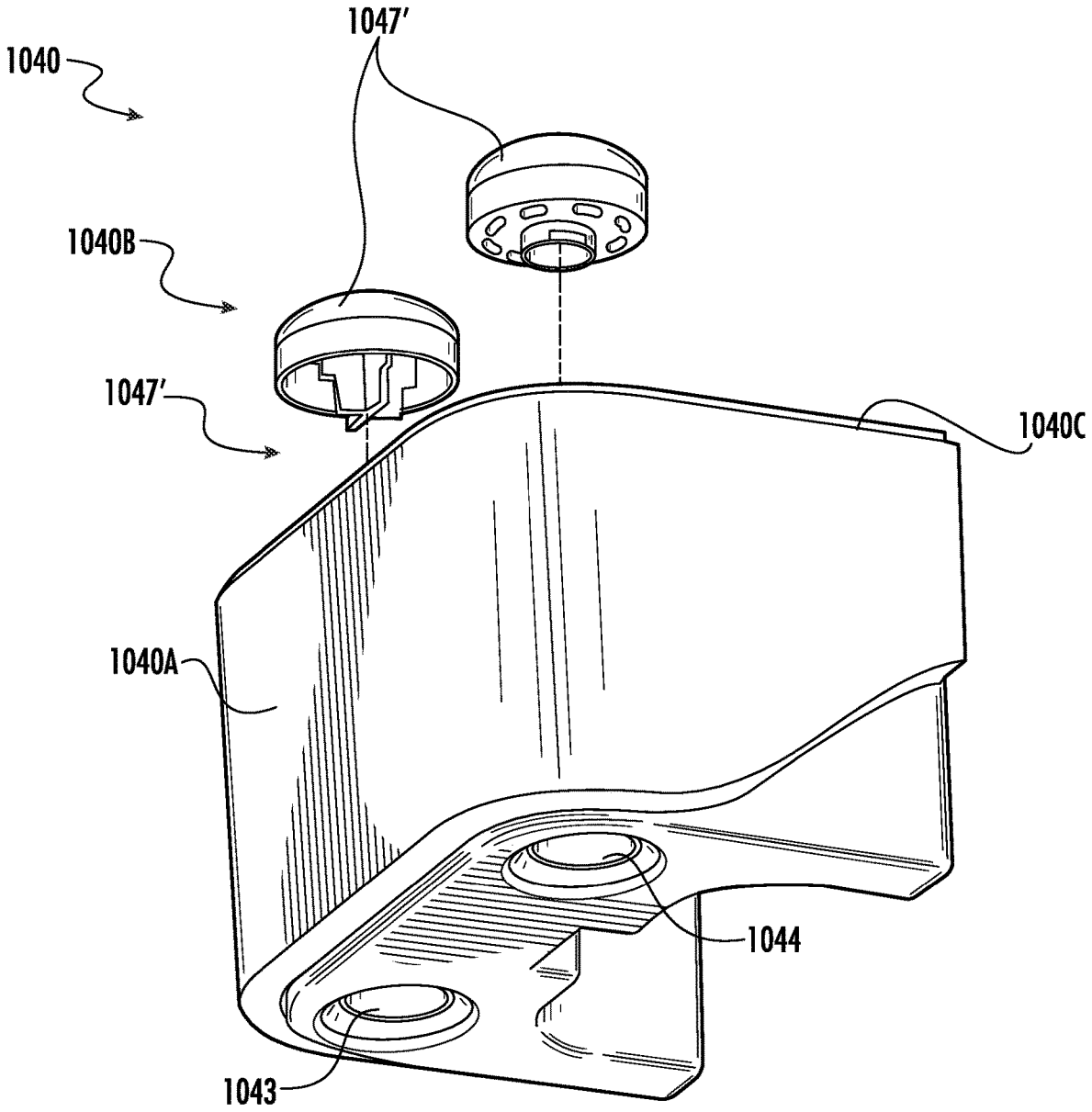

Referring again to FIGS. 14-15B, the handle 1070 attaches to a handle support block 1071 which is mounted to the casing 1020B, for instance via fasteners, tabs, clips or other attachment means. In the shown case, as will be discussed in further detail below, the handle's 1070 attachment to the handle support block 1071 allows the handle 1070 to rotate about a vertical axis while remaining attached to the handle support block 1071. In FIG. 15A, the handle 1070 is oriented in a first or unlocked orientation whereby it does not overlap with the tanks 1030, 1040, (i.e., the tanks 1030, 1040 are not blocked by the handle 1070 in a vertical direction), allowing the dirty fluid tank 1040 to be removed. In FIG. 15B, the handle 1070 is oriented in a second or locked orientation (e.g. 90 degrees from the first orientation), in which locked orientation the handle 1070 overlaps portions of the tanks 1030, 1040. In this orientation, the handle 1070 blocks the removable dirty fluid tank 1040 and, in cases where the clean fluid tank 1030 is removable, the clean fluid tank 1030 in place. The handle 1070 is thus rotatable between the first and second orientations. In some cases, the attachment between the handle 1070 and handle support block 1071 allows the handle to be partially lifted as it rotates, preventing the handle from rubbing against the surfaces of the tanks 1030, 1040. Other handle orientations may be contemplated as well. In the shown case, when assembled to the main housing 1020, the tanks 1030, 1040 are shaped to form a recess or pocket for the handle 1070 to sit within and freely rotate unencumbered, unless the tank 1040 is misinstalled. The handle support block 1071 may act as a partition between the tanks 1030, 1040 when they are mounted to the main housing 1020. In some cases, the positioning of the handle 1070 may be detectable and have an effect on the operability of the spot cleaner apparatus 1010, as will be discussed in further detail below.

Referring to FIGS. 17A-19B, as discussed above, the casing 1020B includes the clean fluid tank-receiving surface 1025A and the dirty fluid tank-receiving surface 1025B. Surface 1025A includes a recess 1026A for receiving the protruding outlet 1033 of the clean fluid tank 1030. Recess 1026A defines a pathway or conduit for the cleaning fluid to travel from the clean fluid tank 1030 to the pump 1121 or heater 1130. The shown casing 1020B includes a handle support attachment 1027 to which the handle support block 1071 attaches. The surface 1025B further includes a cutout 1028A for the dirty fluid tank inlet tube 1110 to protrude through and a cutout 1028B for the dirty fluid tank outlet tube 1100 to protrude through. The casing 1020B may further include a cutout 1028C on a front surface thereof for the control panel 1080 and cutouts 1028D on sides thereof to accommodate the attachment of clips 1021 for the cleaning head 1050 or hose 1060. Other arrangements may be contemplated as well.

The shown clean fluid tank 1030 may include a rear locking rib 1034A (FIG. 17A) on an undersurface thereof adjacent the outlet 1033, and a pair of front locking rib 1034B (FIG. 17B) along a front lower edge thereof to enable the non-removable attachment of the clean fluid tank 1030 to the casing 1020B. Upon installation of the clean fluid tank 1030 to the clean fluid tank-receiving surface 1025A, the rear locking rib 1034A engages with a corresponding recess 1029 in the clean fluid tank-receiving surface 1025A, illustratively within recess 1026A. The front locking ribs 1034B engages with corresponding recesses (not shown) in a lower edge of the handle support block 1071. Other locations for these recesses may be contemplated, for instance in the clean fluid tank-receiving surface 1025A. In an embodiment, the clean fluid tank 1030 is first installed on the clean fluid tank-receiving surface 1025A with the rear locking rib 1034A engaging with the recess 1029. Then, the handle support block 1071 is installed onto the casing 1020B with the front locking ribs 1034B engaging with corresponding recesses in the handle support block 1071. In addition, the clean fluid tank 1030 illustratively includes a pair of support posts 1036 extending downwardly from a lower surface thereof that are receivable in corresponding cutouts or recesses 1029A in the clean fluid tank-receiving surface 1025A, thus providing additional stability once the clean fluid tank 1030 is installed. Similarly, the clean fluid tank-receiving surface 1025A may include additional cutouts or recesses 1029B configured to receive support posts 1074 extending from an underside of the handle support block 1071. In such an arrangement, the clean fluid tank 1030 is non-removably installed to the casing 1020B, as the engagement between respective locking ribs 1034A, 1034B and corresponding recesses, as well as the positioning of outlet 1033 within recess 1026A, prevent movement of the clean fluid tank 1030 relative to the casing 1020B in all directions. In addition, upper sidewall or skirt 20B1 of the casing 1020B, as well as additional walls 1020B2 on the clean fluid tank-receiving surface 1025A may aid in positioning and preventing movement of the clean fluid tank 1030 relative to the casing 1020B. Other fastening means to non-removably attach the clean fluid tank 1030 to the casing 1020B may be contemplated as well, such as hidden fasteners or rivets. The shown handle support block 1071 includes a handle attachment cavity 1073 on an upper surface therefore for attaching the handle 1070 in a rotatable fashion, as discussed above. Other handle fastening means may be contemplated as well. In an embodiment, the clean fluid tank 1030 could be removed, but in a manner that involves tools and/or a specific procedure.

Figure 17A:
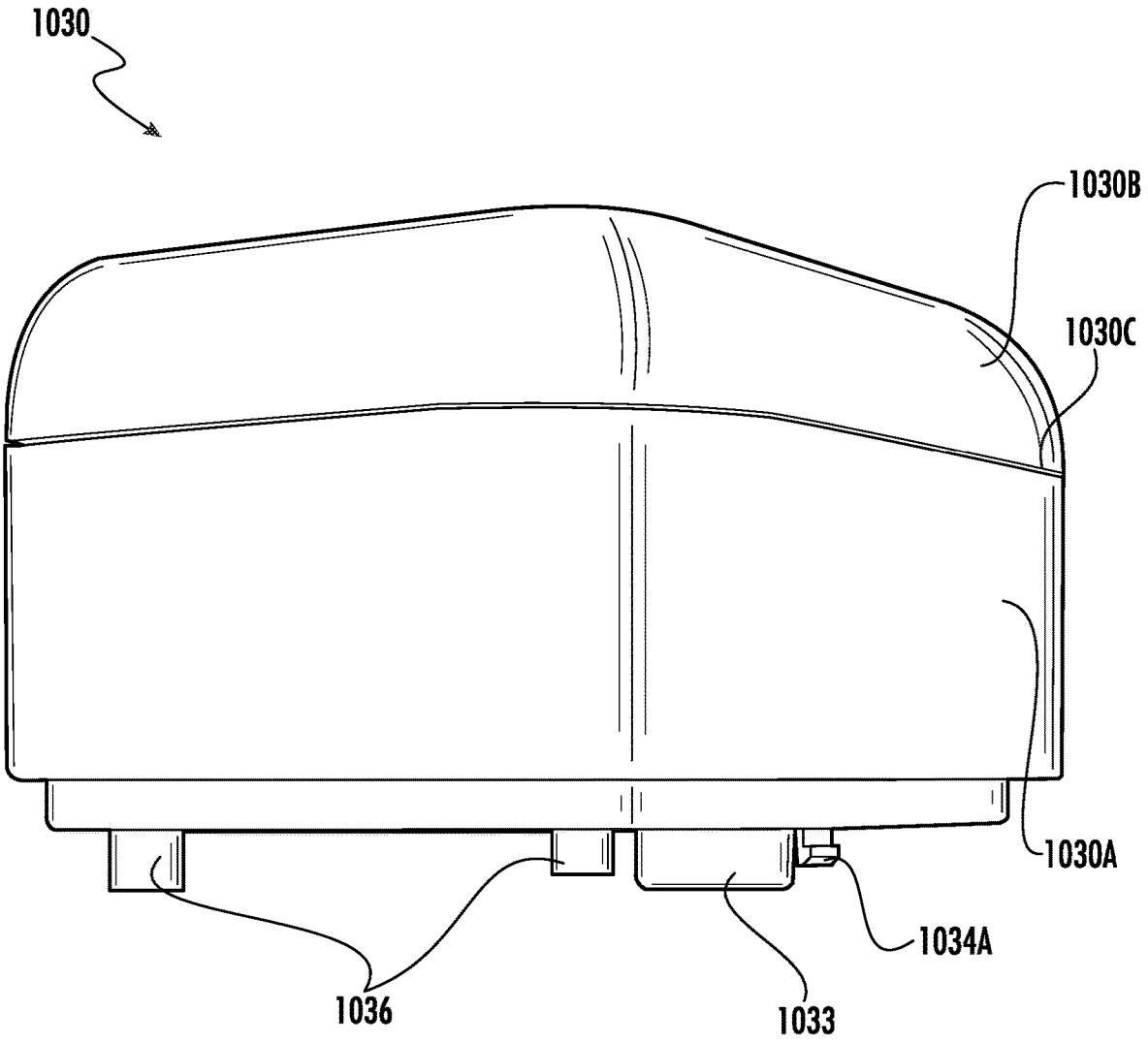
FIGS. 17A-17B are rear perspective and front perspective views, respectively, of a clean fluid tank for the spot cleaner apparatus of FIG. 12.
Figure 17B:
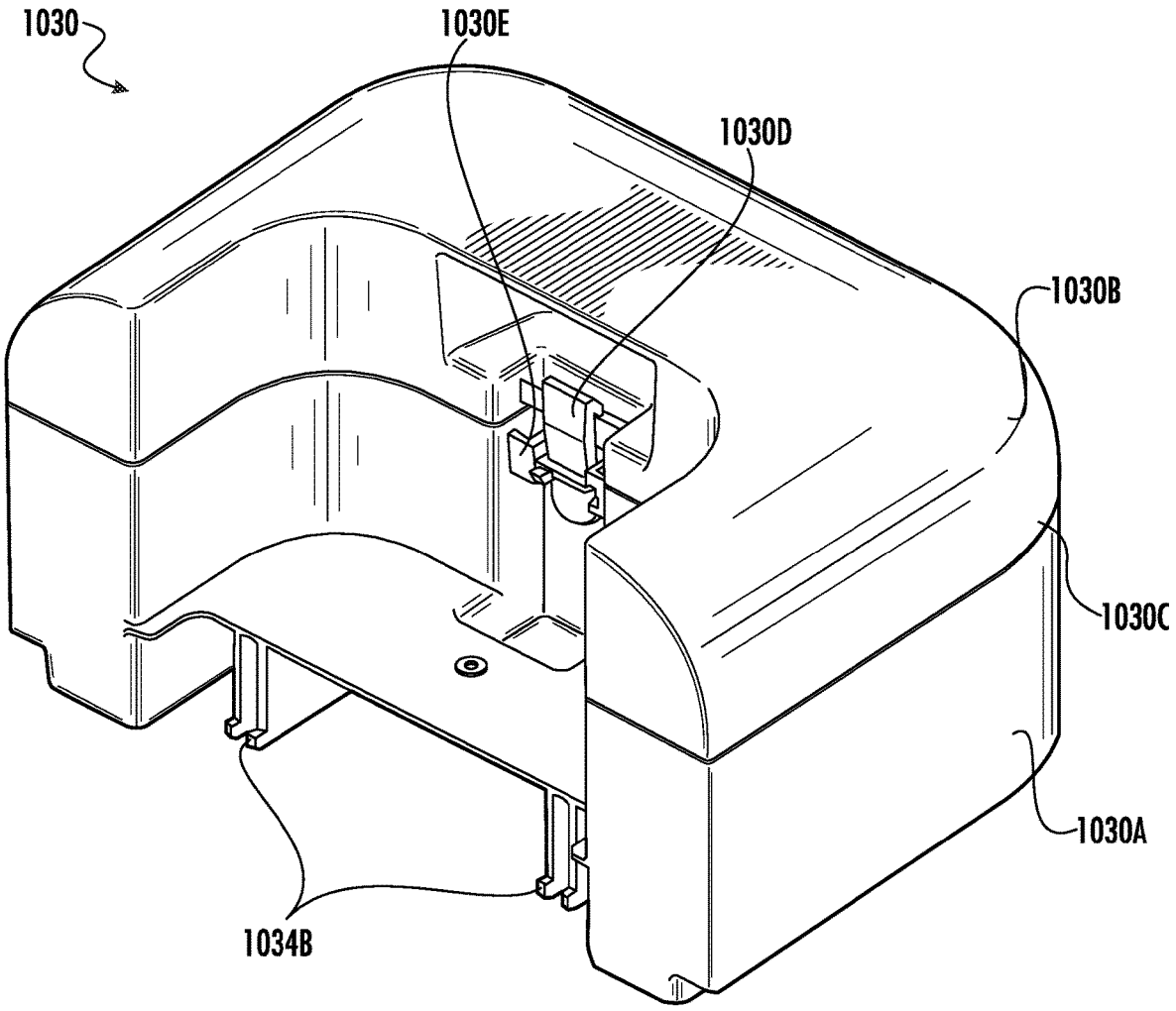
Figure 17C:
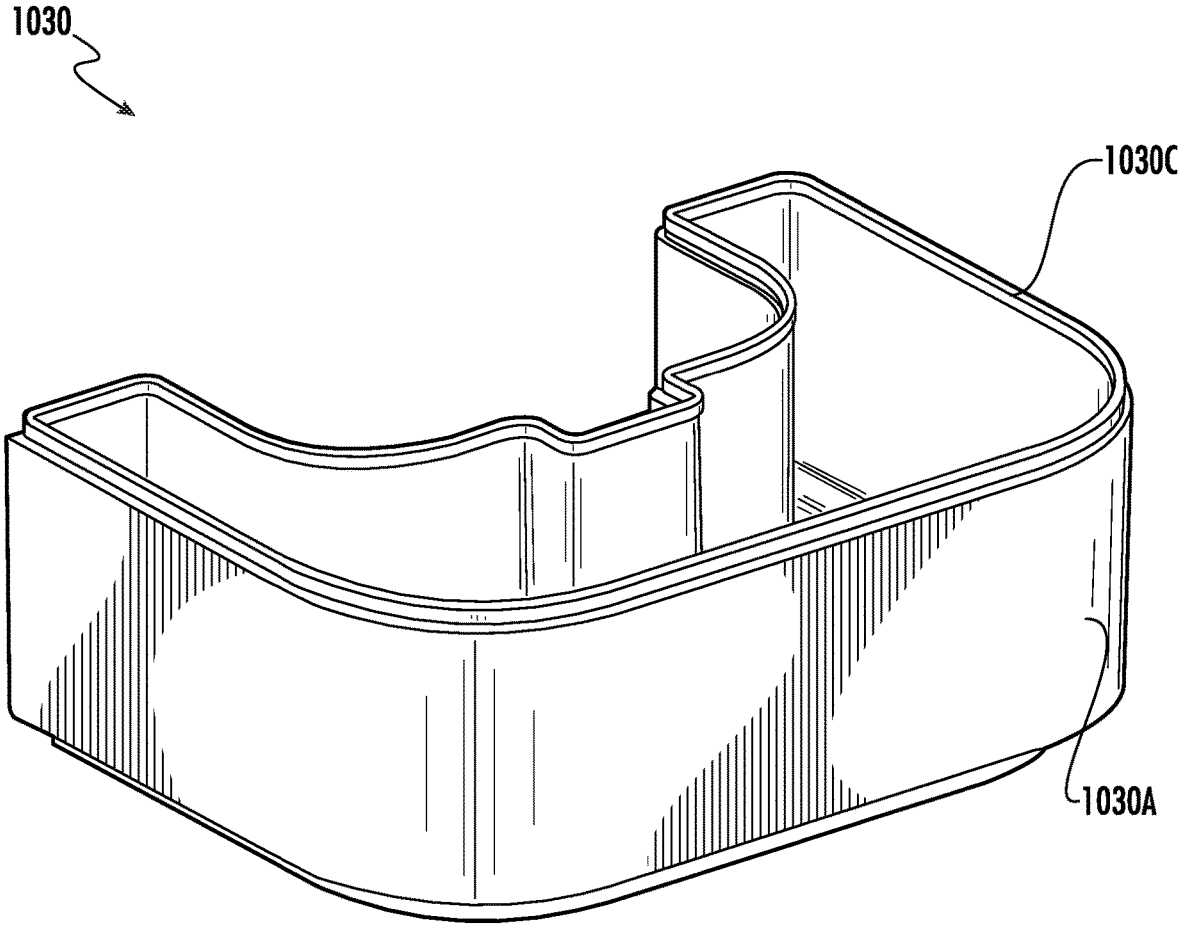
FIG. 17C is a rear perspective view of a clean fluid tank base for the clean fluid tank of FIGS. 17A-17B.
Figure 18:
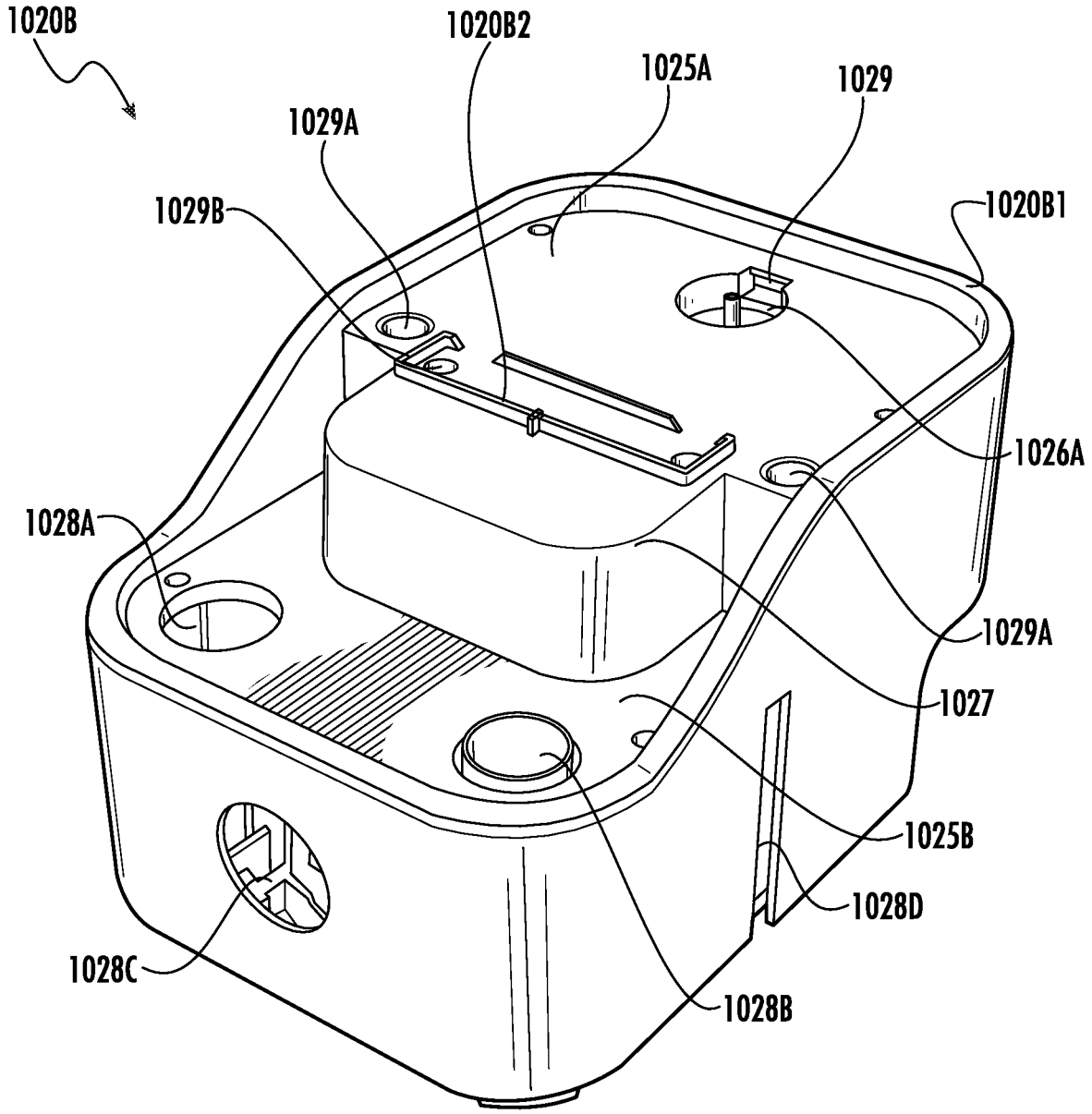
FIG. 18 is a perspective view of a casing for the spot cleaner apparatus of FIG. 12.
Figure 19A:
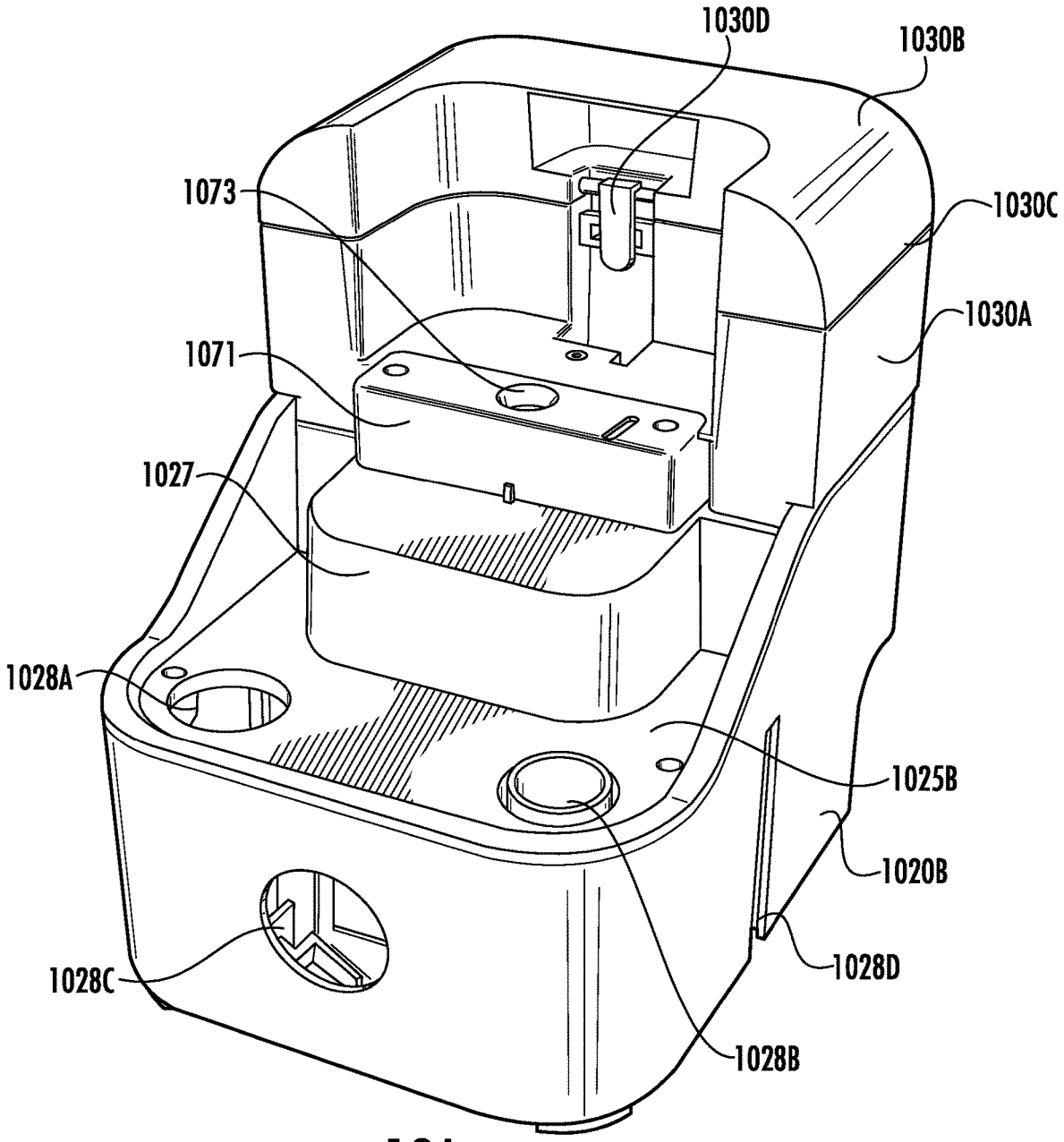
FIGS. 19A-19B are perspective and cross-sectional views of the clean fluid tank of FIG. 17 secured to the casing of FIG. 18.
Figure 19B:
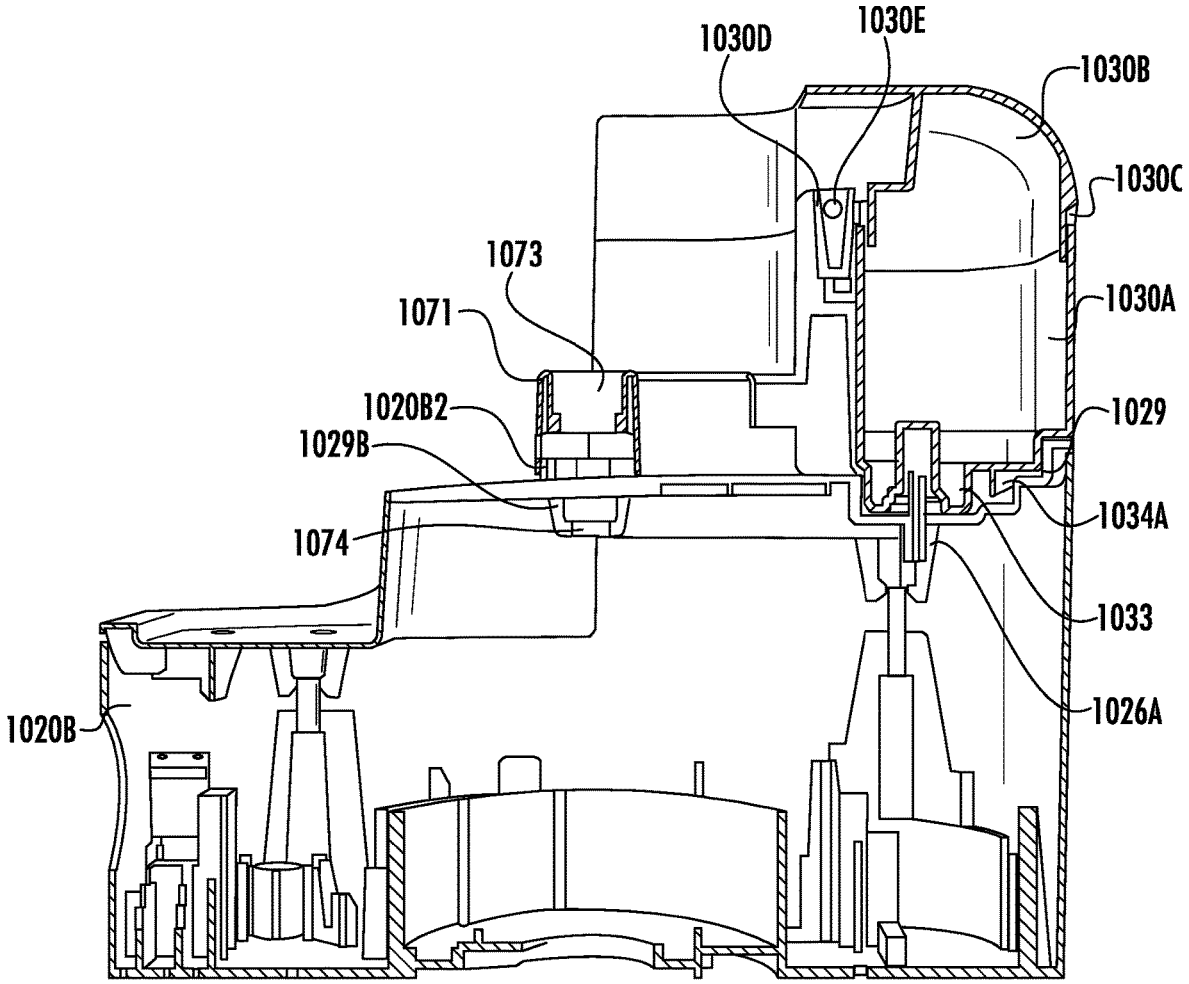

Referring to FIGS. 17A-170, as discussed above, a removable clean tank lid 1030B is illustratively attached to the clean tank body 1030A and is removable to allow access within, for instance to fill or empty the clean fluid tank 1030, or to clean the inside of the clean fluid tank 1030. As the shown clean fluid tank 1030 is non-removably attached to the casing, removal of the clean tank lid 1030B may facilitate access to the inside of the clean fluid tank 1030. The shown clean tank lid 1030B may be secured to the clean tank base 1030A via a clean tank clip 1030D hingedly mounted to the clean tank lid 1030B that latches onto a corresponding ledge or notch 1030E on the clean tank base 1030A. In other embodiments, the clean tank clip 1030D may be positioned on the clean tank base 1030A and clip onto a corresponding ledge or notch 1030E on the clean tank lid 1030B. Other fastening means may be contemplated as well, such as latching, snap-on or screw-type covering means for clean tank lid 1030B. In the shown case, a silicone seal or gasket 1030C extends about an upper perimeter of the clean tank base 1030A to provide a watertight seal when the clean tank lid 1030B is securely mounted to the clean tank base 1030A. Other sealing means may be contemplated.

Figure 20A:
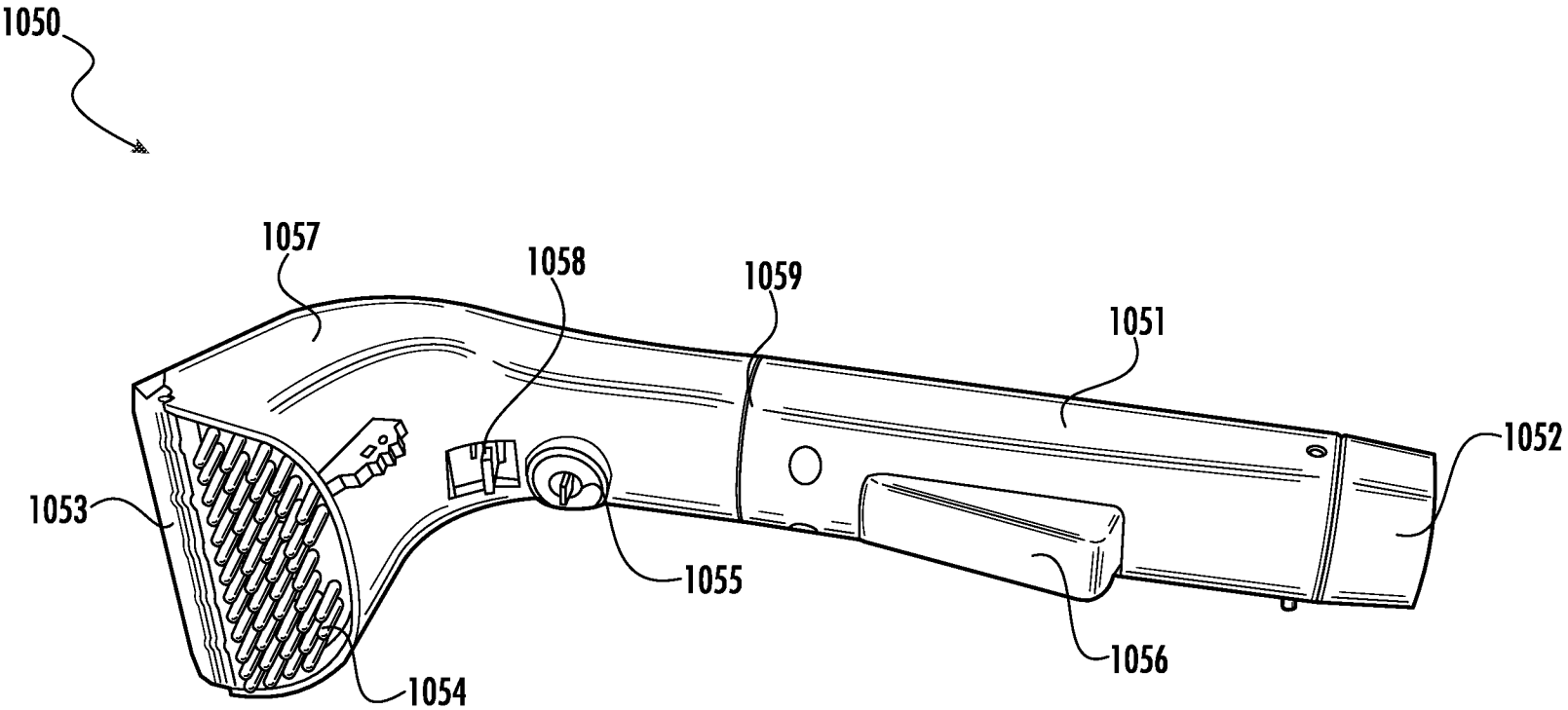
FIGS. 20A-20B are perspective views of two exemplary cleaning heads for the spot cleaner apparatus of FIG. 12.

Referring to FIG. 20A, an exemplary cleaning head 1050, also referred to as a fluid distributor or a fluid distribution and recovery device, is shown. As discussed above, the cleaning head 1050 is fluidly coupled to the main housing via the hose 1060, or via another fluid conduit. The hose 1060, also referred to as a fluid and vacuum supply conduit, supplies both suction and cleaning fluid, for instance via internal conduit 1133, to the cleaning head 1050 so that a user may clean a surface with the cleaning head 1050. The dual operation can be done via dedicated conduits, as described above. The shown cleaning head 1050 includes a handle 1051 for the user to hold and a hose attachment 1052 for attaching the hose 1060. The hose attachment 1052 may include partitioning to separate the fluid to be output via the cleaning head 1050, and airflow of the suction into the cleaning head 1050. The cleaning head 1050 includes one or more vacuum inlets 1053 at a distal end thereof for recovering cleaning fluid and soiled matter from the surface being cleaned. The shown cleaning head 1050 includes a plurality of side-by-side inlets 1053, although other arrangements and patterns may be contemplated as well, for instance different rows of inlets 1053. In the shown case, the inlets 1053 are disposed adjacent a plurality of brushes or bristles 1054 for agitating or loosing the surface to be cleaned. In other cases, the cleaning head 1050 may not include such brushes or bristles. In an embodiment, the bristles 1054 are made of a polymer, such as silicone. Other means for loosing the soiled matter or otherwise generating friction may be contemplated as well. The shown handle 1051 curves towards the inlets 1053 and brushes 1054, although other configurations may be contemplated as well.

The cleaning head 1050 further includes an orifice 1055 for dispersing the cleaning fluid, for instance received via conduit 1133, towards the surface to be cleaned to aid in loosing the soiled matter to be recovered by the vacuum inlets 1053. The direction at which the fluid exits the orifice 1055 may vary, for instance parallel to direction of the airflow entering the inlets 1053. In the shown case, the fluid is nebulized as it exits the orifice 1055 due to the size of the orifice 1055, the temperature of the fluid due to the heater 1130, and the pressure of the fluid due to the pump 1121. By nebulized, it is intended that the cleaning fluid exits the orifice 1055 appearing like a mixture of liquid and mist in a spray bottle-like fashion. In some embodiments, orifice 1055 may thus be referred to as a fluid nebulizer. Other fluid exit means may be contemplated as well. By nebulizing the heated cleaning fluid upon delivery, the cleaning head 1050 may disperse the cleaning fluid in a mist-like fashion. As such, the cleaning fluid may be well distributed across the surface to be cleaned without needing to heat the cleaning fluid to its boiling point to achieve steam, and thus with less energy consumption than boiler systems. In another embodiment, the fluid is vaporized. In various cases, steam may be produced by heating the cleaning fluid below or above its boiling point. In cases where the optional heater 1130 is not present, the cleaning head 1050 may still distribute the cleaning fluid in a mist-like form due to the pressure from the pump 1121 and the nebulized effect from the orifice 1055. In other cases, the orifice 1055 may be shaped to distribute the cleaning fluid in a jet or fan-like stream.

The shown cleaning head 1050 further includes a trigger 1056. In some cases, squeezing the trigger 1056 may interrupt a continuous flow of cleaning fluid to the orifice 1055. In other cases, squeezing the trigger 1056 may induce the flow of cleaning fluid to the orifice 1055. In other cases, squeezing the trigger 1056 may induce or cut off the flow of suction from the cleaning head 1050. For instance, in some cases a user may wish to saturate a stained surface with cleaning fluid, interrupt suction for a given amount of time to allow the fluid to permeate into the stained surface, and the reengage the suction flow to draw in the soiled matter and the cleaning fluid. Other modes of operation may be contemplated as well. In an embodiment, the use of the trigger 1056 causes a simultaneous and concurrent jetting of cleaning fluid and vacuuming of the cleaning fluid with soiled matter, to limit dampening of the surface being cleaned.

Figure 20B:
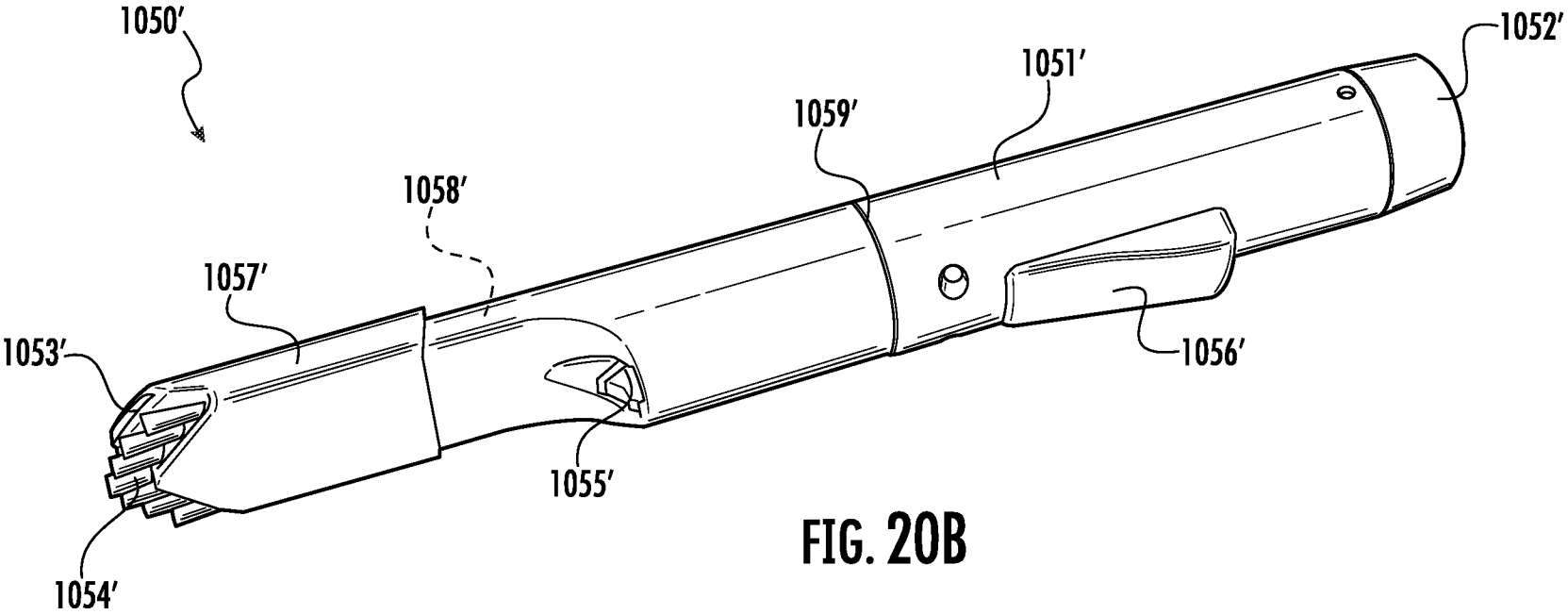

Referring to FIG. 20B, another embodiment of a cleaning head 1050' is shown. In the shown case, the handle 1051' extends axially towards a single inlet 1053' and two surrounding rows of brushes 1054'. While FIG. 20B shows cleaning head 1050' to have a single inlet 1053', other numbers of inlets may be contemplated as well. The shown orifice 1055' directs the cleaning fluid axially, although other directions may be contemplated as well.

The end pieces 1057, 1057' of cleaning heads 1050, 1050' may be removable and interchangeable. For instance, end piece 1057, on which inlets 1053 and brushes 1054 are disposed, may be removed from handle 1051 and replaced with end piece 1057' on which which the inlet 1053' and brushes 1054' are disposed (or vice-versa). A clip 1058, 1058' may be provided on each respective end piece 1057, 1057' to attach or detach the removable end piece 1057, 1057', although other attachment means may be contemplated as well. End pieces 1057, 1057', may attach to respective handles 1051, 1051' at respective attachment points 1059, 1059' through various means.

Referring to FIGS. 13A-14, the control panel 1080 is present on an exterior surface of the main housing 1020 for controlling the operations of the spot cleaner apparatus 1010. In the shown embodiment, although not necessarily the case in all embodiments, the control panel 1080 includes a power button 1081, a fluid temperature button 1082 and plurality of lights 1083. Other buttons or status indicators may be contemplated as well. In some cases, the control panel 1080 may include a graphical user interface.

In the shown embodiment, the control panel 1080 is mounted to and operatively connected to an integrated printed circuit board (PCB) 1084 housed within the casing 1020B for controlling the operations and functions of the spot cleaner apparatus 1010, and actuatable components thereof. The control panel 1080 and integrated PCB 1084 may be formed as a single unit that extend through the control panel cutout 1028C. The power button 1081 may be used to turn the spot cleaner apparatus 1010 on or off, for instance by activating or deactivating the vacuum assembly 1090. In some cases, the power button 1081 may be used to cycle through different vacuum speeds, while in other cases an additional dedicated button may be provided for this. The temperature control button 1082 may be used to cycle through different temperature setting for the heater 1130 and/or to turn off the heater 1130. Additional controls may be provided to control the flow of cleaning fluid provided by the pump 1121. As discussed above, a user may alternatively or concurrently control the flow of suction or cleaning fluid via the trigger 1056 on the cleaning head 1050. Other control means may be contemplated as well.

In an embodiment, the interior of the clean fluid tank 1030 may have internal partitioning (not shown) and may be configured to separately contain a cleaning fluid and water. In such an embodiment, various combinations of the control panel 1080, PCB 1084, trigger 1056, and a selection means (not shown) at the outlet 1033 of the clean fluid tank 1030, for instance, may work in concert to selectively deliver either cleaning fluid only, water only, or a mixture of cleaning fluid and water from the clean fluid tank 1030 to a surface to be cleaned via the cleaning head 1050. Such selection means may be further controllable via the control panel 1080, PCB 1084 and/or the trigger 1056 to vary the ratio between cleaning fluid and water exiting the clean fluid tank 1030 via outlet 1033.

In an embodiment, the temperature of the cleaning fluid may be inversely controlled via the selected flow rate of the cleaning fluid. For instance, in the shown case, by decreasing the flow rate of the cleaning fluid, the cleaning fluid would flow at a lower rate through the in-line fluid heater 1130 (FIGS. 13A-13C), allowing the heater 1130 to heat the cleaning fluid to a higher temperature. As such, the temperature control button 1082 on the control panel 1080 may, through the integrated PCB 1084, inversely control the flow rate of the cleaning fluid via the pump assembly 1120. In other cases, adjusting the temperature control button 1082 may cause the integrated PCB 1084 to increase or decrease the wattage delivered to the heater 1130 to directly either increase or decrease the heat delivered to the cleaning fluid. Other means for controlling the optional heater 1130 may be contemplated as well.

Various means for controlling the flow rate of the cleaning fluid delivered to the cleaning head 1050 via the pump assembly 1120 may be contemplated. In the shown case, a button on the control panel 1080, for instance the temperature control button 1082 or a dedicated flow rate button (not shown), may be connected to the integrated PCB 1084, which may control the operations of the pump assembly 1120. In other cases, the integrated PCB 1084 may be omitted and the flow rate of the cleaning fluid may be controlled via alternate means. For instance, as the spot cleaner apparatus 10 is turned on, full power may be delivered to the pump assembly 120 by default. A user may subsequently reduce the power to reduce the flow rate, and consequently increase the fluid temperature in cases where the optional heater 1130 is present. Power may be reduced, for instance, via a control knob that may act as a voltage selector or dimmer switch for the power delivered to the pump assembly. Alternatively, a physical restrictor may be provided within one of the tubes or conduits to selectively reduce the flow rate of the cleaning fluid. Similarly, a device may be used to externally squeeze or kink one of the tubes or conduits to selectively reduce the flow rate of the cleaning fluid. Other means for controlling the flow rate of the cleaning fluid may be contemplated as well.

The lights 1083 may indicate various statuses of the spot cleaner apparatus 1010, for instance: an on/off state, a vacuum assembly 1090 setting, a heater 1130 temperature setting, a pump 1121 pressure setting, and/or a heater 1130 on/off state. Other status indications may be contemplated as well. In other cases, other visual or auditory status indicators may be provided. Other modes of operation may be contemplated as well. For instance, the control panel 1080 may allow for independent control of the various fluid delivery equipment, such as the pump 1121 and heater 1130, from the various fluid recovery equipment, such as the vacuum assembly 1090. As such, in a sequential mode of operation, a user may first engage the pump 1121 and heater 1130 to deliver cleaning fluid to a soiled or stained surface. Then, after waiting an appropriate amount of time for the cleaning fluid to penetrate the surface and loosen the dirt, debris or other soiled matter, the user may disengage the fluid delivery equipment and engage the vacuum assembly 1090 to recover the liquid, dirt and other debris. The power button 1081 may permit a user to cycle between such a sequential mode of operation and a mode of operation whereby the fluid delivery and recovery equipment are engaged simultaneously. In an embodiment, the control panel 1080 is controlled in IoT mode, for instance using WIFI®, Bluetooth®, or other telecommunications protocol.

In the shown case, the dirty fluid tank 1040 is greater in volume than the clean fluid tank 1030. The shown dirty fluid tank 1040 is approximately one and a half times greater in volume than the shown clean fluid tank 1030, although other size differences may be contemplated as well. The dirty fluid tank 1040 may be sized greater, for instance, to account for the additional matter (i.e. dirt and other soiled matter) from the surface being cleaned in addition to the recovered cleaning fluid, or in the event that external liquid is vacuumed by the apparatus 10. As can be seen in FIGS. 15A-15B, the height of the dirty fluid tank 1040 is greater than the height of the clean fluid tank 1030. As such, as the recovered cleaning fluid accumulates in the dirty fluid tank 1040, the rising fluid is less likely to reach the top of the second separator tube 1042B, requiring the float 1046 to seal the tube 1042B. Other tank size considerations may be contemplated as well.

The spot cleaner apparatus 1010 may include a controller integrated with the integrated PCB 1084 which is in charge of the operation of the spot cleaner apparatus 1010. The controller may be a processing unit, and may have a non-transitory computer-readable memory communicatively coupled to the processing unit and comprising computer-readable program instructions executable by the processing unit for operating the spot cleaner apparatus 1010. The controller is powered, for instance, by being connected to the grid by a power cord 1160 (FIG. 21), or by connection to a battery. The controller may be wired via the integrated PCB 1084 to the various powered components of the spot cleaner apparatus 1010, such as the vacuum assembly 1090, pump 1121 and heater 1130. Moreover, the controller may include various other sensors, such as temperature sensors (e.g., thermocouple) and water level sensors. In some cases, the controller may connect to a position sensor operable to detect the rotational positioning of the handle 1070. In such cases, the controller may only allow the spot cleaner apparatus 1010 to operate when the handle 1070 is in a given position, for instance the "locked" position shown in FIG. 15B. The controller may be controlled via a user interface, for instance the control panel 1080.

Figure 21:
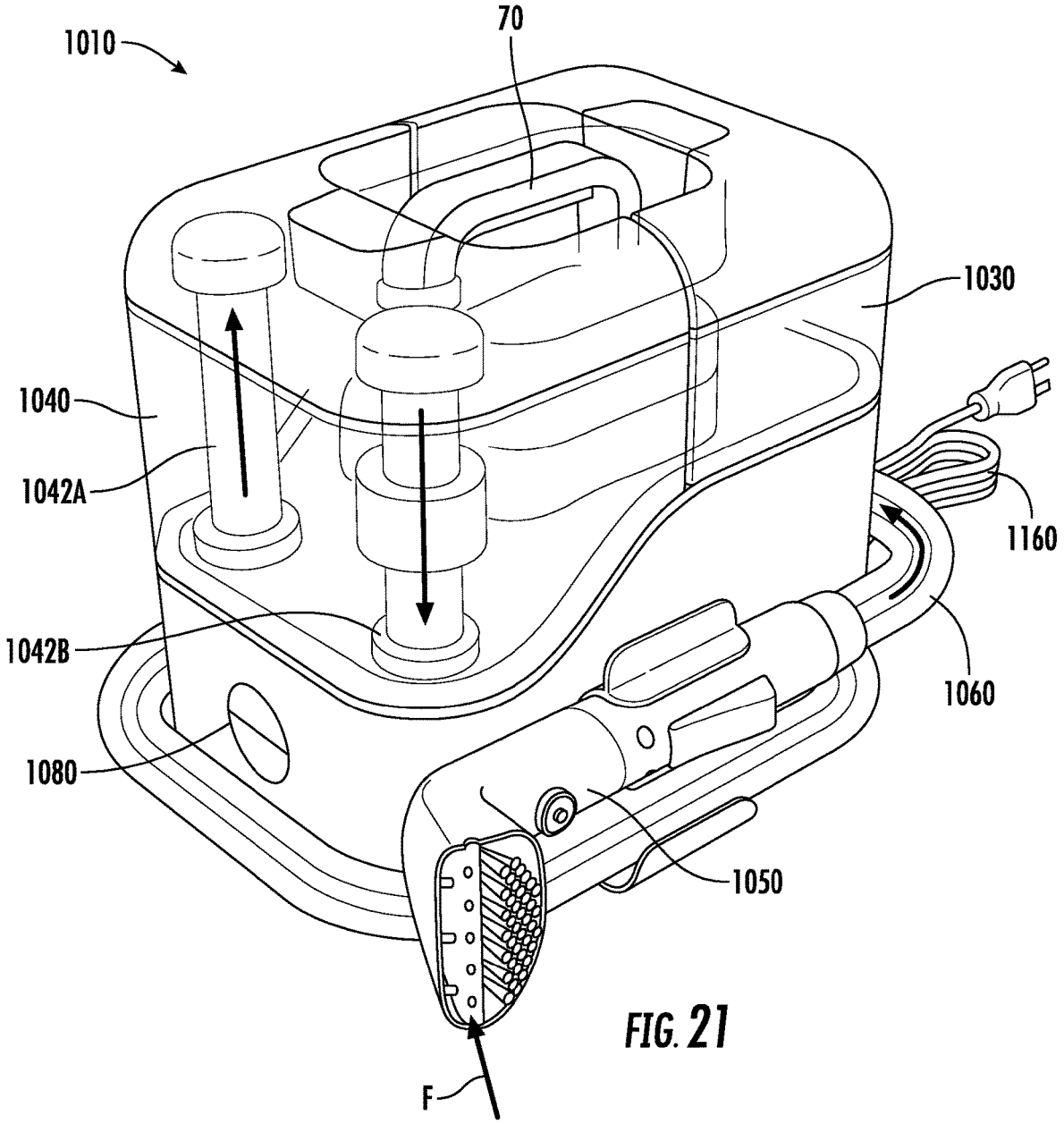
FIG. 21 a perspective view showing an exemplary mode of operation of the spot cleaner apparatus of FIG. 12.

Referring to FIGS. 21-22, the spot cleaner apparatus 1010 may provide a simple solution for cleaning various soiled surfaces such as stains on carpets or upholstery. In an exemplary embodiment, when power is provided to the pump 1121, for instance by the spot cleaner apparatus 1010 being connected to the grid by a power cord 1160, the pump 1121 takes cleaning fluid from the clean fluid tank 1030 and pumps it through the heater 1130 which heats the cleaning fluid to a temperature below boiling. The fluid may pass through the heater 1130 without being heated. The cleaning fluid then passes through conduit 1133 nested within hose 1060 and exits the cleaning head 1050 through a small orifice 1055 to nebulize the cleaning fluid, making it look like mist or steam. This cleaning fluid may soak the carpet or other surface to remove the stain before the vacuum assembly 1090 sucks or draws in the mixture of fluid, dirt, debris and/or other soiled matter.

Simultaneously or subsequently, when power is provided to the motor 1091, the fan 1092 generates a vacuum airflow, denoted as F in FIGS. 21-22. The vacuum airflow F passes through the vacuum inlet(s) 1053 in the cleaning head 1050, through the hose 1060, into the main housing 1020 and into the dirty fluid tank 1040 via tubing 1112 and the dirty fluid tank inlet tube 1110. The integrated liquid/air separator 1041 within the dirty fluid tank 1040 then separates the vacuum airflow F from the cleaning fluid and recovered soiled matter before the vacuum airflow F arrives at the vacuum assembly 1090. The vacuum airflow F is then exhausted through the vacuum exhaust 1093 on the underside of the base 1020A. The clean fluid tank 1030, pump assembly 1120, heater 1130, conduit 1133 passing through hose 1060, and cleaning head 1050 may thus form a fluid delivery system. Similarly, the cleaning head 1050, hose 1060, dirty fluid tank 1040, and vacuum assembly 1090 may form a fluid recovery system. Other modes of operation may be contemplated as well.

As previously discussed, various embodiments of a spot cleaner apparatus 10, 1010 according to the present disclosure may be said to be portable as it may be easily transportable from one location to another, for instance by grabbing the handle 70, 1070. The spot cleaner apparatus 10, 1010 may be suitably dimensioned for such transportability. In an exemplary embodiment, the spot cleaner apparatus 10, 1010 may have a length of about 11.5-12.5 inches, a width of about 8-9 inches, and a height of about 11-12 inches. The overall volume of the spot cleaner apparatus 10, 1010 may thus be about 0.6-0.8 cubic feet. Other dimensions may be contemplated as well. The spot cleaner apparatus 10, 1010 may thus be a compact device that may be stored in a 1 cubic foot container and be easily transportable when required.

As can be seen therefore, the examples described above and illustrated are intended to be exemplary only. The scope is indicated by the appended claims.

What is claimed is:

1. A spot cleaner apparatus comprising:

a clean fluid tank configured for holding a cleaning fluid;

a dirty fluid tank including an integrated liquid/air separator;

a cleaning head fluidly coupled to the clean fluid tank, the cleaning head including one or more vacuum inlets and a fluid-nebulizing orifice configured to dispense the cleaning fluid in a mist-like fashion;

a pump assembly fluidly coupling the clean fluid tank to the cleaning head;

a fluid heater configured to heat the cleaning fluid at or between the clean fluid tank and the fluid-nebulizing orifice; and a vacuum assembly configured for drawing a vacuum airflow from one or more vacuum inlets in the cleaning head through the integrated liquid/air separator in the dirty fluid tank;

wherein the integrated liquid/air separator includes a pair of separator tubes integrally formed in and projecting from a bottom wall of the dirty fluid tank, a first of the pair of separator tubes in fluid communication with the cleaning head and a second of the pair of separator tubes in fluid communication with the vacuum assembly.

2. The spot cleaner apparatus as defined in claim 1, wherein the fluid heater is configured for heating the cleaning fluid to a temperature below the boiling point of the cleaning fluid.

3. The spot cleaner apparatus as defined in claim 2, wherein the fluid heater is configured for heating the cleaning fluid to a temperature of about 60 degrees Celsius.

4. The spot cleaner apparatus as defined in claim 1, wherein the clean fluid tank is non-removably received on a main housing.

5. The spot cleaner apparatus as defined in claim 1, wherein the first of the pair of separator tubes includes a check valve configured to prevent backflow into an inlet of the first of the pair of separator tubes, and the second of the pair of separator tubes includes a float configured to prevent rising fluid in the dirty fluid tank from entering into the second of the pair of separator tubes.

6. The spot cleaner apparatus as defined in claim 1, wherein the cleaning head includes a plurality of side-by-side of the one or more vacuum inlets disposed adjacent a plurality of brushes.

7. The spot cleaner apparatus as defined in claim 1, wherein the dirty fluid tank includes a dirty fluid tank base with a gasket extending about an upper end of the dirty fluid tank base and a dirty fluid tank lid removably mounted to the upper end of the dirty fluid tank base.

8. The spot cleaner apparatus as defined in claim 1, wherein the clean fluid tank includes a clean fluid tank base with a gasket extending about an upper end of the clean fluid tank base and a clean fluid tank lid removably mounted to the upper end of the clean fluid tank base.

9. The spot cleaner apparatus as defined in claim 1, wherein the pump assembly is disposed upstream of the fluid heater relative to a direction of the cleaning fluid flowing through the spot cleaner apparatus.

10. The spot cleaner apparatus as defined in claim 1, wherein a main housing includes a base portion and a casing defining an inner cavity, the inner cavity housing the pump assembly and the vacuum assembly.

11. The spot cleaner apparatus as defined in claim 1, further comprising a handle mounted to a main housing and rotatable about a vertical axis between an unlocked position whereby the dirty fluid tank and the clean fluid tank are unblocked by the handle in a vertical direction and a locked position whereby the dirty fluid tank and the clean fluid tank are blocked by the handle in the vertical direction.

12. A spot cleaner apparatus comprising:

a fluid delivery system comprising a clean fluid tank receivable on a main housing of the spot cleaner apparatus, and a pump assembly fluidly coupling the clean fluid tank to a cleaning head to deliver a cleaning fluid stored in the clean fluid tank via a fluid-ejecting orifice in the cleaning head; and a fluid recovery system comprising a dirty fluid tank receivable on the main housing and a vacuum assembly fluidly coupling the dirty fluid tank to the cleaning head to draw a vacuum airflow from one or more vacuum inlets in the cleaning head through an integrated liquid/air separator in the dirty fluid tank;

wherein the integrated liquid/air separator includes a pair of separator tubes integrally formed in and projecting from a bottom wall of the dirty fluid tank, a first of the pair of separator tubes in fluid communication with the cleaning head and a second of the pair of separator tubes in fluid communication with the vacuum assembly.

13. The spot cleaner apparatus as defined in claim 12, wherein the fluid delivery system further comprises a fluid heater configured to heat the cleaning fluid before delivery via the cleaning head.

14. The spot cleaner apparatus as defined in claim 12, wherein the cleaning head is fluidly coupled to the main housing via a partitioned hose configured to simultaneously deliver the cleaning fluid from the clean fluid tank to the cleaning head and draw airflow from the cleaning head towards the dirty fluid tank.

15. The spot cleaner apparatus as defined in claim 12, further comprising a control panel on an outside surface of the main housing, the control panel operatively connected to a printed circuit board configured to control one or more operations of the fluid delivery system and the fluid recovery system.

16. The spot cleaner apparatus as defined in claim 12, wherein the clean fluid tank is non-removably received on the main housing.

17. The spot cleaner apparatus as defined in claim 12, wherein the clean fluid tank includes a clean fluid tank base with a gasket extending about an upper end of the clean fluid tank and a clean fluid tank lid removably mounted to the upper end of the clean fluid tank base.

18. The spot cleaner apparatus as defined in claim 12, wherein the fluid-ejecting orifice in the cleaning head is a fluid nebulizer configured to disperse the cleaning fluid in a mist-like fashion.

19. A spot cleaner apparatus comprising:

a clean fluid tank configured for holding a cleaning fluid;

a dirty fluid tank including an integrated liquid/air separator;

a cleaning head fluidly coupled to the clean fluid tank, the cleaning head including one or more vacuum inlets and a fluid-nebulizing orifice configured to dispense the cleaning fluid in a mist-like fashion;

a pump assembly fluidly coupling the clean fluid tank to the cleaning head;

a fluid heater configured to heat the cleaning fluid at or between the clean fluid tank and the fluid-nebulizing orifice; and a vacuum assembly configured for drawing a vacuum airflow from one or more vacuum inlets in the cleaning head through the integrated liquid/air separator in the dirty fluid tank;

wherein the dirty fluid tank includes a dirty fluid tank base with a gasket extending about an upper end of the dirty fluid tank base and a dirty fluid tank lid removably mounted to the upper end of the dirty fluid tank base, and wherein the clean fluid tank includes a clean fluid tank base with a gasket extending about an upper end of the clean fluid tank base and a clean fluid tank lid removably mounted to the upper end of the clean fluid tank base.

20. A spot cleaner apparatus comprising:

a clean fluid tank configured for holding a cleaning fluid;

a dirty fluid tank including an integrated liquid/air separator;

a cleaning head fluidly coupled to the clean fluid tank, the cleaning head including one or more vacuum inlets and a fluid-nebulizing orifice configured to dispense the cleaning fluid in a mist-like fashion;

a pump assembly fluidly coupling the clean fluid tank to the cleaning head;

a fluid heater configured to heat the cleaning fluid at or between the clean fluid tank and the fluid-nebulizing orifice; and a vacuum assembly configured for drawing a vacuum airflow from one or more vacuum inlets in the cleaning head through the integrated liquid/air separator in the dirty fluid tank;

wherein the clean fluid tank includes a clean fluid tank base with a gasket extending about an upper end of the clean fluid tank base and a clean fluid tank lid removably mounted to the upper end of the clean fluid tank base.

21. A spot cleaner apparatus comprising:

a clean fluid tank configured for holding a cleaning fluid;

a dirty fluid tank including an integrated liquid/air separator;

a cleaning head fluidly coupled to the clean fluid tank, the cleaning head including one or more vacuum inlets and a fluid-nebulizing orifice configured to dispense the cleaning fluid in a mist-like fashion;

a pump assembly fluidly coupling the clean fluid tank to the cleaning head;

a fluid heater configured to heat the cleaning fluid at or between the clean fluid tank and the fluid-nebulizing orifice;

a vacuum assembly configured for drawing a vacuum airflow from one or more vacuum inlets in the cleaning head through the integrated liquid/air separator in the dirty fluid tank; and a handle mounted to a main housing and rotatable about a vertical axis between an unlocked position whereby the dirty fluid tank and the clean fluid tank are unblocked by the handle in a vertical direction and a locked position whereby the dirty fluid tank and the clean fluid tank are blocked by the handle in the vertical direction.

22. A spot cleaner apparatus comprising:

a fluid delivery system comprising a clean fluid tank receivable on a main housing of the spot cleaner apparatus, and a pump assembly fluidly coupling the clean fluid tank to a cleaning head to deliver a cleaning fluid stored in the clean fluid tank via a fluid-ejecting orifice in the cleaning head; and a fluid recovery system comprising a dirty fluid tank receivable on the main housing and a vacuum assembly fluidly coupling the dirty fluid tank to the cleaning head to draw a vacuum airflow from one or more vacuum inlets in the cleaning head through an integrated liquid/air separator in the dirty fluid tank;

wherein the clean fluid tank includes a clean fluid tank base with a gasket extending about an upper end of the clean fluid tank and a clean fluid tank lid removably mounted to the upper end of the clean fluid tank base.

23. The spot cleaner apparatus as defined in claim 19, further comprising a handle mounted to a main housing and rotatable about a vertical axis between an unlocked position whereby the dirty fluid tank and the clean fluid tank are unblocked by the handle in a vertical direction and a locked position whereby the dirty fluid tank and the clean fluid tank are blocked by the handle in the vertical direction.

24. The spot cleaner apparatus as defined in claim 20, further comprising a handle mounted to a main housing and rotatable about a vertical axis between an unlocked position whereby the dirty fluid tank and the clean fluid tank are unblocked by the handle in a vertical direction and a locked position whereby the dirty fluid tank and the clean fluid tank are blocked by the handle in the vertical direction.

* * * * *